US010648141B2

(12) United States Patent
Merrill et al.

(10) Patent No.: US 10,648,141 B2
(45) Date of Patent: May 12, 2020

(54) AUTOMATED RUMBLE STRIP ASSEMBLY

(71) Applicant: THE BOARD OF REGENTS OF THE NEVADA SYSTEM OF HIGHER EDUCATION ON BEHALF OF THE UNIVERSITY OF NEVADA, LAS VEGAS, Las Vegas, NV (US)

(72) Inventors: Steve Merrill, Minden, NV (US); Alexander Paz, Henderson, NV (US)

(73) Assignee: THE BOARD OF REGENTS OF THE NEVADA SYSTEM OF HIGHER EDUCATION ON BEHALF OF THE UNIVERSITY OF NEVADA, LAS VEGAS, Las Vegas, NV (US)

( * ) Notice: Subject to any disclaimer, the term of this patent is extended or adjusted under 35 U.S.C. 154(b) by 160 days.

(21) Appl. No.: 15/892,659

(22) Filed: Feb. 9, 2018

(65) Prior Publication Data

US 2018/0163353 A1 Jun. 14, 2018

Related U.S. Application Data

(63) Continuation-in-part of application No. 15/233,535, filed on Aug. 10, 2016.

(51) Int. Cl.
*E01F 9/529* (2016.01)
*E01F 9/565* (2016.01)

(52) U.S. Cl.
CPC ..... *E01F 9/529* (2016.02); *E01F 9/565* (2016.02)

(58) Field of Classification Search
CPC ..... E01F 9/529; E01F 13/046; E01F 9/565
(Continued)

(56) References Cited

U.S. PATENT DOCUMENTS 1,356,922 A 10/1920 Keenan
1,365,165 A * 1/1921 Garcia ..... A01K 3/002 49/33
(Continued)

FOREIGN PATENT DOCUMENTS

EP 1995381 A2 11/2008
FR 1023189 A * 3/1953 ..... E01F 9/529
(Continued)

OTHER PUBLICATIONS

International Search Report and Written Opinion for Application No. PCT/US2019/015987 dated May 8, 2019 (10 pages).
(Continued)

*Primary Examiner* — Thomas B Will
*Assistant Examiner* — Katherine J Chu
(74) *Attorney, Agent, or Firm* — Michael Best & Friedrich LLP

(57) ABSTRACT

An automated rumble strip assembly includes a frame having a top surface configured to support a vehicle tire moving along the frame. The automated rumble strip assembly also includes a plurality of elongate members disposed within the frame, wherein each elongate member includes an elongate member housing, an internal carriage assembly disposed within the elongate member housing and moveable within the elongate member housing, and an actuator assembly coupled to the internal carriage configured to move the internal carriage relative to the elongate member housing.

21 Claims, 57 Drawing Sheets

(58) Field of Classification Search
USPC ..... 404/9, 11, 15
See application file for complete search history.

(56) References Cited

U.S. PATENT DOCUMENTS

| | | | | | |
|---|---|---|---|---|---|
| 1,497,073 | A * | 6/1924 | Doyle | E01F 13/046 | 49/360 |
| 1,649,877 | A * | 11/1927 | Walston | E01F 9/529 | 49/273 |
| 1,960,376 | A | 5/1934 | Gilman | | |
| 2,200,739 | A * | 5/1940 | Evans | B61L 29/24 | 340/940 |
| 2,244,117 | A * | 6/1941 | Preston | E01F 9/529 | 238/3 |
| 2,457,512 | A * | 12/1948 | Wheeler | E01F 9/529 | 404/15 |
| 3,325,782 | A | 6/1967 | Der | | |
| 3,838,391 | A | 9/1974 | Mintz | | |
| 4,012,156 | A | 3/1977 | Turner et al. | | |
| 4,342,525 | A * | 8/1982 | Mastronuzzi, Jr. | E01F 9/529 | 404/6 |
| 4,775,261 | A * | 10/1988 | Fladung | E01F 13/08 | 404/6 |
| 4,790,684 | A | 12/1988 | Adams | | |
| 4,921,074 | A | 5/1990 | Ochs | | |
| 5,479,809 | A | 1/1996 | Stachuletz et al. | | |
| 5,509,753 | A | 4/1996 | Thompson | | |
| 5,582,490 | A | 12/1996 | Murray | | |
| 5,676,490 | A | 10/1997 | Nelson | | |
| 6,226,592 | B1 | 5/2001 | Luckscheiter et al. | | |
| 6,997,638 | B2 * | 2/2006 | Hensley | E01F 13/046 | 404/6 |
| 7,011,470 | B1 * | 3/2006 | Breazeale | E01F 9/529 | 404/10 |
| 7,731,448 | B2 | 6/2010 | Fillie | | |
| 8,226,322 | B2 * | 7/2012 | Blair | E01F 13/123 | 404/11 |
| 8,439,594 | B1 | 5/2013 | Clark et al. | | |
| 8,623,056 | B2 | 1/2014 | Linares | | |
| 8,711,004 | B2 | 4/2014 | Gabara et al. | | |
| 8,956,072 | B2 * | 2/2015 | Brackin | E01F 13/08 | 404/6 |
| 9,677,232 | B2 * | 6/2017 | Zwerneman | E01F 9/529 | |
| 9,683,339 | B2 | 6/2017 | Thompson et al. | | |
| 9,689,121 | B2 * | 6/2017 | Shi | E01F 9/529 | |
| 9,840,817 | B2 | 12/2017 | Wallinder | | |
| 2005/0045914 | A1 | 3/2005 | Agranat et al. | | |
| 2007/0160420 | A1 * | 7/2007 | Aoki | E01F 15/006 | 404/6 |
| 2010/0075771 | A1 | 3/2010 | Martens | | |
| 2012/0070217 | A1 | 3/2012 | Hendricks et al. | | |
| 2012/0216220 | A1 | 8/2012 | Huang et al. | | |
| 2013/0189030 | A1 | 7/2013 | Miracle | | |
| 2014/0227031 | A1 * | 8/2014 | Fifi | E01F 9/529 | 404/15 |
| 2015/0376849 | A1 | 12/2015 | Thompson et al. | | |
| 2018/0044866 | A1 | 2/2018 | Merrill et al. | | |
| 2018/0298570 | A1 * | 10/2018 | Abu Al-Rubb | E01F 9/529 | |
| 2019/0063019 | A1 * | 2/2019 | Collier, Jr. | E01F 13/046 | |

FOREIGN PATENT DOCUMENTS

| | | | | |
|---|---|---|---|---|
| FR | 2927338 | A1 * | 8/2009 | E01F 9/529 |
| GB | 2079356 | A * | 1/1982 | E01F 13/08 |
| GB | 2296277 | A | 6/1996 | |
| GB | 2397603 | A * | 7/2004 | E01F 9/529 |
| JP | 05065708 | A * | 3/1993 | |
| JP | 2001152417 | A * | 6/2001 | |
| WO | WO-9419544 | A1 * | 9/1994 | E01F 9/529 |
| WO | WO-2008129108 | A1 * | 10/2008 | E01F 9/529 |
| WO | WO-2012057679 | A1 * | 5/2012 | E01F 9/529 |
| WO | 2014102411 | A1 | 7/2014 | |
| WO | 2017/094037 | A1 | 6/2017 | |
| WO | 2019/017760 | A1 | 1/2019 | |

OTHER PUBLICATIONS

Nevada Department of Transportation, "Prototyping and Field Testing of a Demand-Responsive Rumble Strip Mechanism," NDOT Research Report No. 224-14-803 to Jul. 17, 2018, 186 pages.
Office Action from the U.S. Appl. No. 15/233,535 dated Jun. 19, 2019 (13 pages).
Office Action from the U.S. Patent and Trademark Office for U.S. Appl. No. 15/233,535 dated Apr. 20, 2018 (13 pages).
Office Action from U.S. Patent and Trademark Office for U.S. Appl. No. 15/233,535 dated Nov. 13, 2019 (13 pages).

* cited by examiner

AUTOMATED RUMBLE STRIP ASSEMBLY

CROSS-REFERENCE TO RELATED APPLICATIONS

This application is a continuation-in-part of U.S. application Ser. No. 15/233,535, filed Aug. 10, 2016, the entire contents of which are incorporated herein by reference.

BACKGROUND

The present disclosure relates to rumble strip assemblies, and to the use of rumble strip assemblies to raise levels of driver attention on roadways.

Driver errors due to lack of driver attention and distracted driving contribute significantly to the occurrence and the severity of vehicle crashes, and to pedestrian injuries and fatalities. However, changing driver behavior is difficult. While law enforcement is an effective mechanism to improve driver behavior (e.g., through issuance of tickets and monitoring/patrol), it is impossible both from a cost and logistical standpoint to have law enforcement presence at each and every location along a roadway. Thus, there is a need for systems and mechanisms that will effectively raise levels of driver attention on roadways, and that will facilitate a reduction in the number and/or severity of crashes.

SUMMARY

In accordance with one construction, an automated rumble strip assembly includes a frame having a top surface configured to support a vehicle tire moving along the frame. The automated rumble strip assembly also includes a plurality of elongate members disposed within the frame. Each elongate member includes an elongate member housing, an internal carriage assembly disposed within the elongate member housing and moveable within the elongate member housing, and an actuator assembly coupled to the internal carriage configured to move the internal carriage relative to the elongate member housing.

In accordance with another construction, an automated rumble strip assembly includes a frame having a top surface configured to support a vehicle tire moving along the frame. The automated rumble strip assembly also includes a plurality of elongate members disposed within the frame and movable relative to the top surface. Each elongate member includes an elongate member housing, and an actuator assembly disposed at least partially within the elongate member housing and configured to move the elongate member housing between a raised position and a recessed position relative to the top surface of the frame. The actuator assembly is configured to move with the elongate member housing between the raised position and the recessed position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

FIGS. 1-22 illustrate an automated rumble strip assembly 10. The automated rumble strip assembly 10 may be used to raise a level of driver attention on roadways, and to facilitate a reduction in a number and/or severity of crashes. In some constructions, the automated rumble strip assembly 10 is sized and shaped to be integrally formed as part of a newly constructed roadway. In other constructions, the rumble strip assembly 10 is sized and shaped so as to be a retrofit for an existing roadway.

Figure 1:
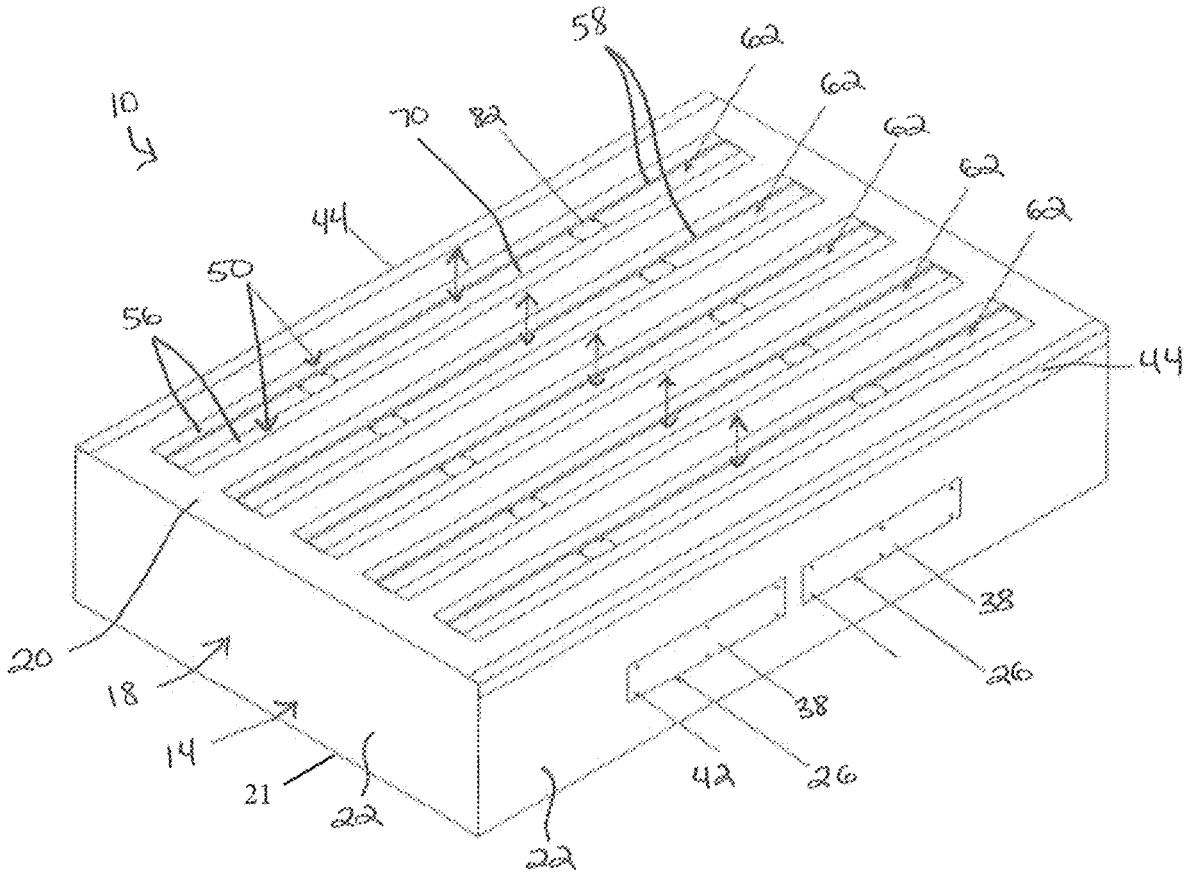
FIG. 1 is a perspective view of an automated rumble strip assembly according to one embodiment.
Figure 2:
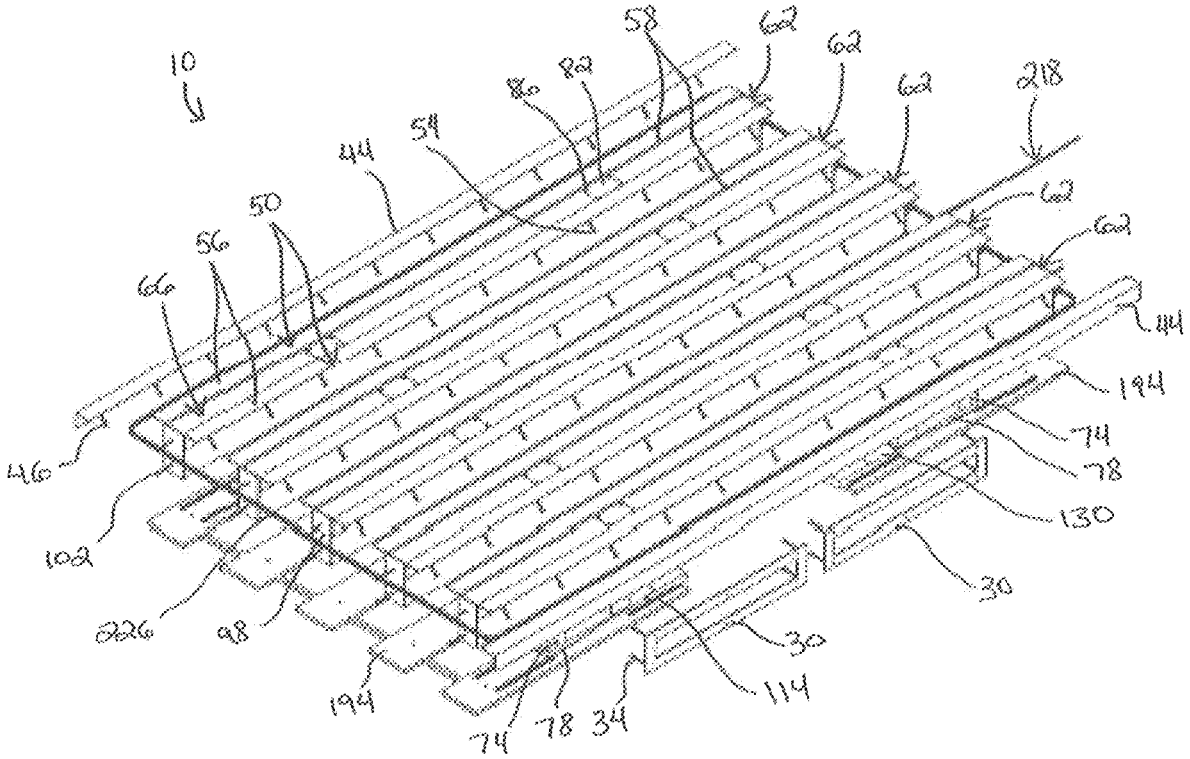
FIG. 2 is a perspective view of the automated rumble strip assembly, with a frame removed.
Figure 3:
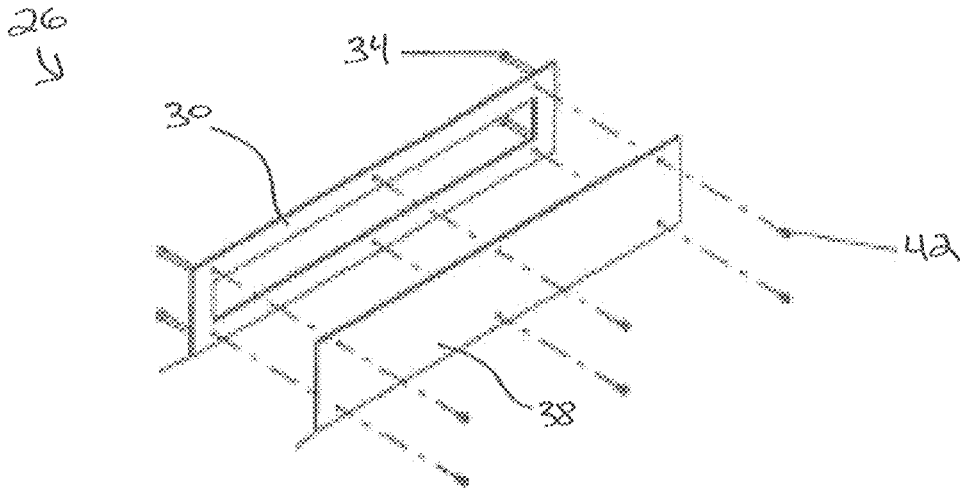
FIG. 3 is a perspective, exploded view of an access frame and an access plate of the automated rumble strip assembly.

With reference to FIGS. 1-3, the automated rumble strip assembly 10 includes a frame 14. In the illustrated construction the frame 14 is a generally box-like structure. In other constructions the frame 14 has other shapes and/or sizes than that illustrated. The frame 14 includes a main housing 18 having a top surface 20 (e.g., a planar top surface), a bottom surface 21, and at least one side surface 22 that extends (e.g., perpendicularly and downwardly) from the top surface 20. In the illustrated construction the main housing 18 is made of concrete, although in other constructions the main housing 18 is made of material other than concrete.

With continued reference to FIGS. 1-3, the frame 14 also includes access assemblies 26 disposed along one of the side surfaces 22. Each access assembly 26 includes its own access frame 30 (FIGS. 2 and 3) coupled to one of the side surfaces 22 with welded studs 34, and an access plate 38 coupled to the access frame 30 with access plate bolts 42 (FIGS. 1 and 3). The access plates 38 may be removed to access components inside of the main housing 18, and to inspect, repair and/or replace the components. While the illustrated construction includes two access assemblies 26, other constructions include different numbers of access assemblies 26 than that illustrated. In some constructions, the frame 14 does not include any access assemblies 26. In some constructions, the access assembly or assemblies 26 are located along a different side surface 22 than that illustrated, or are located along the top surface 20 of the main housing 18.

With reference to FIGS. 1 and 2, the frame 14 also includes edge plates 44 that provide added structural stability to the automated rumble strip assembly 10. In the illustrated construction the frame 14 includes two edge plates 44 that fit over opposite edges of the main housing 18, and are coupled to the main housing 18 with welded studs 46 (FIG. 2). The edge plates 44 each have a generally L-shaped angled profile, with one portion of each of the L-shaped angled profiles contacting the top surface 20 of the main housing 18, and the other portion contacting one of the side surfaces 22. In some constructions, the frame 14 includes a different number of edge plates 44 than that illustrated, and/or includes edge plates 44 having different shapes and/or sizes than that illustrated. In some constructions, the frame 14 does not include any edge plates 44.

With continued reference to FIGS. 1 and 2, the frame 14 further includes guiding angle plates 50 that provide added structural stability to the automated rumble strip assembly 10. In the illustrated construction, the frame 14 includes five pairs of guiding angle plates 50 that are each coupled to the top surface 20 of the main housing 18 with welded studs 54 (FIG. 2), and extend parallel to one another along the top surface 20. The guiding angle plates 50 each include a top surface 56 (e.g., a planar top surface). In some constructions, the frame 14 includes a different number of guiding angle plates 50 than that illustrated, and/or includes guiding angle plates 50 having different shapes and/or sizes than that illustrated. In some constructions, the frame 14 does not include any guiding angle plates 50.

Figure 15:
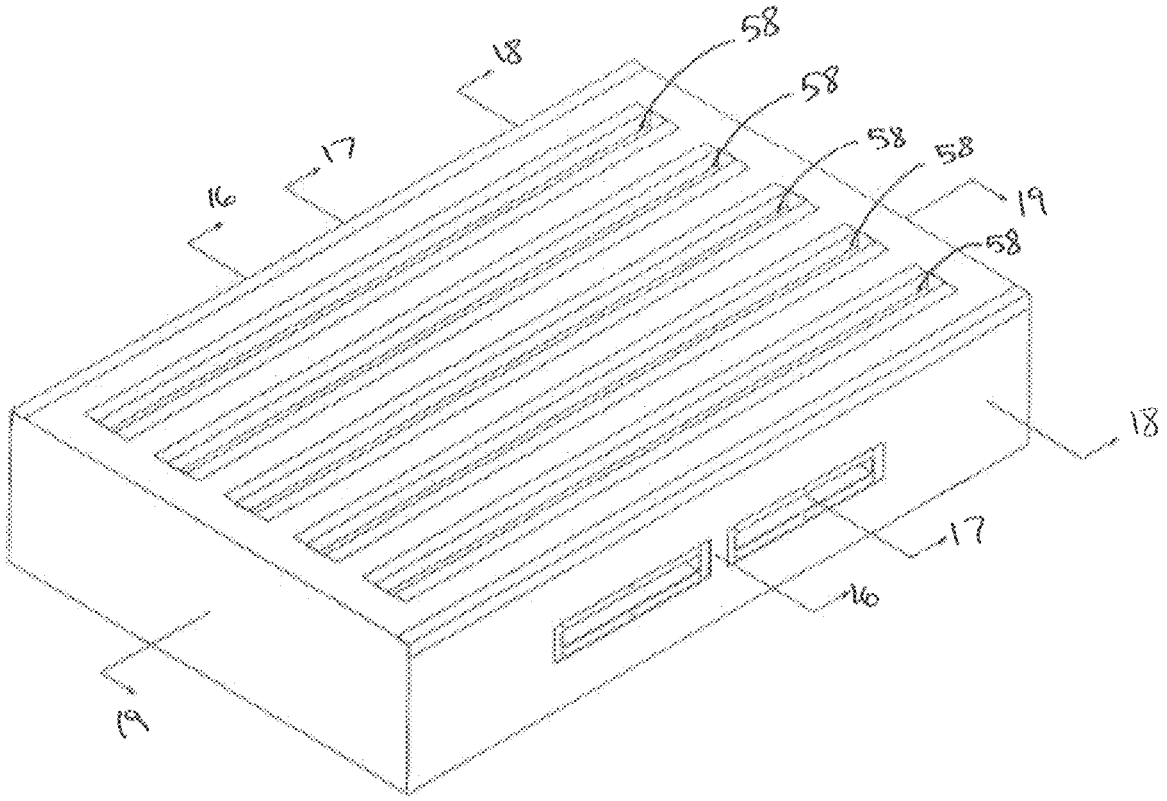
FIG. 15 is a perspective view of the automated rumble strip assembly, with the elongate members removed.
Figure 16:
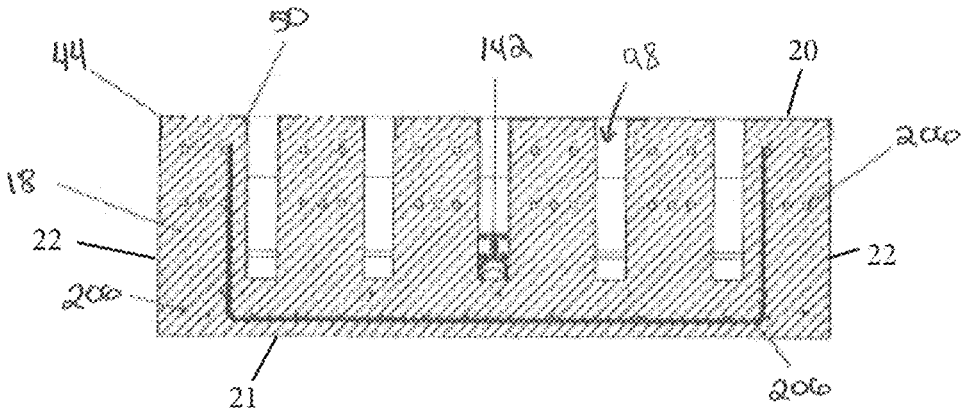
FIG. 16 is a cross-sectional view of the automated rumble strip assembly, taken along lines 16-16 in FIG. 15.

With reference to FIGS. 1 and 15, the frame 14 also includes a plurality of elongate apertures 58 that are open and exposed along the top surface 20 of the main housing 18. As illustrated in FIG. 1, each of the elongate apertures 58 is positioned between a pair of the guiding angle plates 50, and extends parallel to each of the other elongate apertures 58.

With reference to FIGS. 1, 2, and 4-6, the automated rumble strip assembly 10 also includes a plurality of movable, elongate members 62 that are disposed at least partially within the frame 14. In the illustrated construction the automated rumble strip assembly 10 includes five elongate members 62 that are spaced equally apart from one another and are parallel to one another. However, in other constructions the number and/or arrangement of elongate members 62 is different.

Figure 4:
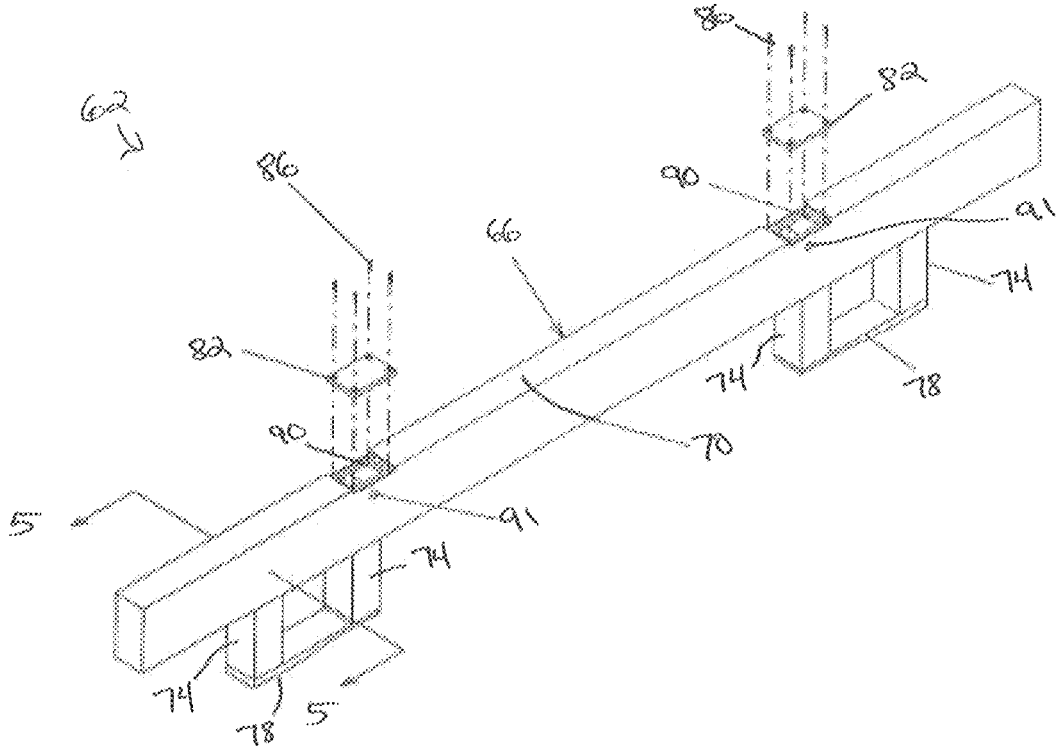
FIG. 4 is a perspective, exploded view of an elongate member of the automated rumble strip assembly.

With reference to FIG. 4, each of the elongate members 62 includes an upper body 66. Each of the upper bodies 66 is generally rectangular in cross-section, and includes a top surface 70. In the illustrated construction, each of upper bodies 66 is sized and shaped to move within one of the elongate apertures 58 (e.g., along the direction of the arrows in FIG. 1).

With continued reference to FIG. 4, each of the elongate members 62 also includes at least one support member 74 coupled to and extending beneath the upper body 66. The support members 74 support the upper body 66. In the illustrated construction, each of the elongate members 62 includes four support members 74 extending perpendicularly below the upper body 66. In other constructions, the elongate members 62 include a different number and/or arrangement of support members 74.

With continued reference to FIG. 4, each of the elongate members 62 includes at least one base portion 78 that is coupled to and disposed below the support member 74. In the illustrated construction, each of the elongate members 62 includes two base portions 78. Each of the base portions 78 is coupled to two of the support members 74. In other constructions, the elongate members 62 include a different number and/or arrangement of base portions 78.

With continued reference to FIG. 4, each of the elongate members 62 also includes at least one elongate member access plate 82 that is coupled to the upper body 66 with bolts 86. When the access plate 82 is removed, an access frame 90 and lifting rod 91 are exposed inside of the upper body 66. In some constructions, the lifting rod 91 may be used to lift and/or move the elongate member 62. While the illustrated construction includes two access plates 82, other constructions include different numbers of access plates 82 than that illustrated. In some constructions, the elongate members 62 do not include any access plates 82, access plate frames 90, and/or lifting rods 91. In some constructions, the access plates 82 are located along a different surface of the elongate member 62 than that illustrated.

Figure 5:
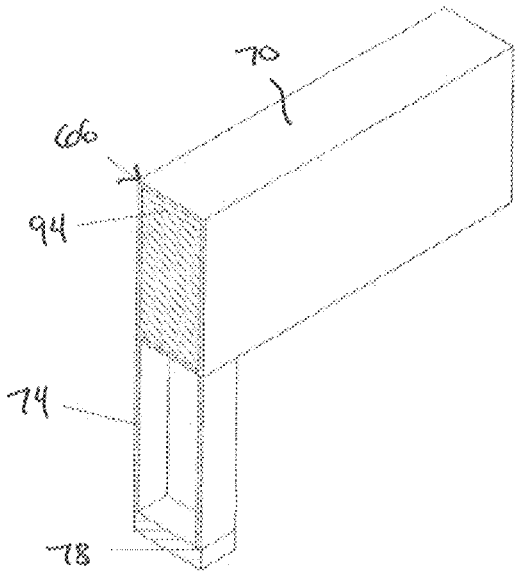
FIG. 5 is a cross-sectional view of the elongate member, taken through lines 5-5 in FIG. 4.

With reference to FIG. 5, each elongate member 62 also includes a dampening material 94 disposed within the upper body 66. The dampening material 94 at least partially fills an interior, hollow space in the upper body 66, and acts to dampen sound and/or vibrations as a vehicle travels over the automated rumble strip assembly 10. In some constructions, the dampening material is sand or fluid such as water or oil, although other constructions include different materials. In some constructions, the upper body 66 does not include any dampening material.

Figure 6:
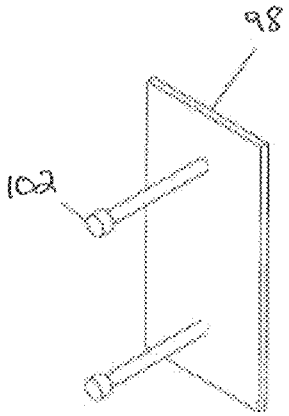
FIG. 6 is a perspective view of an end plate of the automated rumble strip assembly.
Figure 7:
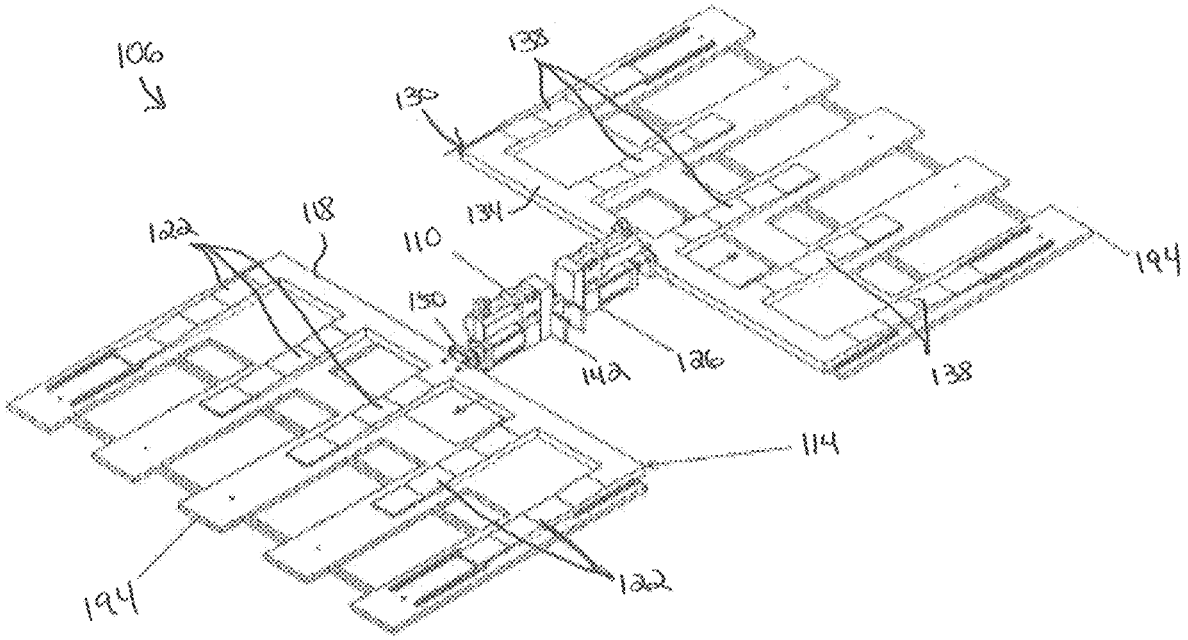
FIG. 7 is a perspective view of an actuator assembly of the automated rumble strip assembly.

With reference to FIGS. 2 and 6, the automated rumble strip assembly 10 also includes end plates 98 that are coupled to the main body 18, to provide added structural stability to the automated rumble strip assembly 10 and guidance for the elongate members 62. In the illustrated construction, the end plates 98 are coupled to the main body 18 with welded studs 102. In some constructions the automated rumble strip assembly 10 does not include end plates 98.

With reference to FIGS. 7-12, the rumble strip assembly 10 also includes an actuator assembly 106. In the illustrated construction, the actuator assembly 106 is disposed entirely within the main housing 18 of the frame 14. However, in other construction at least a portion of the actuator assembly 106 is disposed outside of the main housing 18. The actuator assembly 106 that moves the elongate members 62 from a first position (FIGS. 1, 10A, 10B) where each of the top surfaces 70 (FIGS. 4 and 5) of the elongate members 62 is at a first distance relative to a top surface of the frame 14, to a second position (FIGS. 11A, 11B) where each of the top surfaces 70 of the elongate members 62 is at a second, different distance relative to the top surface of the frame 14. In the illustrated construction, the top surface of the frame 14 corresponds to the top surfaces 56 of the guiding angle plates 50. In some constructions, the top surface of the frame 14 corresponds to the top surface 20 of the main housing 18. In the illustrated construction, each of the top surfaces 70 is flush relative to the top surface of the frame 14 in the first position, and is recessed relative to the top surface of the frame 14 in the second position.

With continued reference to FIGS. 7-12, the actuator assembly 106 includes a first motor 110 and a first wedge plate 114 coupled to and driven linearly by the first motor 110. In the illustrated construction, the first wedge plate 114 includes a first main body 118 and five separate first arms 122 (FIGS. 7 and 8) that extend parallel to one another from the first main body 118. The actuator assembly 106 also includes a second motor 126 and a second wedge plate 130 coupled to and driven linearly by the second motor 126. In the illustrated construction, each of the motors 110, 126 is a high-force electric cylinder, although other constructions include different types of motors. For example, in some constructions the motors 110, 126 are hydraulic cylinders or pneumatic cylinders. In the illustrated construction, the second wedge plate 130 includes a second main body 134 and five separate second arms 138 (FIGS. 7 and 8) that extend parallel to one another from the second main body 134. In other constructions the number of first and second arms 122, 138 is different than that illustrated.

Figure 8:
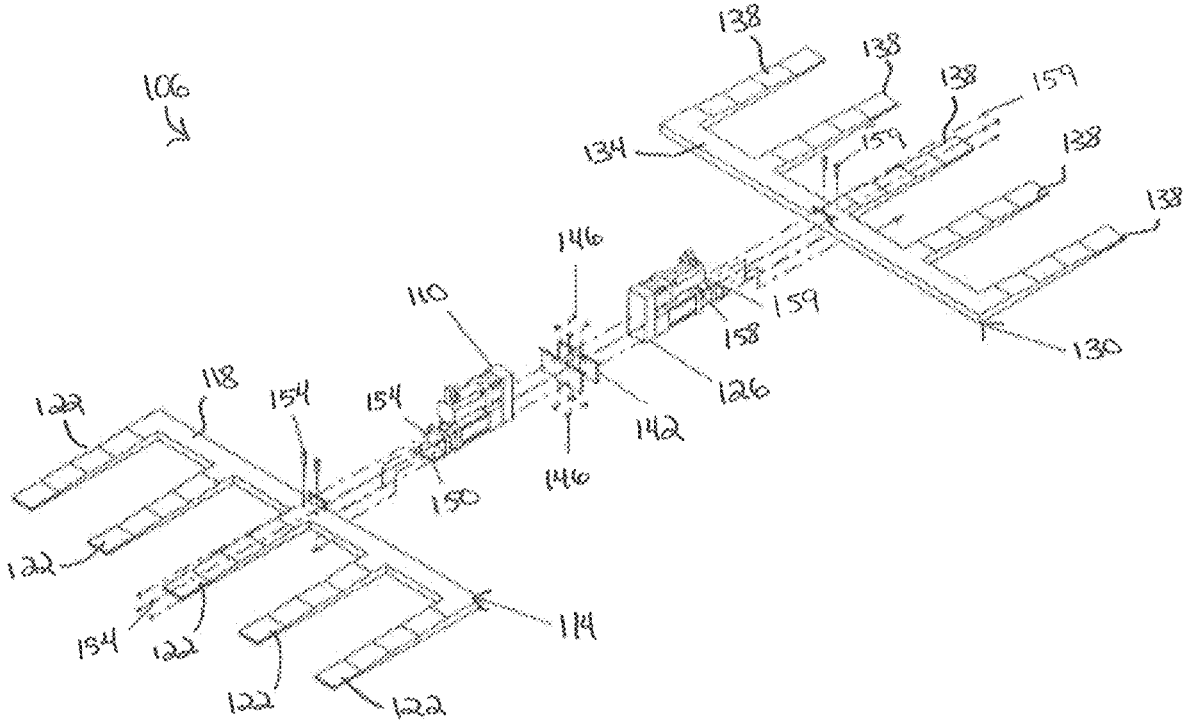
FIG. 8 is a perspective, exploded view of the actuator assembly.

With continued reference to FIGS. 7-12, the first and second motors 110, 126 drive the first wedge plate 114 and the second wedge plate 130 toward and away from one another in opposite directions. The first and second motors 110, 126 are coupled together with a thrust block 142 and thrust block bolts 146 (FIG. 8), such that the first and second motors 110, 126 are disposed between the first wedge plate 114 and the second wedge plate 130. As illustrated in FIG. 8, the first motor 110 is coupled to a first wedge connection plate 150, and the first wedge connection plate 150 is coupled to the first wedge plate 114, with first wedge connection bolts 154. The second motor 126 is coupled to a second wedge connection plate 158, and the second wedge connection plate 158 is coupled to the second wedge plate 130, with second wedge connection bolts 159.

Figure 23:
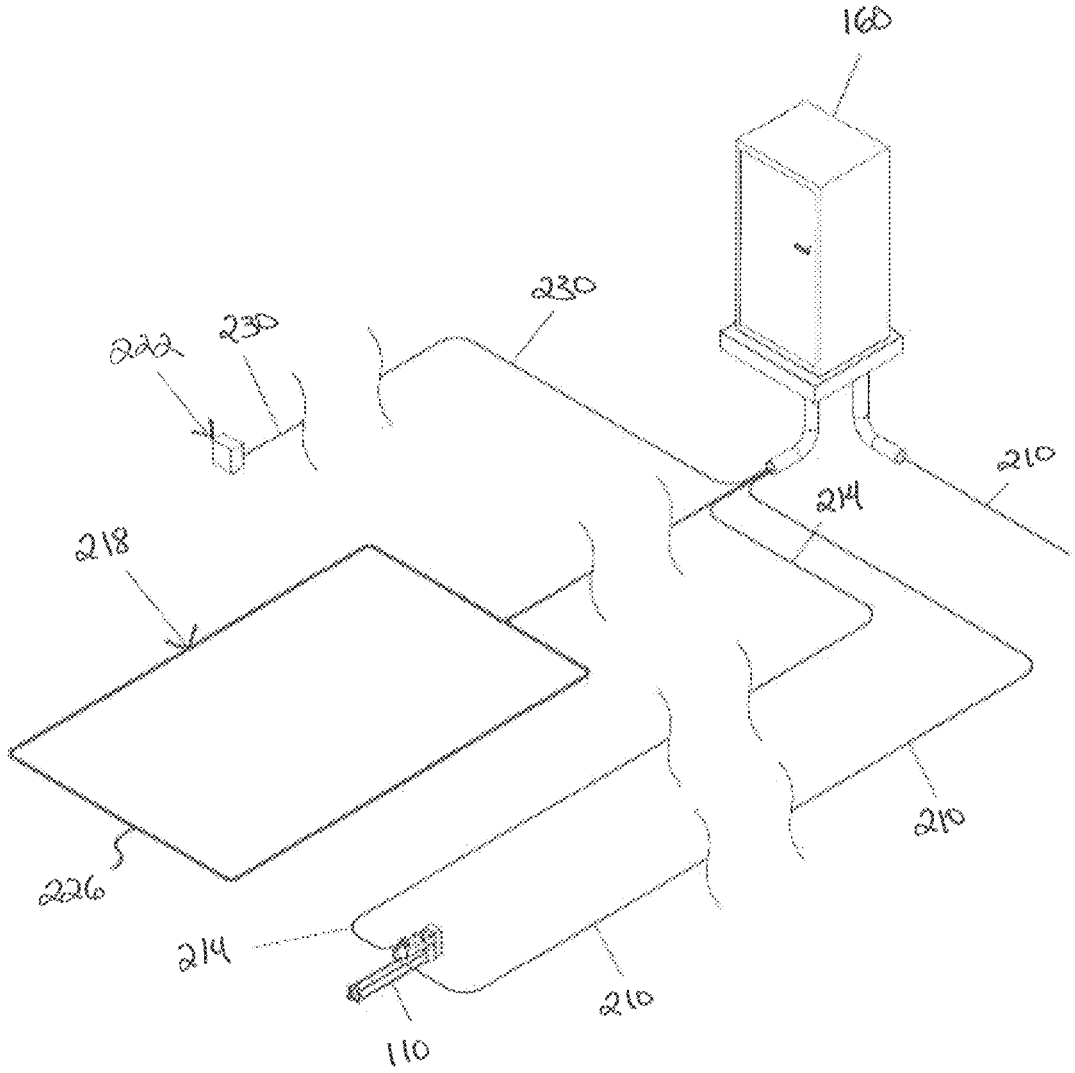
FIG. 23 is a schematic illustration of a wiring system for the automated rumble strip assembly.

With reference to FIGS. 7-12 and 23, the automated rumble strip assembly 10 further includes a controller 160 (FIG. 23) coupled to the actuator assembly 106. In the illustrated construction the controller 160 is coupled to both the first motor 110 and the second motor 126 (although only the first motor 110 is shown in FIG. 23), and controls operation of the first and second motors 110, 126. In some constructions the controller 160 communicates wirelessly with the first and second motors 110, 126. In some constructions the controller 160 is disposed remotely from the actuator assembly 106 and from the frame 14.

With continued reference to FIGS. 7-12, when the first and second motors 110, 126 are actuated via the controller 160 in a first manner, the first and second wedge plates 114, 130 move linearly toward one another and toward the first and second motors 110, 126, thereby moving the plurality of elongate members 62 from the first position (FIGS. 10A, 10B) to the second position (FIGS. 11A, 11B), where the elongate members 62 are recessed. When the first and second motors 110, 126 are actuated via the controller 160 in a second manner, the first and second wedge plates 114, 130 move linearly away from one another and away from the first and second motors 110, 126, thereby moving the plurality of elongate members 62 from the second position (FIGS. 11A, 11B) back to the first position (FIGS. 12A, 12B), where the elongate members 62 are raised.

Figure 9:
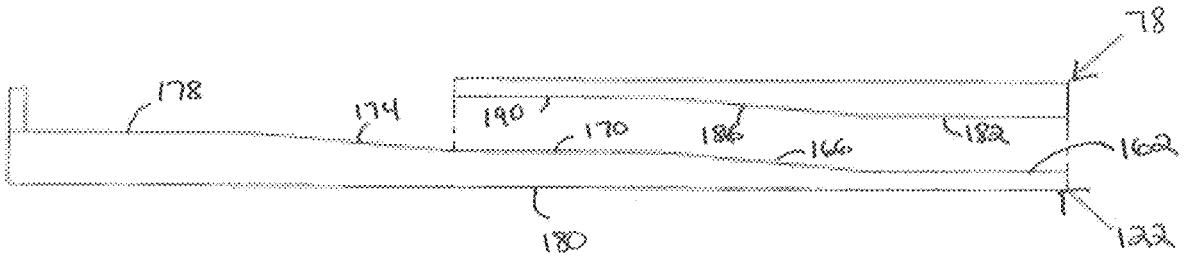
FIG. 9 is a side view of a portion of both the actuator assembly and the elongate member of FIG. 4.
Figure 10A:
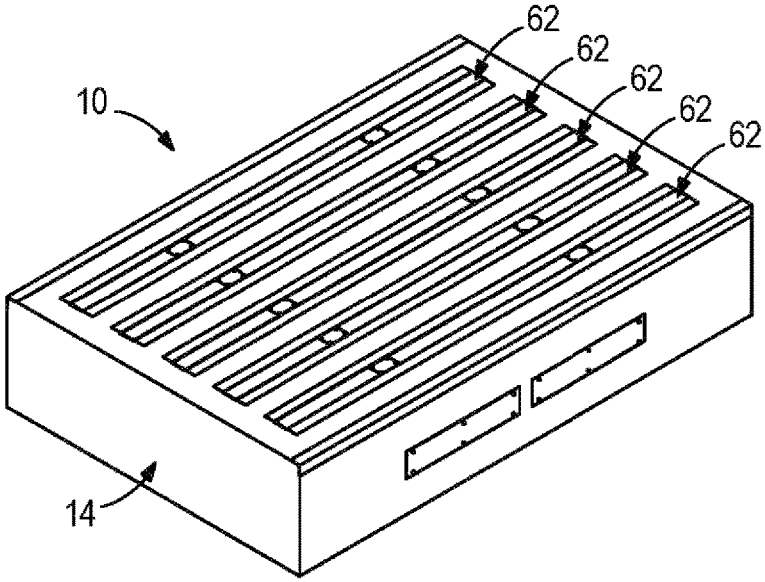
FIGS. 10A and 10B illustrate a first, initial raised position of the elongate members.
Figure 10B:
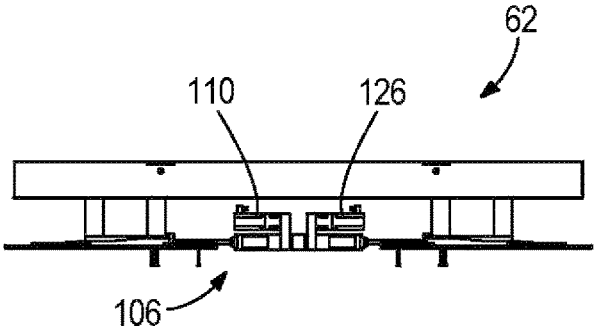
Figure 11A:
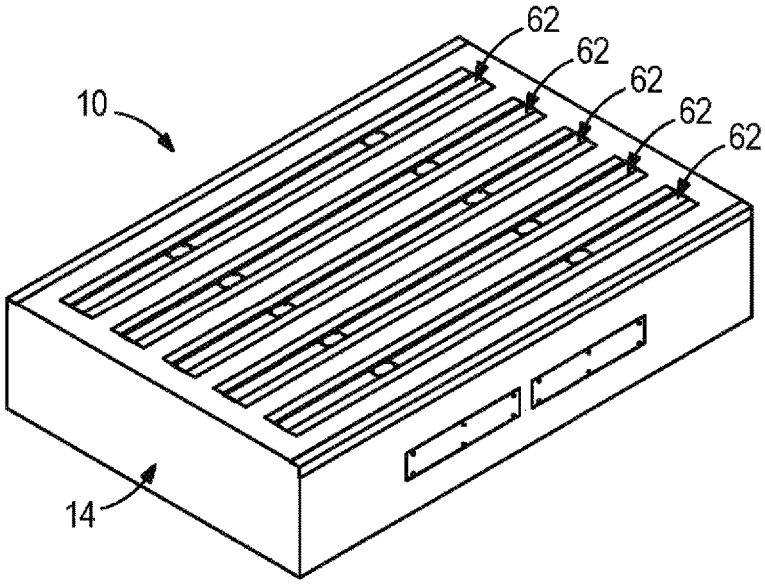
FIGS. 11A and 11B illustrate a second, lowered position of the elongate members, based on a first activation of the actuator assembly.
Figure 11B:
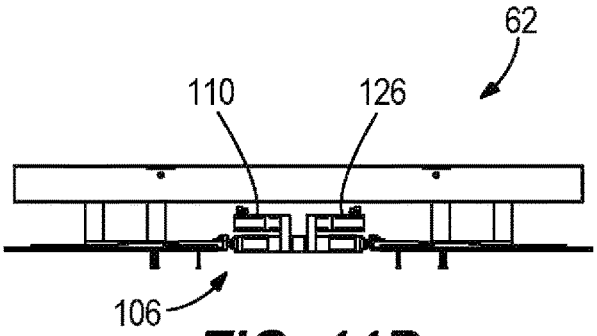
Figure 12A:
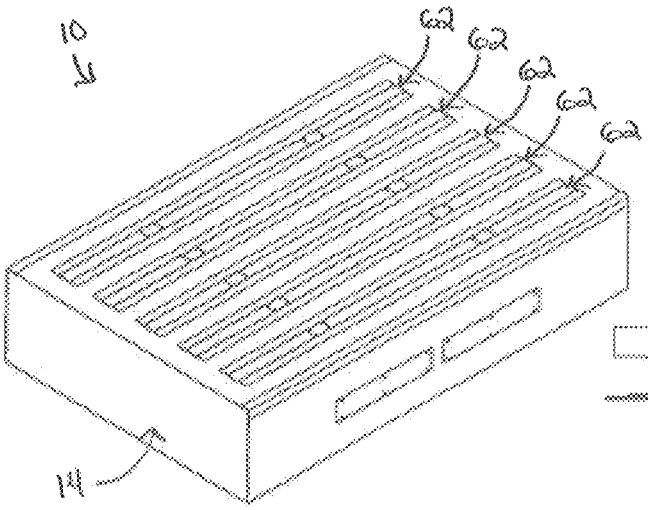
FIGS. 12A and 12B illustrate a third, raised position of the elongate member, based on a second activation of the actuator assembly.
Figure 12B:
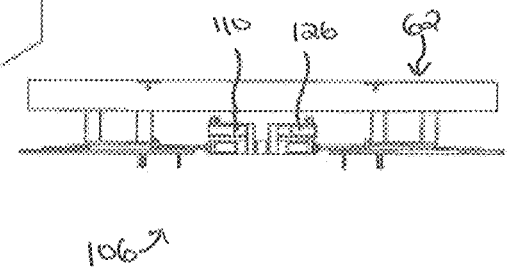
Figure 13:
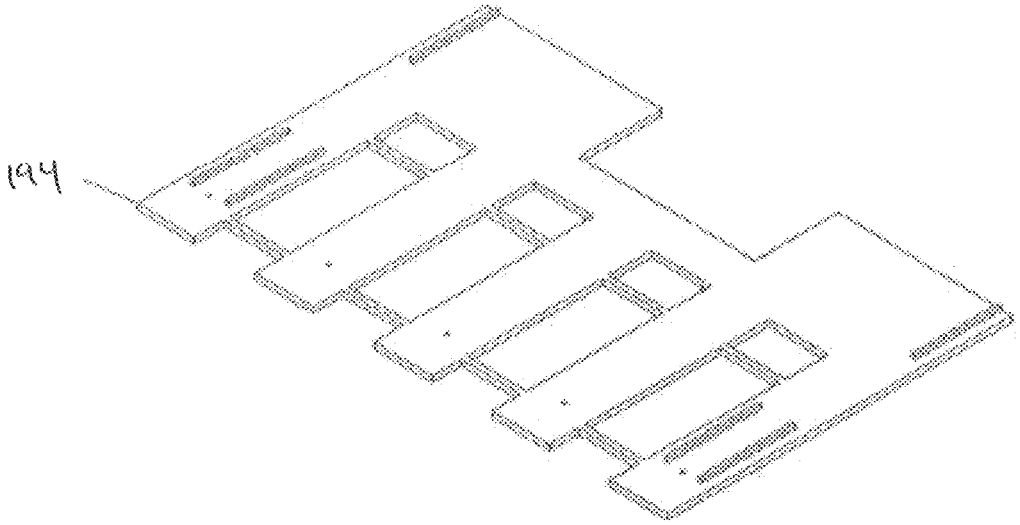
FIGS. 13 and 14 are perspective views of a lower plate of the automated rumble strip assembly.
Figure 14:
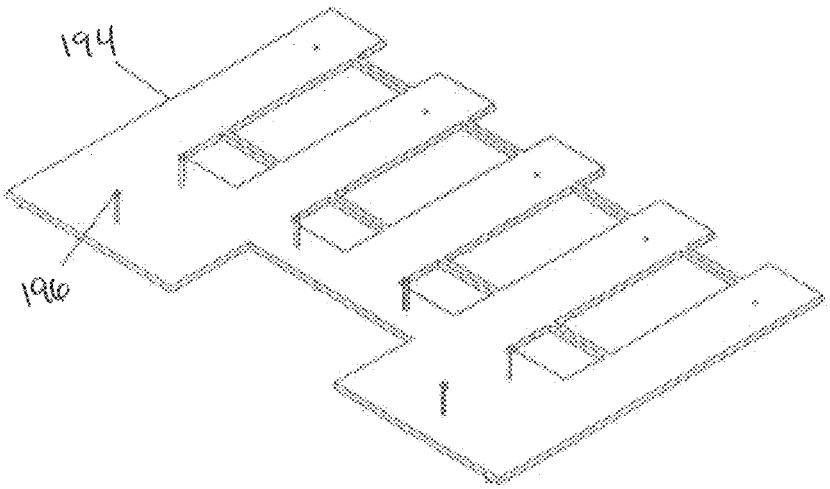

With reference to FIG. 9, each of the first arms 122 (as well as the second arms 138) includes a first surface 162, a second surface 166, a third surface 170, a fourth surface 174, and a fifth surface 178. The first surface 162, the third surface 170, and the fifth surface 178 are parallel to one another and are parallel to the top surface of the frame 14 (e.g., to the top surfaces 56 or the top surface 20). The second surface 166 extends between the first surface 162 and the third surface 170, and is transverse to both the first surface 162 and the third surface 170. The fourth surface 174 extends between the third surface 170 and the fifth surface 178 and is transverse to both the third surface 170 and the fifth surface 178. Each of the first arms 122 (as well as the second arms 138) also includes a lower surface 180.

With continued reference to FIG. 9, each of the base portions 78 of the elongate members 62 includes a first engagement surface 182, a second engagement surface 186, and a third engagement surface 190. The first engagement surface 182 and the third engagement surface 190 are parallel to one another and are parallel to the top surface of the frame 14 (e.g., to the top surfaces 56 or the top surface 20). The second engagement surface 186 extends between the first engagement surface 182 and the third engagement surface 190 and is transverse to both the first engagement surface 182 and the third engagement surface 190.

With continued reference to FIG. 9, when one of the elongate members 62 is in the first position, the first engagement surface 182 of the base portion 78 is engaged with the third surface 170 of the first arm 122, the second engagement surface 186 of the base portion 78 is engaged with the fourth surface 174 of the first arm 122, and the third engagement surface 190 of the base portion 78 is engaged with the fifth surface 178 of the first arm 122.

With continued reference to FIG. 9, when the elongate member 62 is in the second position (e.g., recessed relative to the top surface of the frame 14), the first engagement surface 182 of the base portion 78 is engaged with the first surface 162 of the first arm 122, the second engagement surface 186 of the base portion 78 is engaged with the second surface 166 of the first arm 122, and the third engagement surface 190 of the base portion 78 is engaged with the third surface 170 of the first arm 122.

With continued reference to FIG. 9, in the illustrated construction when the elongate member 62 moves from the first position to the lowered second position (i.e., when the first arm 122 has moved to the position illustrated in FIG. 9), the first engagement surface 182 of the base portion 78 initially slides along the third surface 170 of the first arm 122, and the third engagement surface 190 of the base portion 78 slides along the fifth surface 178 of the first arm 122. The second engagement surface 186 of the base portion 78 slides along the second surface 166 of the first arm 122 until the first engagement surface 182 of the base portion 78 is engaged with the first surface 162 of the first arm 122 and the second engagement surface 186 of the base portion 78 is engaged with the second surface 166 of the first arm 122 and the third engagement surface 190 of the base portion 78 is engaged with the third surface 170 of the first arm 122.

While only a single base portion 78 and a single first arm 122 are illustrated in FIG. 9, the same arrangement and sliding movement described above simultaneously occurs at each of the other base portions 78 and each of the other first and second arms 122, 138 during operation. That is, when the first and second motors 110, 126 are actuated, the elongate members 62 move in unison, and the base portions 78 of the elongate members 62 slide together relative to the first and second arms 122, 138. This arrangement results in a smooth, consistent movement of the elongate members 62 between the first position and the second position, and also from the second position back to the first position.

With reference to FIGS. 2, 7, 13, 14, and 17-19 in the illustrated construction the automated rumble strip assembly 10 also includes lower plates 194. The lower plates 194 are disposed within the main housing 18 of the frame 14, and are positioned below the first and second wedge plates 114, 130. The lower plates 194 are coupled to the main housing 18 with welded studs 196. The lower plates 194 provide added stability and guidance for the first and second wedge plates 114, 130 and for the actuator assembly 106. For example, in some constructions the lower surfaces 180 of the first and second arms 122, 138 slide along the lower plates 194. In some constructions the lower plates 194 are not provided.

Figure 18:
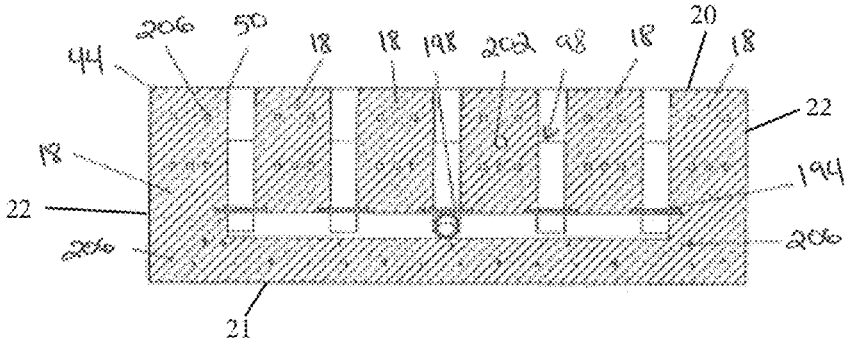
FIG. 18 is a cross-sectional view of the automated rumble strip assembly, taken along lines 18-18 in FIG. 15.
Figure 19:
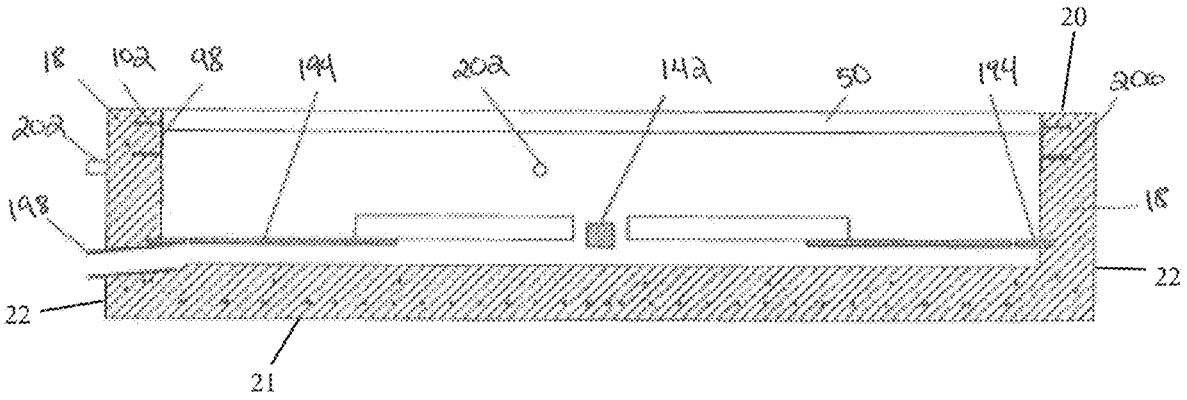
FIG. 19 is a cross-sectional view of the automated rumble strip assembly, taken along lines 19-19 in FIG. 15.
Figure 20:
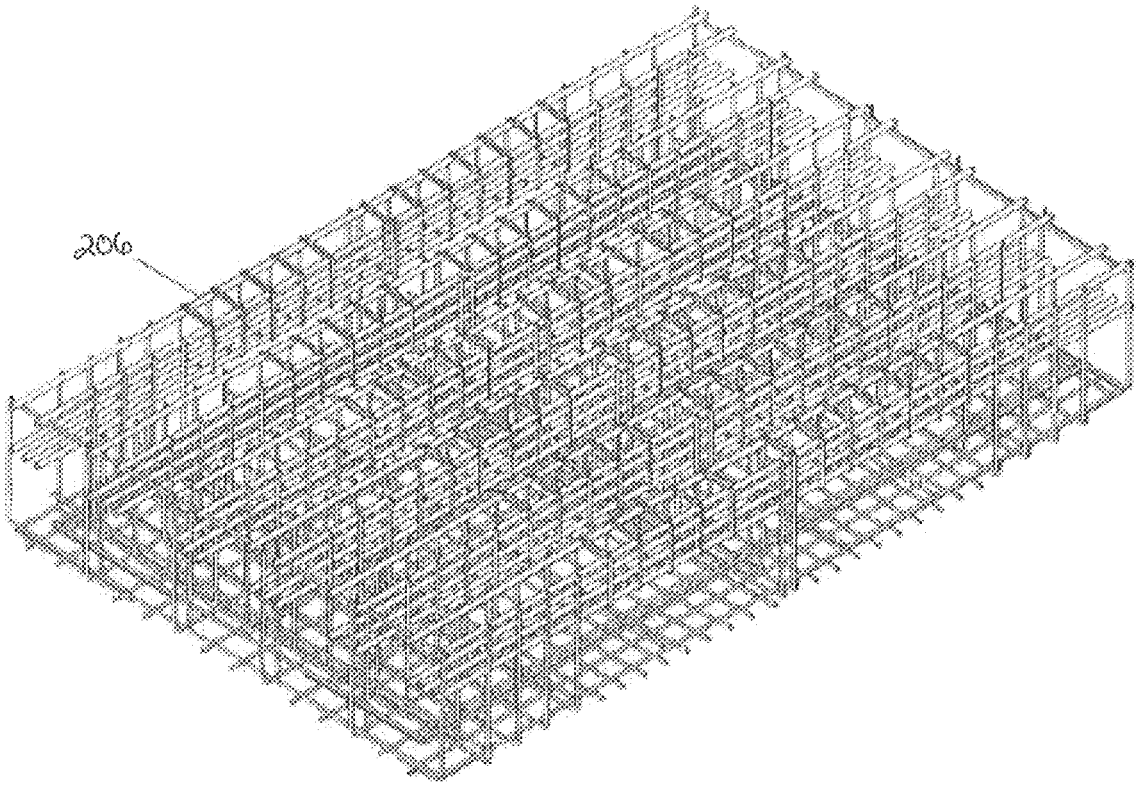
FIGS. 20-22 are perspective, front, and side views respectively of reinforcing elements of the automated rumble strip assembly.
Figure 21:
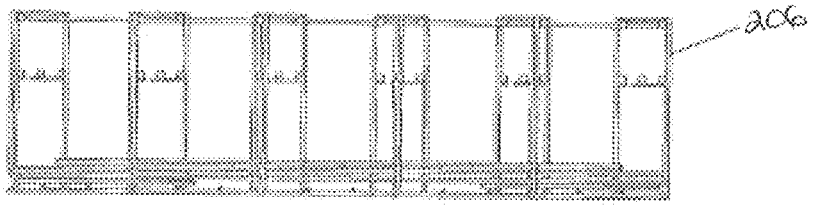
Figure 22:
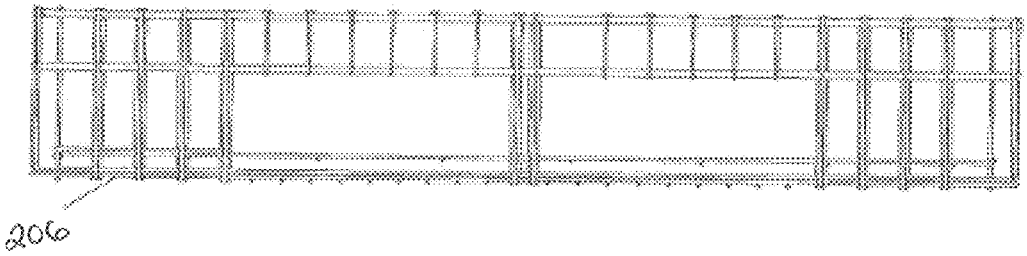

With reference to FIGS. 18 and 19, in the illustrated construction the automated rumble strip assembly 10 also includes a drain pipe 198 disposed below the lower plates 194. The drain pipe 198 permits water or other material to pass out of the frame 14.

Figure 17:
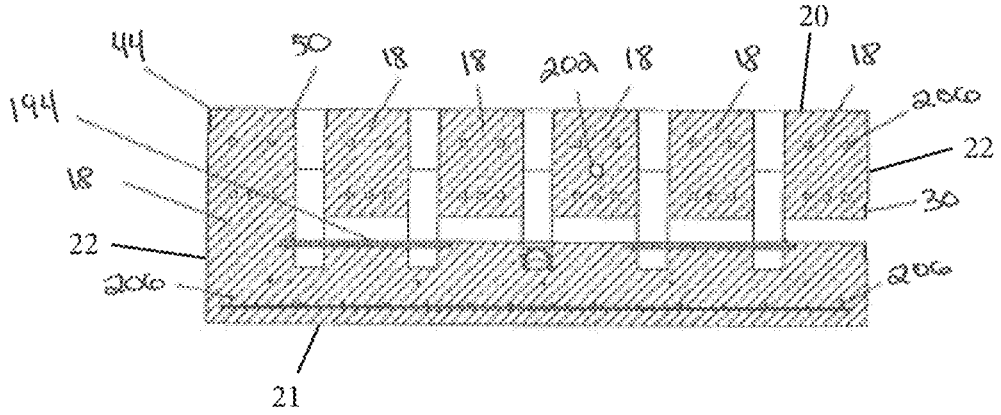
FIG. 17 is a cross-sectional view of the automated rumble strip assembly, taken along lines 17-17 in FIG. 15.

With reference to FIGS. 17-19, in the illustrated construction the automated rumble strip assembly 10 also includes at least one electrical conduit 202. In some constructions, the electrical conduit or conduits 202 provide space in the frame 14 for electricity and/or control signals to be delivered to the first and second motors 110, 126.

With reference to FIGS. 16-22, in the illustrated construction the automated rumble strip assembly 10 also includes a plurality of reinforcing elements 206. The reinforcing elements 206 provide added structural stability to the frame 14 and to the overall automated rumble strip assembly 10. In some constructions the reinforcing elements 206 are steel rebar elements, although other constructions include different materials or arrangements of reinforcing elements 206 than that illustrated.

With reference to FIG. 23, in the illustrated construction the controller 160 is coupled to each of the motors 110, 126 through one or more power cables 210 and control cables 214, and controls operation of the motors 110, 126. With reference to FIGS. 2 and 23, the automated rumble strip assembly 10 also includes at least one object detector to detect the presence of an object (e.g., vehicle) on the automated rumble strip assembly 10. In the illustrated construction the automated rumble strip assembly 10 includes a first object detector 218 (FIGS. 2 and 23) and a second object detector 222 (FIG. 23). The first object detector 218 includes an inductive loop wire 226 that is coupled to the controller 160 and wraps around the elongate members 62 (FIG. 2) inside of the frame 14. The second object detector 222 is a load cell that is coupled to the controller 160 with a cable 230. In other constructions a different number, arrangement, and/or type of object detector are provided. For example, in some constructions the object detector(s) is one of a piezoelectric wire, a camera detector, an infrared detector, a probe sensor, or an ultrasonic sensor.

With reference to FIG. 23, in the illustrated construction the controller 160 is configured to activate the motors 110, 126 and move the elongate members 62 from the first position to the second position only when the object detector detects that a vehicle is not positioned on the frame 14. This ensures that the automated rumble strip assembly 10 does not waste energy or movement, and is only used when a vehicle or vehicles are passing over the automated rumble strip assembly 10. In some constructions the controller 160 is configured to specifically detect pedestrians, trains, cars, or other specific objects (e.g., based on measurements or signals received from the object detector(s)), depending on how and where the automated rumble strip 10 is being used. For example, in some constructions the automated rumble strip assembly 10 is used at railroad crossings to raise driver awareness. In some constructions when the object detector senses an object, it sends a signal (e.g., through the cable 230) to the controller 160. The controller 160 then sends a signal through the control cable(s) 214 to the motors 110, 126 to retract the elongate members 62 (i.e., to move the elongate members 62 to the second position), causing rumbles to be formed in the roadway. In some constructions this action is controlled by a timer in the controller 160. For example, in some constructions the motors 110, 126 are activated based on timing, such as in school zones, where it is advantageous to have the elongate members 62 lowered (and rumbles thus formed in the roadway) during times of heavy pedestrian traffic or anticipated heavy pedestrian traffic in the school zones. Once the rumbles are no longer needed, based on time or object detection, the controller 160 checks the object detector to insure there are no vehicles on the automated rumble assembly 10. If no vehicles are detected, the controller 160 then sends a signal through the control cable(s) 214 to the motors 110, 126 to raise the elongate members 62 back to the first position, creating a generally smooth/flat roadway configuration.

FIGS. 24-40 illustrate another automated rumble strip assembly 1010. Similar to the automated rumble strip assembly 10, the automated rumble strip assembly 1010 may be used to raise a level of driver attention on roadways, and to facilitate a reduction in a number and/or severity of crashes. In some constructions, the automated rumble strip assembly 1010 is sized and shaped to be integrally formed as part of a newly constructed roadway. In other constructions, the rumble strip assembly 1010 is sized and shaped so as to be a retrofit for an existing roadway.

Figure 24:
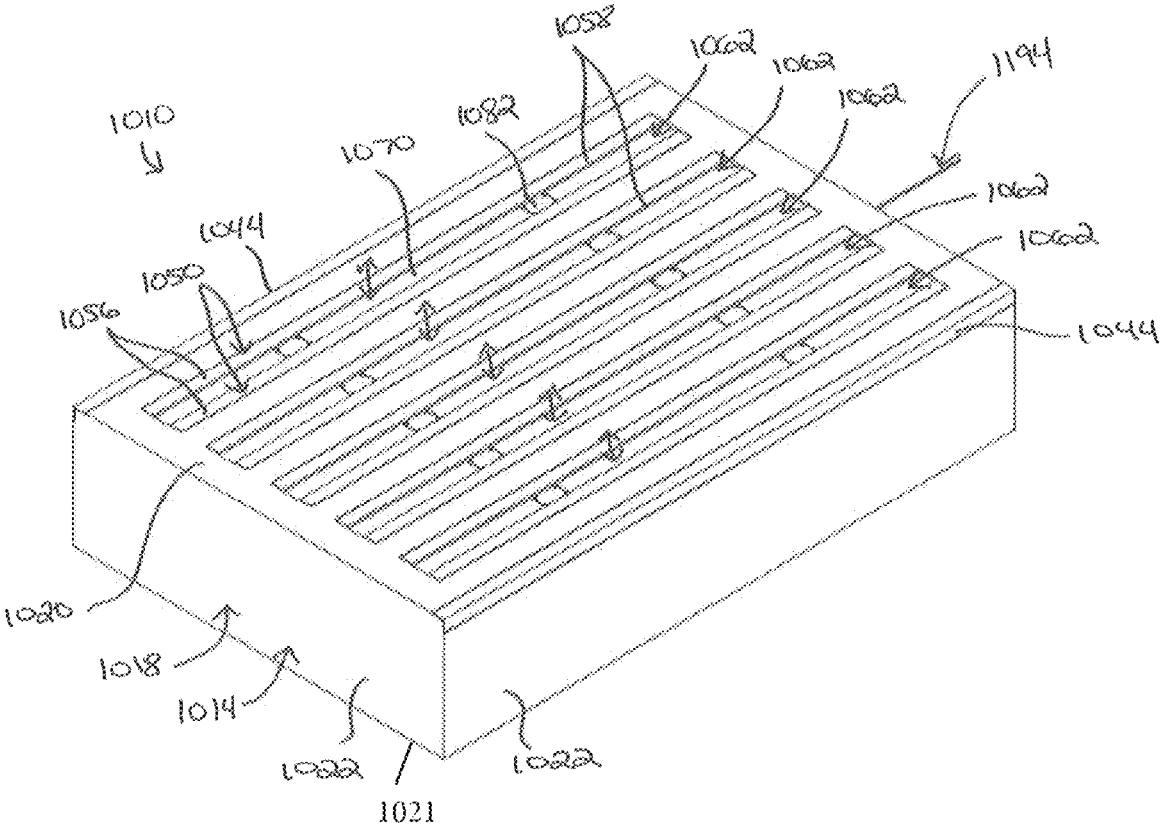
FIG. 24 is a perspective view of an automated rumble strip assembly according to another embodiment.
Figure 25:
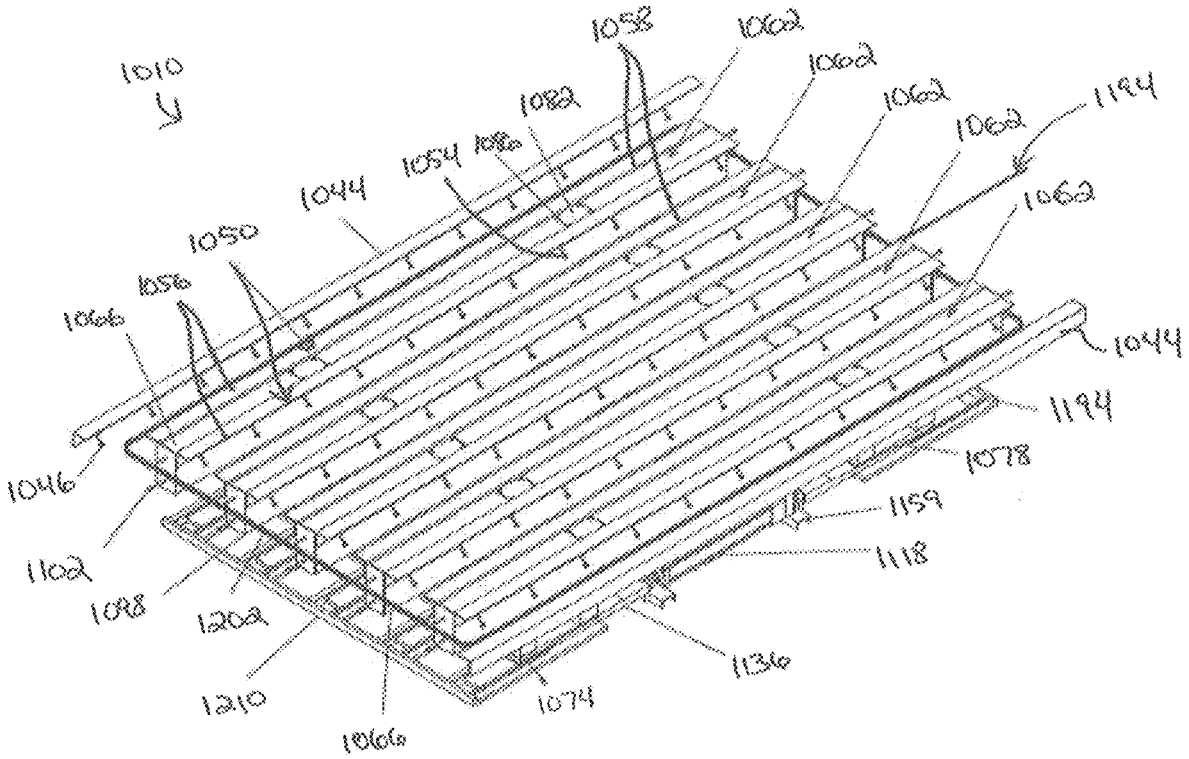
FIG. 25 is a perspective view of the automated rumble strip assembly of FIG. 24, with a frame removed.

With reference to FIGS. 24 and 25, the automated rumble strip assembly 1010 includes a frame 1014. The frame 1014 is a generally box-like structure. In other constructions the frame 1014 has other shapes and/or sizes than that illustrated. The frame 1014 includes a main housing 1018 having a top surface 1020 (e.g., a planar top surface), a bottom surface 1021, and at least one side surface 1022 that extends (e.g., perpendicularly and downwardly) from the top surface 1020. In the illustrated construction the main housing 1018 is made of concrete, although in other constructions the main housing 1018 is made of material other than concrete. In the illustrated construction the frame 1014 does not include access assemblies. However, in some constructions the frame 1014 includes one or more access assemblies such as the access assemblies 26 described above for frame 14.

With continued reference to FIGS. 24 and 25, the frame 1014 further includes edge plates 1044 that provide added structural stability to the automated rumble strip assembly 1010. Similar to the frame 14, the frame 1014 includes two edge plates 1044 that fit over opposite edges of the main housing 1018, and are coupled to the main housing 1018 with welded studs 1046. The edge plates 1044 each have a generally an L-shaped angled profile, with one portion of each of the L-shaped angled profiles contacting the top surface 1020 of the main housing 1018, and another portion contacting one of the side surfaces 1022. In some constructions, the frame 1014 includes a different number of edge plates 1044 than that illustrated, and/or includes edge plates 1044 having different shapes and/or sizes than that illustrated. In some constructions, the frame 1014 does not include any edge plates 1044.

With continued reference to FIGS. 24 and 25, the frame 1014 further includes guiding angle plates 1050 that provide added structural stability to the automated rumble strip assembly 1010. Similar to the frame 14, the frame 1014 includes five pairs of guiding angle plates 1050 that are each coupled to the top surface 1020 of the main housing 1018 with welded studs 1054 (FIG. 25), and extend parallel to one another along the top surface 1020. The guiding angle plates 1050 each include a top surface 1056 (e.g., a planar top surface). In some constructions, the frame 1014 includes a different number of guiding angle plates 1050 than that illustrated, and/or includes guiding angle plates 1050 having different shapes and/or sizes than that illustrated. In some constructions, the frame 1014 does not include any guiding angle plates 1050.

Figure 34:
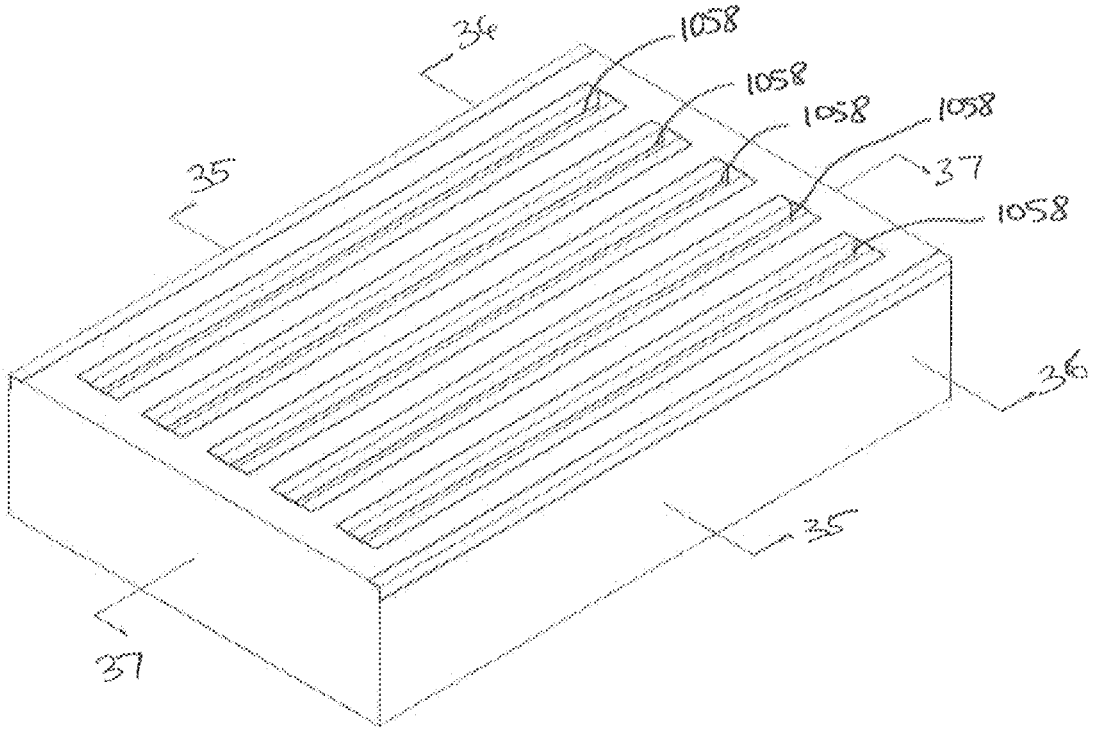
FIG. 34 is a perspective view of the automated rumble strip assembly of FIG. 23, with the elongate members removed.

With reference to FIGS. 24 and 34, the frame 1014 also includes a plurality of elongate apertures 1058 that are open and exposed along the top surface 1020 of the main housing 1018. Similar to the apertures 58 in the frame 14, each of the elongate apertures 1058 in the frame 1014 is positioned between a pair of the guiding angle plates 1050, and extends parallel to each of the other elongate apertures 1058.

With reference to FIGS. 24-28, the automated rumble strip assembly 1010 also includes a plurality of movable, elongate members 1062 that are disposed at least partially within the frame 1014. The automated rumble strip assembly 1010 includes five elongate members 1062 that are spaced equally apart from one another and are parallel to one another. However, in other constructions the number and/or arrangement of elongate members 1062 is different.

Figure 26:
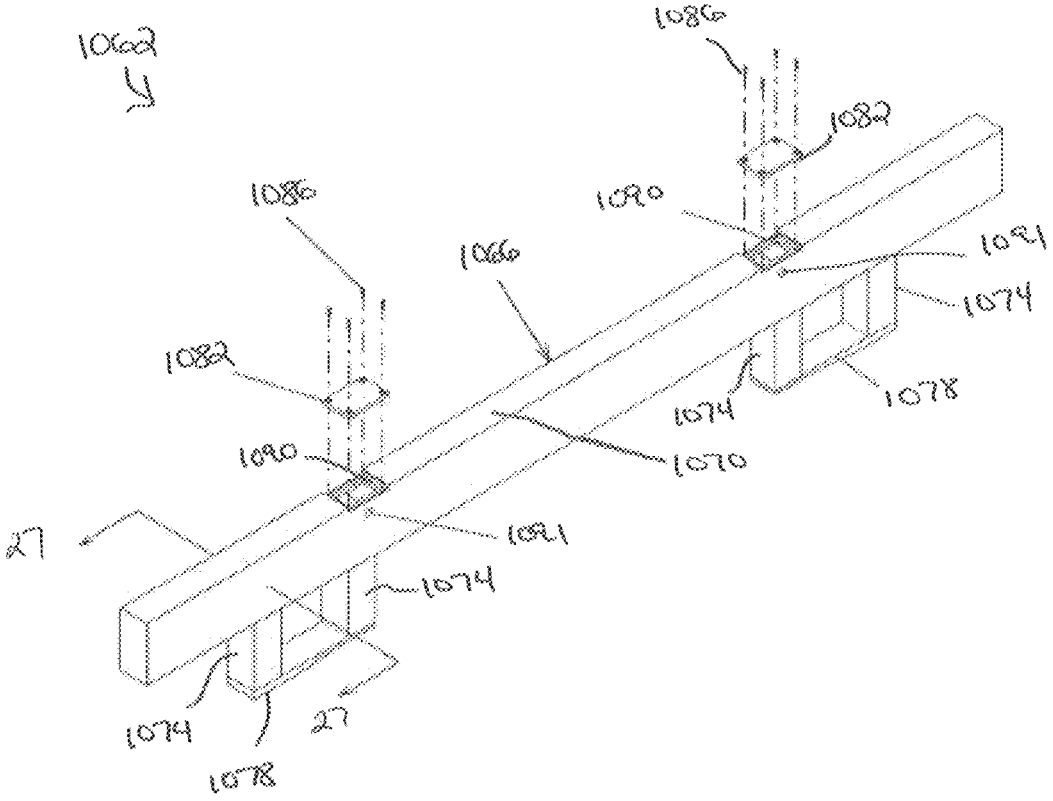
FIG. 26 is a perspective, exploded view of an elongate member of the automated rumble strip assembly of FIG. 24.

With reference to FIG. 26, similar to the elongate members 62, each of the elongate members 1062 includes an upper body 1066. Each of the upper bodies 1066 is generally rectangular in cross-section, and includes a top surface 1070. In the illustrated construction, each of upper bodies 1066 is sized and shaped to move within one of the elongate apertures 1058 (e.g., along the direction of the arrows in FIG. 24).

With continued reference to FIG. 26, each of the elongate members 1062 also includes at least one support member 1074 coupled to and extending beneath the upper body 1066. The support members 1074 support the upper body 1066. In the illustrated construction, each of the elongate members 1062 includes four support members 1074 extending perpendicularly below the upper body 1066. In other constructions, the elongate members 1062 include a different number and/or arrangement of support members 1074.

With continued reference to FIG. 26, each of the elongate members 1062 also includes at least one base portion 1078 that is coupled to and disposed below the support members 1074. In the illustrated construction, each of the elongate members 1062 includes two base portions 1078. Each of the base portions 1078 is coupled to two of the support members 1074. In other constructions, the elongate members 1062 include a different number and/or arrangement of base portions 1078.

With continued reference to FIG. 26, each of the elongate members 1062 also includes at least one elongate member access plate 1082 that is coupled to the upper body 1066 with bolts 1086. When the access plate 1082 is removed, an access plate frame 1090 and a lifting rod 1091 are exposed inside of the upper body 1066. In some constructions, the lifting rod 1091 may be used to lift and/or move the elongate member 1062. While the illustrated construction includes two access plates 1082, other constructions include different numbers of access plates 1082 than that illustrated. In some constructions, the elongate members 1062 do not include any access plates 1082, access plate frames 1090, and/or lifting rods 1091. In some constructions, the access plates 1082 are located along a different surface of the elongate member 1062 than that illustrated.

Figure 27:
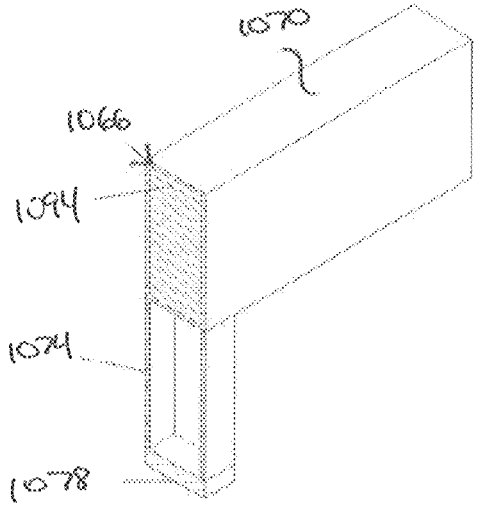
FIG. 27 is a cross-sectional view of the elongate member, taken through lines 27-27 in FIG. 26.

With reference to FIG. 27, each elongate member 1062 also includes a dampening material 1094 disposed within the upper body 1066. The dampening material 1094 at least partially fills an interior, hollow space in the upper body 1066, and acts to dampen sound and/or vibrations as a vehicle travels over the automated rumble strip assembly 1010. In some constructions, the dampening material 1094 is sand or liquid such as water or oil, although other constructions include different materials. In some constructions, the upper body 1066 does not include any dampening material.

Figure 28:
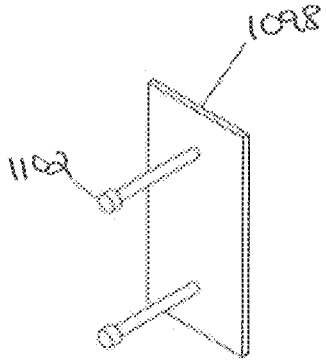
FIG. 28 is a perspective view of an end plate of the automated rumble strip assembly of FIG. 24.

With reference to FIGS. 24 and 28, the automated rumble strip assembly 1010 also includes end plates 1098 that are coupled to the main body 1018, to provide added structural stability to the automated rumble strip assembly 1010 and guidance for the elongate members 1062. In the illustrated construction, the end plates 1098 are coupled to the main body 1018 with welded studs 1102. In some constructions the automated rumble strip assembly 1010 does not include end plates 1098.

With reference to FIGS. 29-32, the rumble strip assembly 1010 also includes an actuator assembly 1106. In the illustrated construction the actuator assembly 1106 is disposed entirely within the main housing 1018 of the frame 1014. However, in other construction at least a portion of the actuator assembly 1106 is disposed outside of the main housing 1018. The actuator assembly 1106 moves the elongate members 1062 from a first position where each of the top surfaces 1070 (FIGS. 26 and 27) of the elongate members 1062 is at a first distance relative to a top surface of the frame 1014, to a second position where each of the top surfaces 1070 of the elongate members 1062 is at a second, different distance relative to the top surface of the frame 1014. In the illustrated construction, the top surface of the frame 1014 corresponds to the top surfaces 1056 of the guiding angle plates 1050. In other constructions, the top surface of the frame 1014 corresponds to the top surface 1020 of the main housing 1018. In the illustrated construction, each of the top surfaces 1070 is flush relative to the top surface of the frame 1014 in the first position, and is recessed relative to the top surface of the frame 1014 in the second position.

Figure 29:
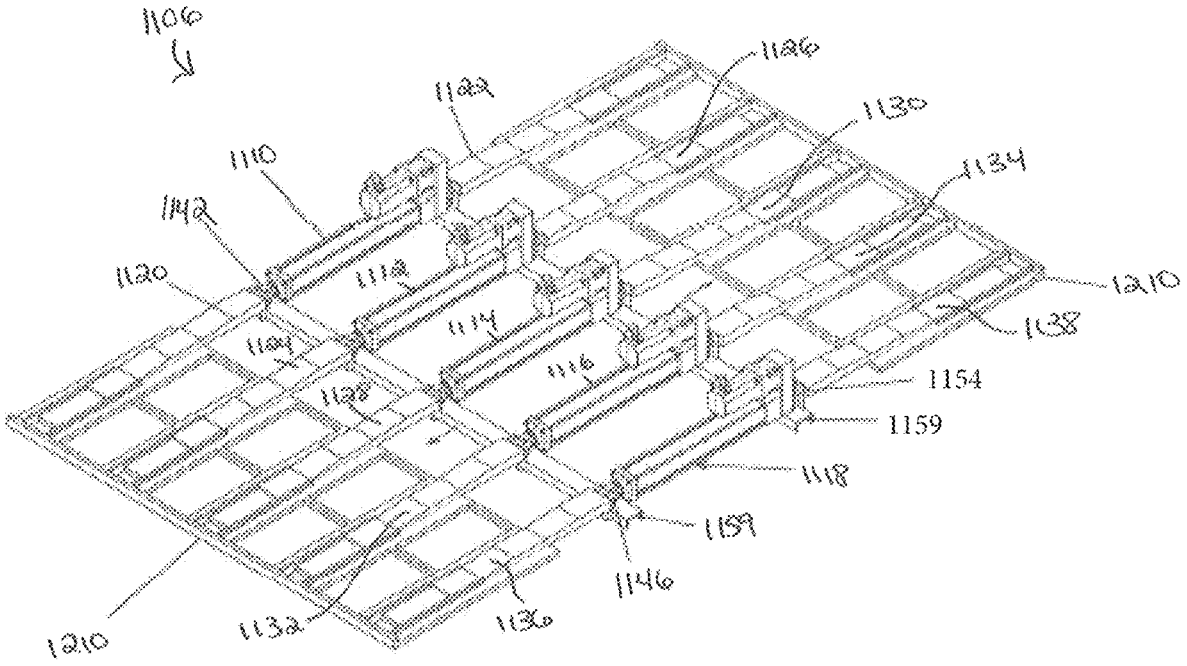
FIG. 29 is a perspective view of an actuator assembly of the automated rumble strip assembly of FIG. 24.

With continued reference to FIGS. 29-32, the actuator assembly 1106 includes a first motor 1110, a second motor 1112, a third motor 1114, a fourth motor 1116, and a fifth motor 1118. In the illustrated construction, each of the motors 1110, 1112, 1114, 1116, and 1118 is a high-force electric cylinder, although other constructions include different types of motors. For example, in some constructions the motors 1110, 1112, 1114, 1116, and 1118 are hydraulic cylinders or pneumatic cylinders. As illustrated in FIG. 29, the motors 1110, 1112, 1114, 1116, and 1118 are parallel to one another and spaced equally apart from one another. A first wedge plate 1120 and a second wedge plate 1122 are coupled to and driven linearly by the first motor 1110, in opposite directions from one another. A third wedge plate 1124 and a fourth wedge plate 1126 are coupled to and driven linearly by the second motor 1112, in opposite directions from one another. A fifth wedge plate 1128 and a sixth wedge plate 1130 are coupled to and driven linearly by the third motor 1114, in opposite direction from one another. A seventh wedge plate 1132 and an eighth wedge plate 1134 are coupled to and driven linearly by the fourth motor 1116, in opposite directions from one another. A ninth wedge plate 1136 and a tenth wedge plate 1138 are coupled to and driven linearly by the fifth motor 1118, in opposite direction from one another.

Figure 30:
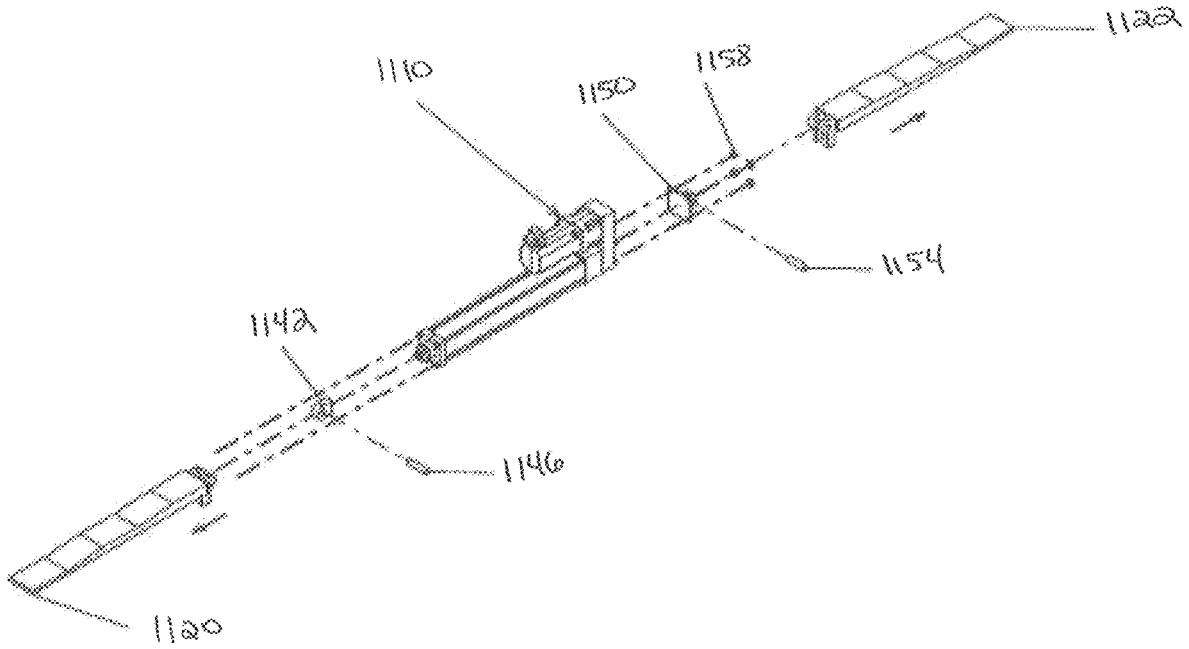
FIG. 30 is a perspective, exploded view of the actuator assembly of FIG. 29.

With reference to FIG. 30, in the illustrated construction each of the motors 1110, 1112, 1114, 1116, 1118 is coupled to its respective wedge plates 1120, 1122, 1124, 1126, 1128, 1130, 1132, 1134, 1136, 1138 with a rod clevis 1142, a first connection pin 1146, a clevis bracket 1150, a second connection pin 1154, and ram nuts 1158. In the illustrated construction the actuator assembly 1106 also includes wedge stops 1159 (e.g., coupled to the frame 1014) that limit movement of the wedge plates 1120, 1122, 1124, 1126, 1128, 1130, 1132, 1134, 1136, 1138.

Figure 32:
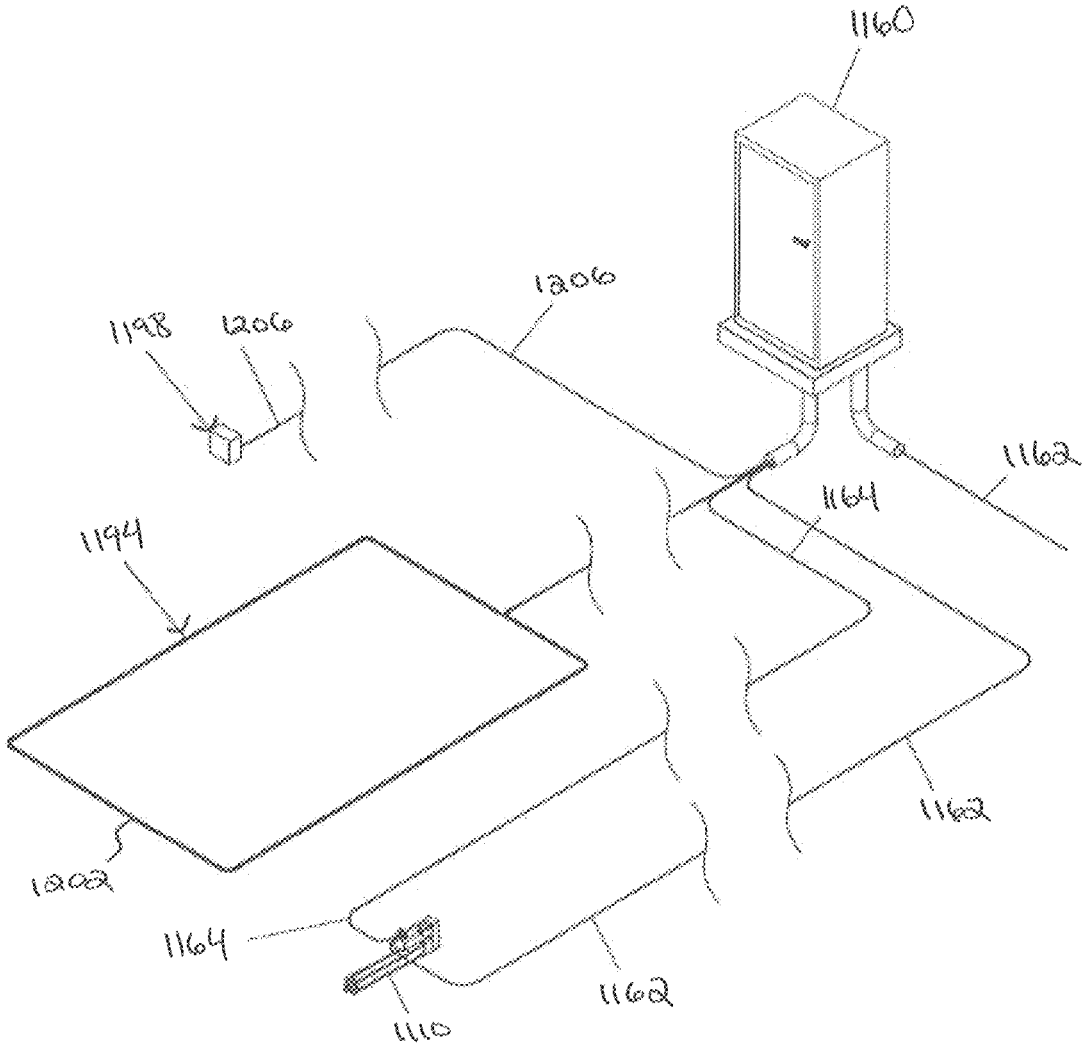
FIG. 32 is a schematic illustration of a wiring system for the automated rumble strip assembly of FIG. 24.
Figure 33:
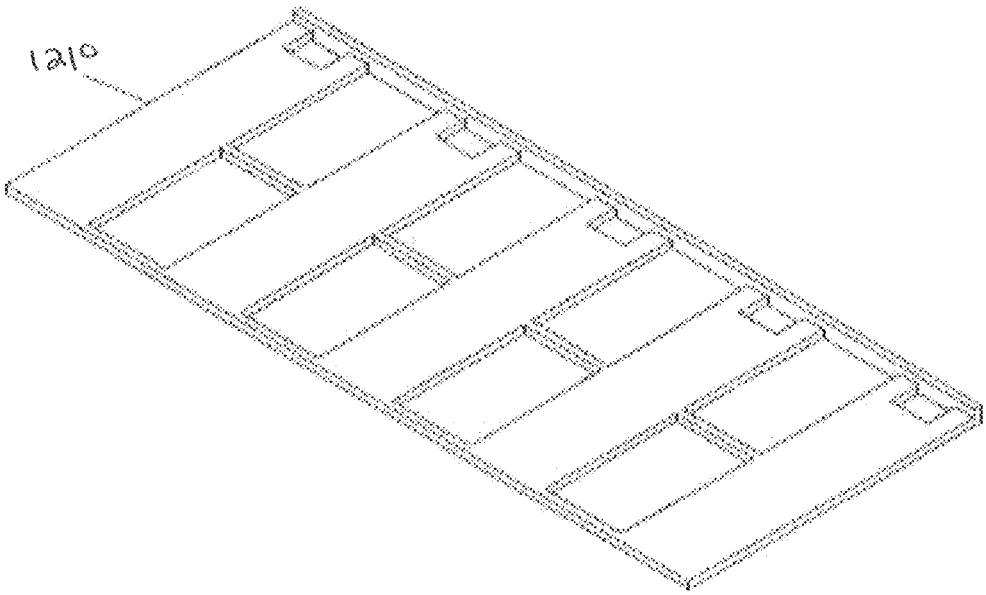
FIG. 33 is a perspective view of a lower plate of the automated rumble strip assembly of FIG. 24.

With reference to FIG. 32, the automated rumble strip assembly 1010 further includes a controller 1160 coupled to the actuator assembly 1106. In the illustrated construction the controller 1160 is coupled to each of the first motor 1110, the second motor 1112, the third motor 1114, the fourth motor 1116, and the fifth motor 1118 (although only the first motor 1110 is shown) through one or more power cables 1162 and control cables 1164, and controls operation of the motors 1110, 1112, 1114, 1116, 1118. In some constructions the controller 1160 communicates wirelessly with the motors 1110, 1112, 1114, 1116, 1118. In some constructions the controller 1160 is disposed remotely from the actuator assembly 1106 and from the frame 1114.

When the motors 1110, 1112, 1114, 1116, 1118 are actuated via the controller 1160 in a first manner, the first wedge plate 1120, the third wedge plate 1124, the fifth wedge plate 1128, the seventh wedge plate 1132, and the ninth wedge plate 1136 move linearly toward the motors 1110, 1112, 1114, 1116, 1118 along a first direction, and the second wedge plate 1122, the fourth wedge plate 1126, the sixth wedge plate 1130, the eighth wedge plate 1134, and the tenth wedge plate 1138 move linearly toward the motors 1110, 1112, 1114, 1116, 1118 along a second, opposite direction, thereby moving the plurality of elongate members 1062 from the first position to the second position (e.g., similar to what is shown in FIGS. 10A, 10B, 11A, and 11B). When the motors 1110, 1112, 1114, 1116, 1118 are actuated via the controller 1160 in a second manner, the first wedge plate 1120, the third wedge plate 1124, the fifth wedge plate 1128, the seventh wedge plate 1132, and the ninth wedge plate 1136 move linearly away the motors 1110, 1112, 1114, 1116, 1118 along a first direction, and the second wedge plate

1122, the fourth wedge plate 1126, the sixth wedge plate 1130, the eighth wedge plate 1134, and the tenth wedge plate 1138 move linearly away from the motors 1110, 1112, 1114, 1116, 1118 along a second, opposite direction, thereby moving the plurality of elongate members 1062 from the second position back to the first position (e.g., similar to what is shown in FIGS. 11A, 11B, 12A, and 12B).

Figure 31:
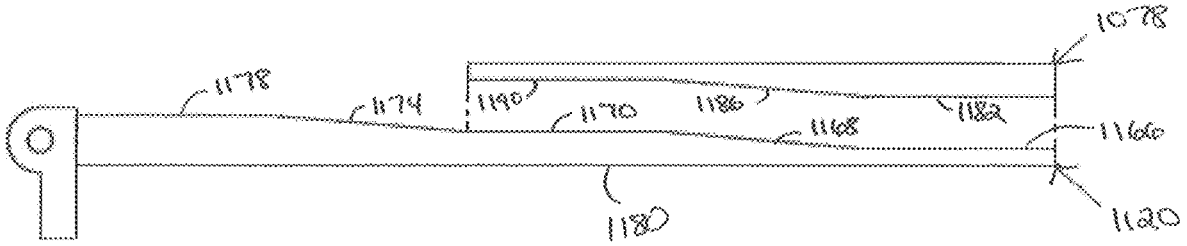
FIG. 31 is a side view of a portion of both the actuator assembly of FIG. 29 and the elongate member of FIG. 26.

With reference to FIG. 31, each of the wedge plates 1120, 1122, 1124, 1126, 1128, 1130, 1132, 1134, 1136, 1138 defines an arm that includes a first surface 1166, a second surface 1168, a third surface 1170, a fourth surface 1174, and a fifth surface 1178. The first surface 1166, the third surface 1170, and the fifth surface 1178 are parallel to one another and are parallel to the top surface of the frame 1014. The second surface 1168 extends between the first surface 1166 and the third surface 1170, and is transverse to both the first surface 1166 and the third surface 1170. The fourth surface 1174 extends between the third surface 1170 and the fifth surface 1178 and is transverse to both the third surface 1170 and the fifth surface 1178. Each of the wedge plates 1120, 1122, 1124, 1126, 1128, 1130, 1132, 1134, 1136, 1138 also includes a lower surface 1180.

With continued reference to FIG. 31, each of the base portions 1078 of the elongate members 1062 includes a first engagement surface 1182, a second engagement surface 1186, and a third engagement surface 1190. The first engagement surface 1182 and the third engagement surface 1190 are parallel to one another and are parallel to the top surface of the frame 1014. The second engagement surface 1186 extends between the first engagement surface 1182 and the third engagement surface 1190 and is transverse to both the first engagement surface 1182 and the third engagement surface 1190.

With continued reference to FIG. 31, when one of the elongate members 1062 is in the first position, the first engagement surface 1182 of one of the base portions 1078 is engaged with the third surface 1170, the second engagement surface 1186 of the base portion 1078 is engaged with the fourth surface 1174, and third engagement surface 1190 of the base portion 1078 is engaged with the fifth surface 1178.

With continued reference to FIG. 31, when the elongate member 1062 is in the second position, the first engagement surface 1182 of the base portion 1078 is engaged with the first surface 1166, the second engagement surface 1186 of the base portion 1078 is engaged with the second surface 1168, and the third engagement surface 1190 of the base portion 1078 is engaged with the third surface 1170.

With continued reference to FIG. 31, when the elongate member 1062 moves from the first position to the second position, the first engagement surface 1182 of the base portion 1078 initially slides along the third surface 1170, and the third engagement surface 190 of the base portion 1078 slides along the fifth surface 1178. The second engagement surface 1186 of the base portion 1078 slides along the second surface 1168 until the first engagement surface 1182 of the base portion 1078 is engaged with the first surface 1166 and the second engagement surface 1186 of the base portion 1078 is engaged with the second surface 1168 and the third engagement surface 1190 of the base portion 1078 is engaged with the third surface 1170.

While only a single base portion 1078 and a single wedge plate 1120 are illustrated in FIG. 9, the same arrangement and sliding movement described above simultaneously occurs at each of the other base portions 1078 and wedge plates 1122, 1124, 1126, 1128, 1130, 1132, 1134, 1136, 1138 during operation. That is, when the motors 1110, 1112, 1114, 1116, and 1118 are actuated, the elongate members 1062 move in unison, and the base portions 1078 of the elongate members 1062 slide together relative to the wedge plates 1122, 1124, 1126, 1128, 1130, 1132, 1134, 1136, 1138. This arrangement results in a smooth, consistent movement of the elongate members 1062 between the first position and the second position, and also from the second position back to the first position.

With reference to FIGS. 24, 25, and 32, the automated rumble strip assembly 1010 also includes at least one object detector to detect the presence of an object (e.g., vehicle) on the automated rumble strip assembly 1010. In the illustrated construction the automated rumble strip assembly 1010 includes a first object detector 1194 and a second object detector 1198. The first object detector 1194 includes an inductive loop wire 1202 that is coupled to the controller 1160 and wraps around the elongate members 1062 (FIG. 25) inside of the frame 1114. The second object detector 1198 (FIG. 32) is a load cell that is coupled to the controller 1160 with a cable 1206. In other constructions a different number, arrangement, and/or type of object detector are provided. For example, in some constructions the object detector(s) is one of a piezoelectric wire, a camera detector, an infrared detector, a probe sensor, or an ultrasonic sensor.

With continued reference to FIG. 32, in the illustrated construction the controller 1160 is configured to activate the motors 1110, 1112, 1114, 1116, 1118 and move the elongate members 1062 from the first position to the second position only when the object detector detects that a vehicle is not positioned on the frame 1014. This ensures that the automated rumble strip assembly 1010 does not waste energy or movement, and is only used when a vehicle or vehicles are passing over the automated rumble strip assembly 1010. In some constructions the controller 1160 is configured to specifically detect pedestrians, trains, cars, or other specific objects (e.g., based on measurements or signals received from the object detector(s)), depending on how and where the automated rumble strip assembly 1010 is being used. For example, in some constructions the automated rumble strip assembly 1010 is used at railroad crossings to raise driver awareness. In some constructions when the object detector senses an object, it sends a signal (e.g., through the cable 1206) to the controller 1160. The controller 1160 then sends a signal through the control cable(s) 1164 to the motors 1110, 1112, 1114, 1116, 1118 to retract the elongate members 1062 (i.e., to move the elongate members 1062 to the second position), causing rumbles to be formed in the roadway. In some constructions this action is controlled by a timer in the controller 1160. For example, in some constructions the motors 1110, 1112, 1114, 1116, 1118 are activated based on timing, such as in school zones, where it is advantageous to have the elongate members 1062 lowered (and rumbles thus formed in the roadway) during times of heavy pedestrian traffic or anticipated heavy pedestrian traffic in the school zones. Once the rumbles are no longer needed, based on time or object detection, the controller 1160 checks the object detector to insure there are no vehicles on the automated rumble assembly 1010. If no vehicles are detected, the controller 1160 then sends a signal through the control cable(s) 1164 to the motors 1110, 1112, 1114, 1116, 1118 to raise the elongate members 1062 back to the first position, creating a generally smooth/flat roadway configuration.

With reference to FIGS. 25, 29, 33, and 37, the automated rumble strip assembly 1010 also includes lower plates 1210. The lower plates 1210 are disposed within the main housing 1018 of the frame 1014, and are positioned below the wedge plates 1120, 1122, 1124, 1126, 1128, 1130, 1132, 1134, 1136, 1138. In some constructions the lower plates 1210 are coupled to the main housing 1018 with welded studs. The lower plates 1210 provide added stability and guidance for the wedge plates 1120, 1122, 1124, 1126, 1128, 1130, 1132, 1134, 1136, 1138 and for the actuator assembly 1106. For example, in some constructions the lower surfaces 1180 of the wedge plates 1120, 1122, 1124, 1126, 1128, 1130, 1132, 1134, 1136, 1138 slide along the lower plates 1210. In some constructions the lower plates 1210 are not provided.

Figure 36:
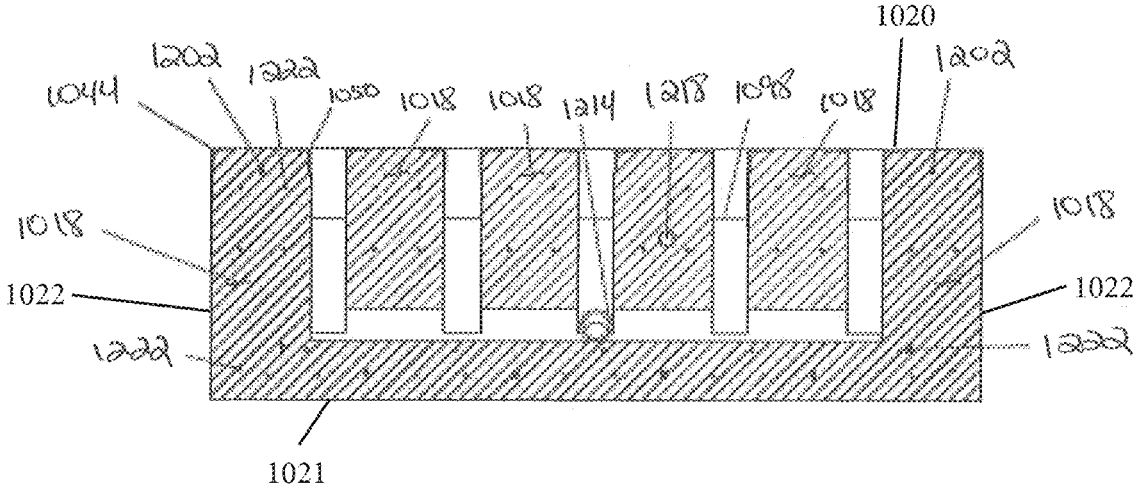
FIG. 36 is a cross-sectional view of the automated rumble strip assembly of FIG. 24, taken along lines 36-36 in FIG. 34.
Figure 37:
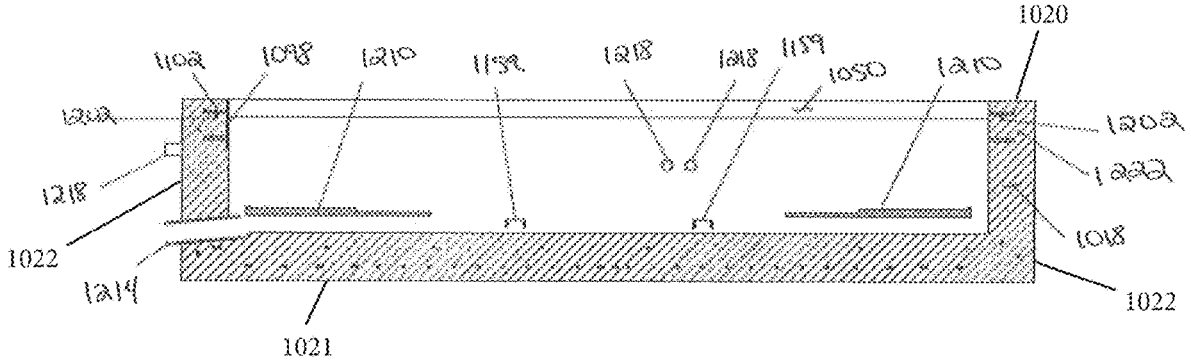
FIG. 37 is a cross-sectional view of the automated rumble strip assembly of FIG. 24, taken along lines 37-37 in FIG. 34.

With reference to FIGS. 36 and 37, in the illustrated construction the automated rumble strip assembly 1010 also includes a drain pipe 1214 disposed below the lower plates 1210. The drain pipe 1214 permits water or other material to pass out of the frame 1014

Figure 35:
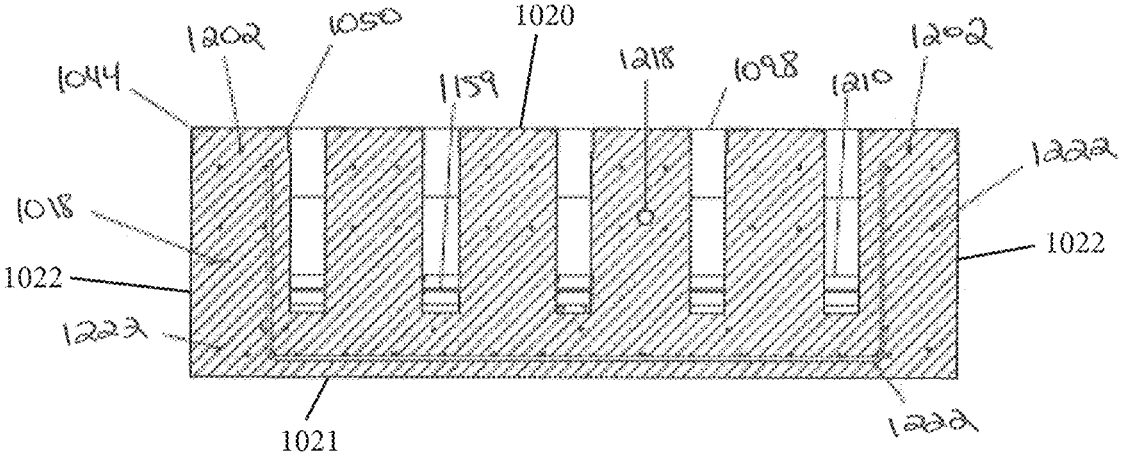
FIG. 35 is a cross-sectional view of the automated rumble strip assembly of FIG. 24, taken along lines 35-35 in FIG. 34.

With reference to FIGS. 35-37, in the illustrated construction the automated rumble strip assembly 1010 also includes at least one electrical conduit 1218. The electrical conduit or conduits 1218 provide space in the frame 1014 for electricity and/or control signals to be delivered to the motors 1110, 1112, 1114, 1116, 1118 and/or object detectors.

Figure 38:
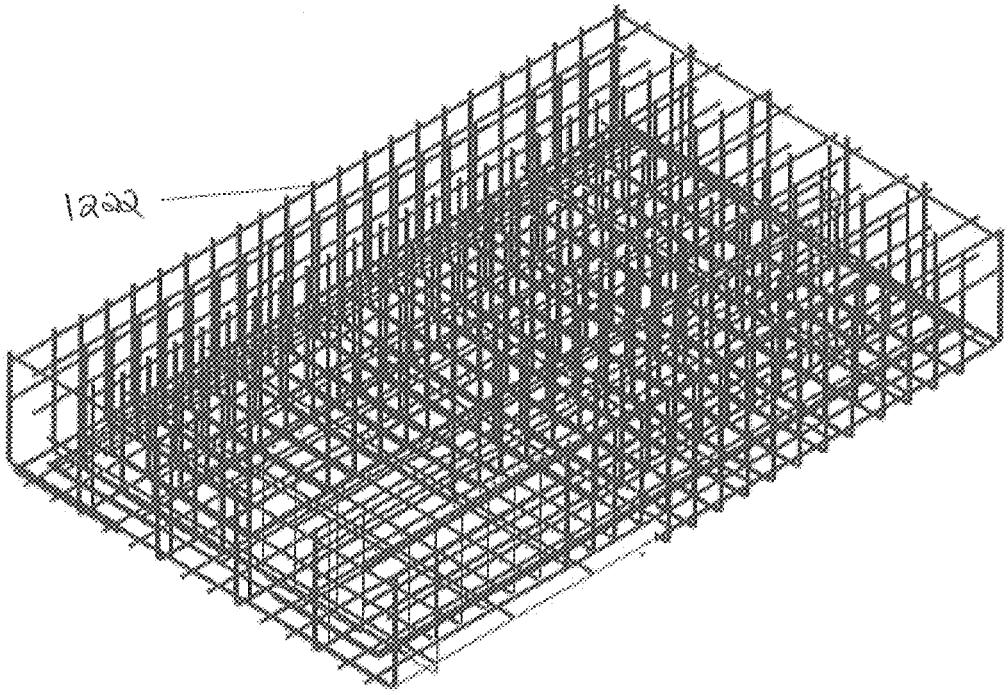
FIGS. 38-40 are perspective, front, and side views respectively of reinforcing elements of the automated rumble strip assembly of FIG. 24.
Figure 39:
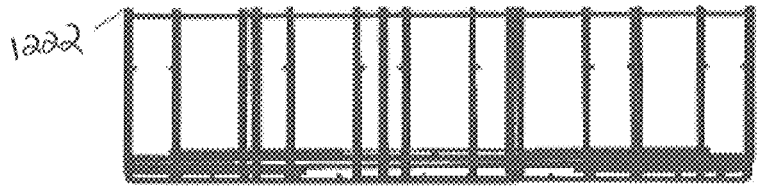
Figure 40:
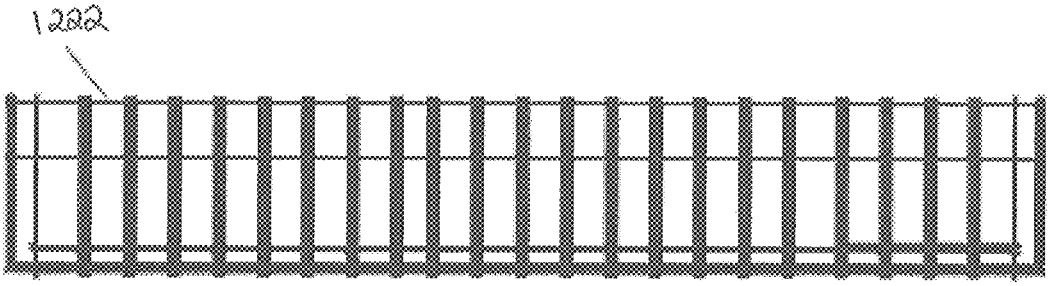

With reference to FIGS. 38-40, in the illustrated construction the automated rumble strip assembly 1010 also includes a plurality of reinforcing elements 1222. The reinforcing elements 1222 provide added structural stability to the frame 1014 and to the overall automated rumble strip assembly 1010. In some constructions the reinforcing elements 1222 are steel rebar elements, although other constructions include different materials or arrangements of reinforcing elements 1222 than that illustrated.

Figure 41:
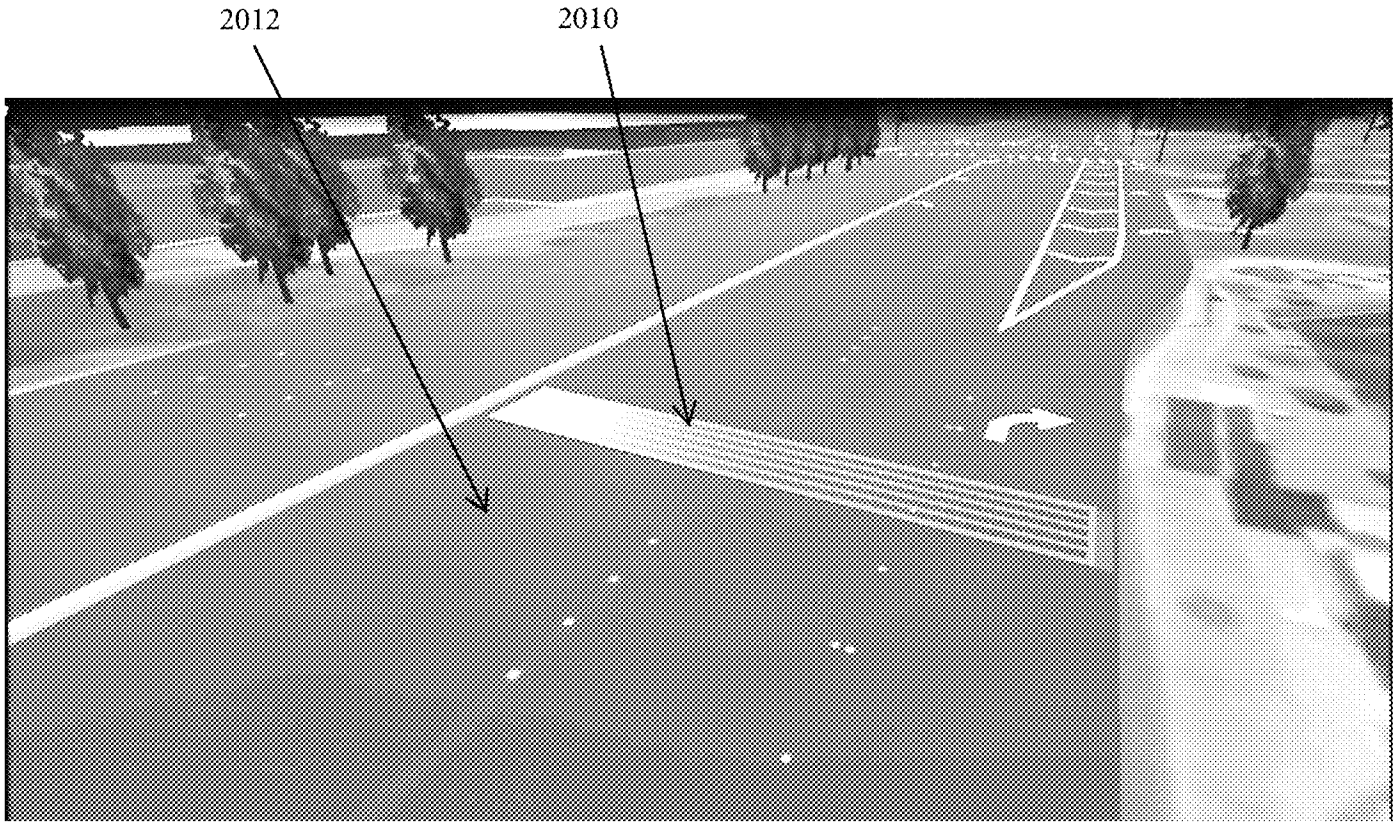
FIG. 41 is a perspective view of a roadway and a rumble strip assembly according to another embodiment.

FIGS. 41-65 illustrate another automated rumble strip assembly 2010. Similar to the automated rumble strip assemblies 10 and 1010, the automated rumble strip assembly 2010 may be used to raise a level of driver attention on roadways, and to facilitate a reduction in a number and/or severity of crashes. In some constructions, and as illustrated in FIG. 41, the automated rumble strip assembly 2010 is sized and shaped to be integrally formed as part of a newly constructed roadway 2012. In other constructions, the rumble strip assembly 2010 is sized and shaped so as to be a retrofit for an existing roadway.

Figure 42:
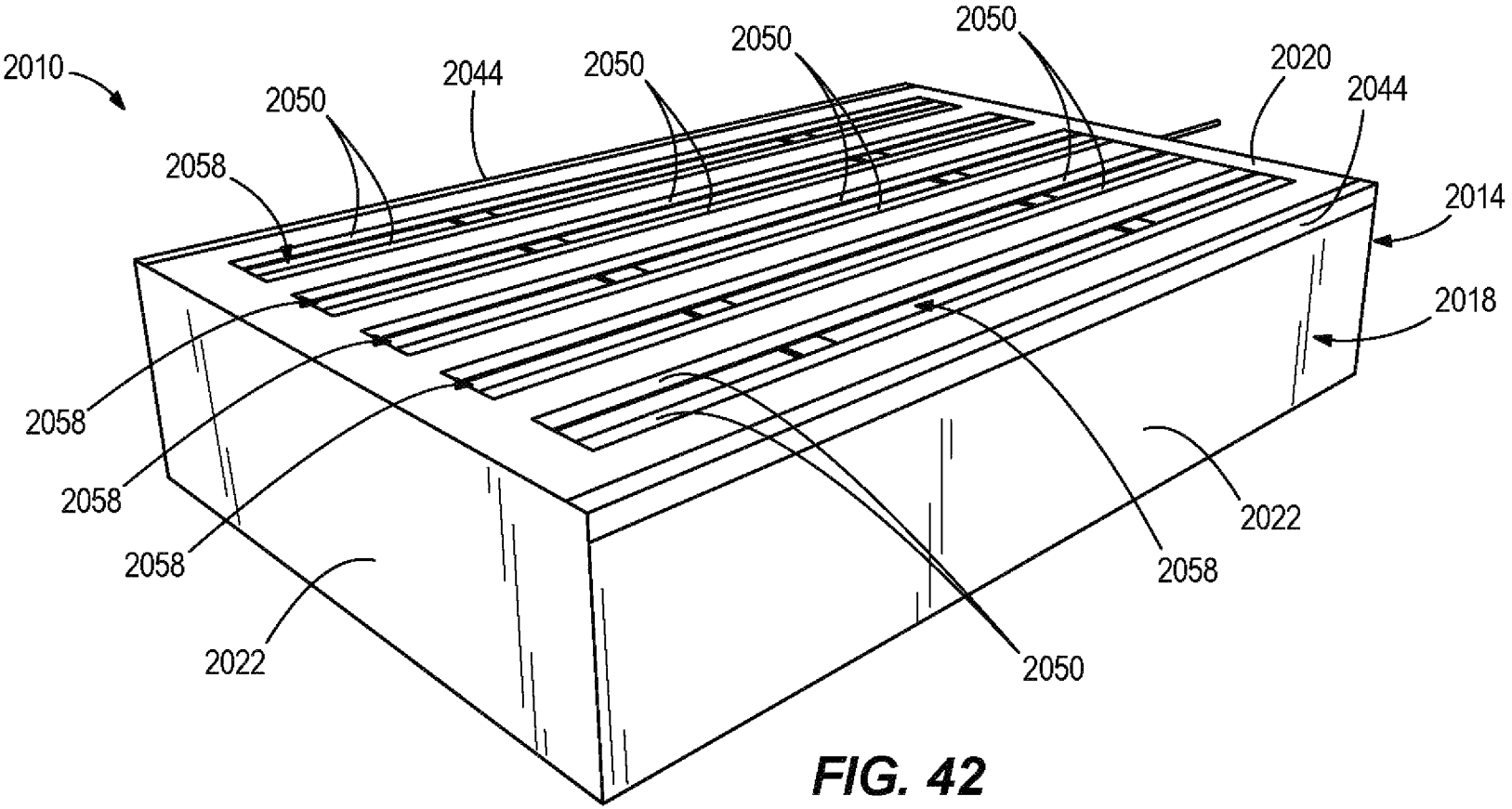
FIG. 42 is a perspective view of a frame of the rumble strip assembly of FIG. 41.

With reference to FIG. 42, the automated rumble strip assembly 2010 includes a frame 2014. The frame 2014 is a generally box-like structure that sits within the roadway 2012. In other constructions the frame 2014 has other shapes and/or sizes than that illustrated. The frame 2014 includes a main housing 2018 having a top surface 2020 (e.g., a planar top surface that sits flush with the roadway 2012), a bottom surface (not visible), and at least one side surface 2022 that extends (e.g., perpendicularly and downwardly) from the top surface 2020 to the bottom surface. In the illustrated construction the main housing 2018 is made of concrete, although in other constructions the main housing 2018 is made of material other than concrete.

With continued reference to FIG. 42, the frame 2014 includes edge plates 2044 that provide added structural stability to the automated rumble strip assembly 2010. Similar to the frames 14 and 1014, the frame 2014 includes two edge plates 2044 that fit over opposite edges of the main housing 2018, and are coupled to the main housing 2018 (e.g., with welded studs). The edge plates 2044 each have a generally L-shaped angled profile, with one portion of each of the L-shaped angled profiles contacting the top surface 2020 of the main housing 2018, and another portion contacting one of the side surfaces 2022. In some constructions, the frame 2014 includes a different number of edge plates 2044 than that illustrated, and/or includes edge plates 2044 having different shapes and/or sizes than that illustrated. In some constructions, the frame 2014 does not include any edge plates 2044.

Figure 43:
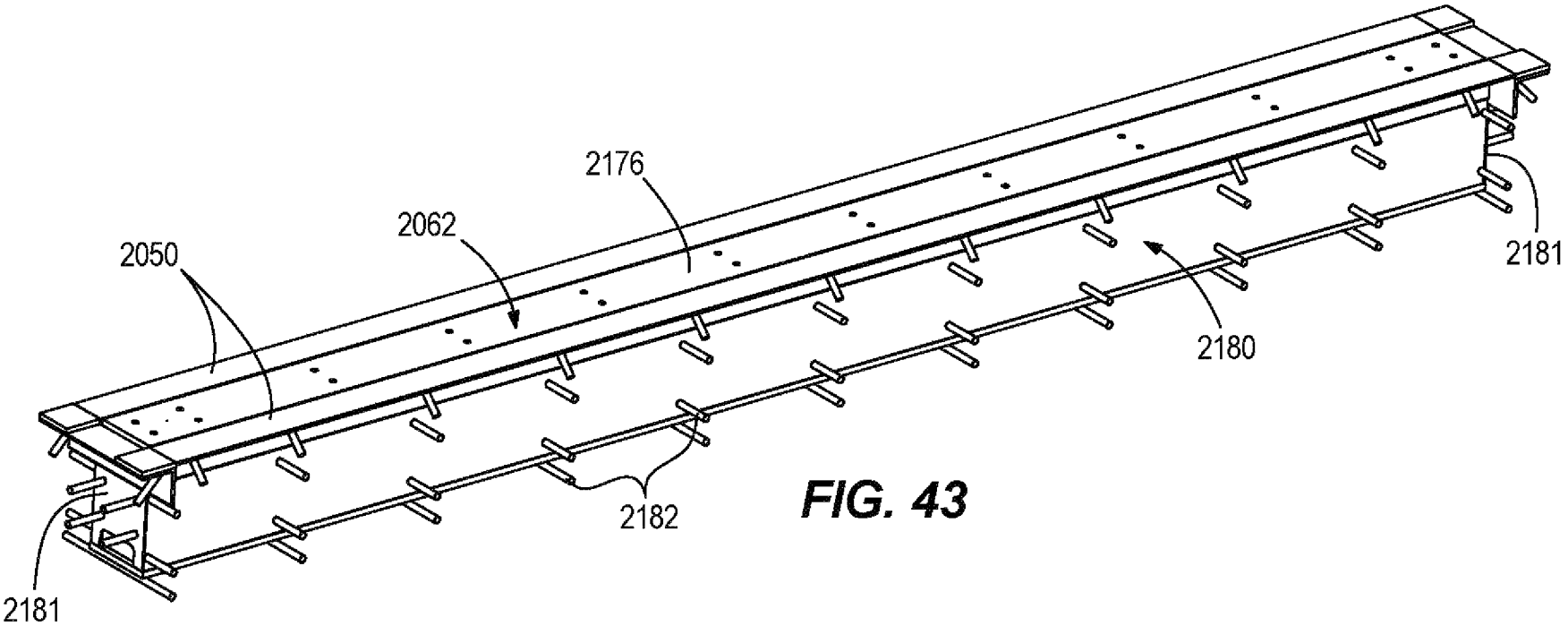
FIGS. 43 and 44 are perspective view of an elongate member of the rumble strip assembly of FIG. 41.
Figure 44:
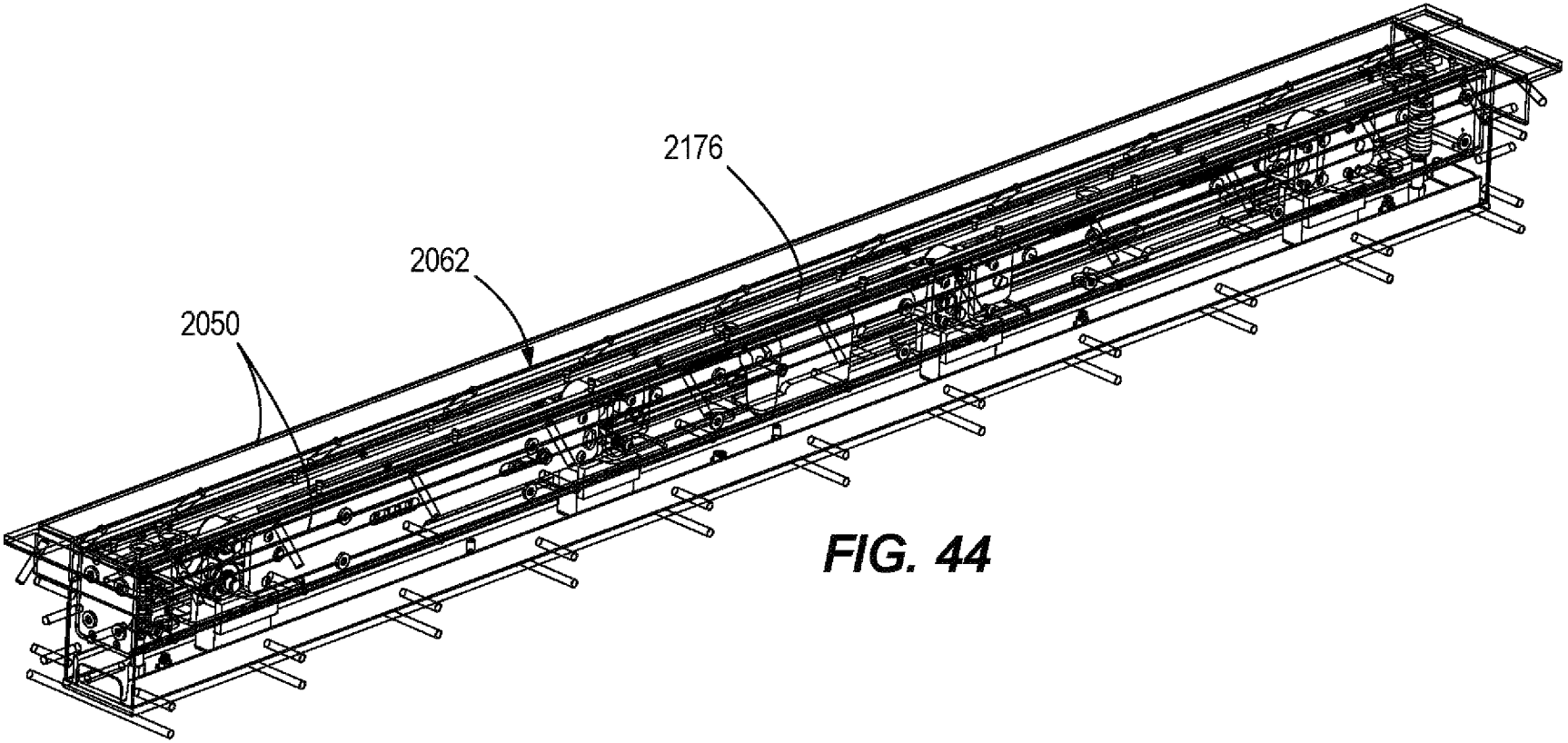

With reference to FIG. 42-44, the frame 2014 further includes guiding angle plates 2050 that provide added structural stability to the automated rumble strip assembly 2010. Similar to the frames 14 and 1014, the frame 2014 includes five pairs of guiding angle plates 2050 that are each coupled to the top surface 2020 of the main housing 2018 (e.g., with welded studs), and extend parallel to one another along the top surface 2020. The guiding angle plates 2050 each include a top surface (e.g., a planar top surface) that extends parallel to the top surface 2020 of the main housing 2018. In some constructions, the frame 2014 includes a different number of guiding angle plates 2050 than that illustrated, and/or includes guiding angle plates 2050 having different shapes and/or sizes than that illustrated. In some constructions, the frame 2014 does not include any guiding angle plates 2050.

With reference to FIG. 42, the frame 2014 also includes a plurality of elongate apertures 2058 that are open and exposed along the top surface 2020 of the main housing 2018. Similar to the apertures 58 in the frame 14 and the apertures 1058 in the frame 1014, each of the elongate apertures 2058 in the frame 2014 is positioned between a pair of the guiding angle plates 2050, and extends parallel to each of the other elongate apertures 2058. In some constructions, rather than having two guiding angle plates 2050 disposed on opposite sides of the aperture 2058, a single guiding angle plate 2050 (or multiple separate guiding angle plates 2050) extend entirely around the aperture 2058.

With reference to FIGS. 43 and 44, the automated rumble strip assembly 2010 also includes a plurality of movable, elongate members 2062 that are disposed at least partially within the frame 2014. The automated rumble strip assembly 2010 includes five elongate members 2062 that are spaced equally apart from one another and are parallel to one another. However, in other constructions the number and/or arrangement of elongate members 2062 is different.

Figure 45:
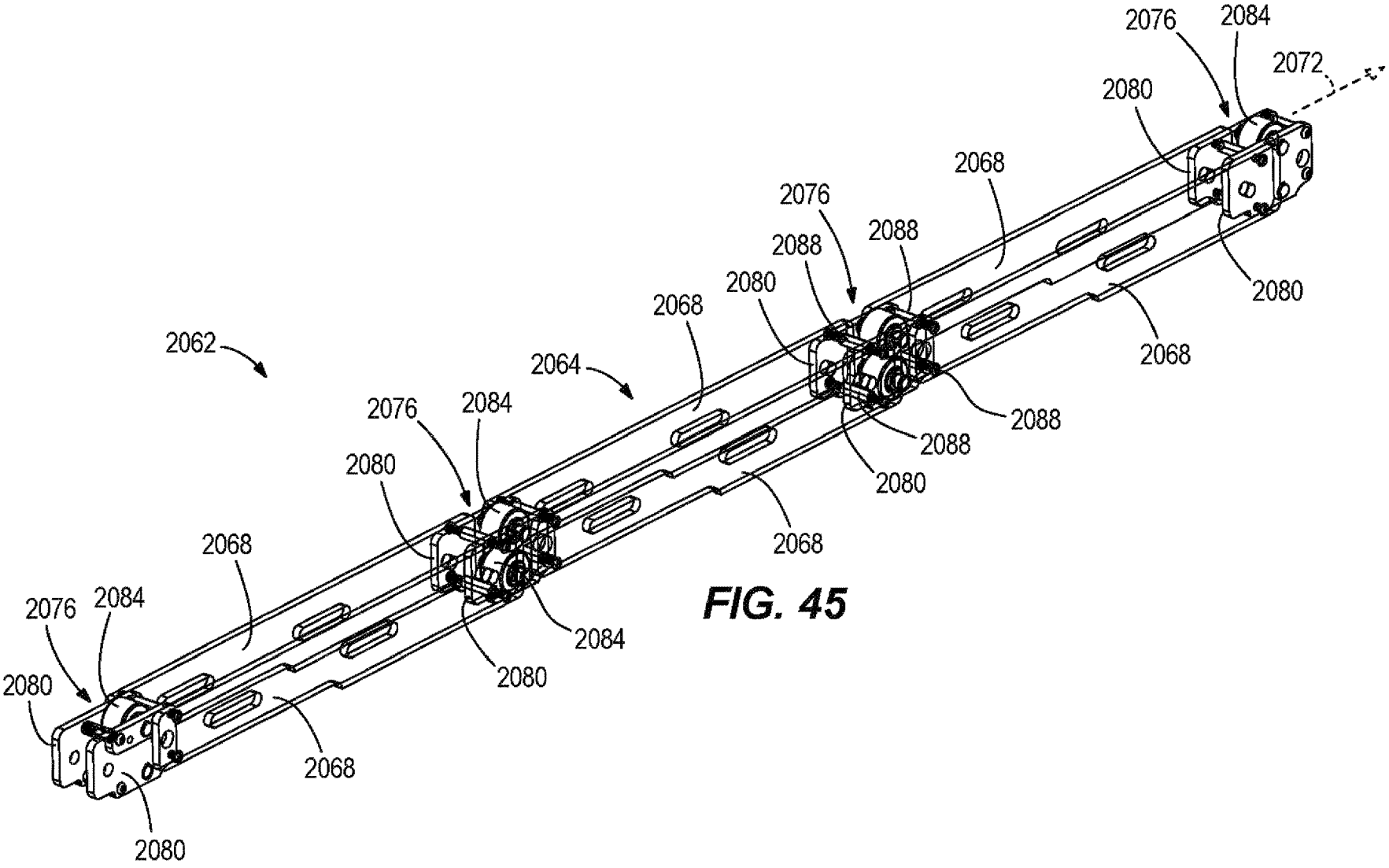
FIG. 45 is a perspective view of an internal carriage assembly of the elongate member.

With reference to FIG. 45, each of the elongate members 2062 includes an internal carriage assembly 2064. The internal carriage assembly 2064 includes a set of six carriage plates 2068 that form a body of the internal carriage assembly 2064. The carriage plates 2068 are arranged in three pairs that are coupled to one another linearly along a longitudinal, elongate direction 2072. Other constructions include different numbers and arrangements of carriage plates 2068 than that illustrated. For example, in some constructions the internal carriage assembly 2064 includes just two carriage plates 2068, or includes a single carriage plate 2068 that forms a body of the internal carriage assembly 2064.

With continued reference to FIG. 45, each of the carriage plates 2068 in one of the pairs of carriage plates 2068 extends parallel to and is spaced opposite from the other carriage plate 2068 in the pair. The internal carriage assembly 2064 further includes roller assemblies 2076 disposed between the opposed carriage plates 2068. The illustrated construction includes four roller assemblies 2076, although other constructions include different numbers of roller assemblies 2076. For example, in some constructions the internal carriage assembly 2064 includes just a single roller assembly 2076.

In the illustrated construction, two of the roller assemblies 2076 are disposed at opposite ends of the set of six carriage plates 2068, and the other two rollers assemblies 2076 are disposed between the pairs of the carriage plates 2068. The roller assemblies 2076 each include two roller plates 2080, at least one roller 2084 disposed between and rotatably coupled to the two roller plates 2080 (e.g., with pins), and fasteners 2088 (e.g., bolts) that extend through the two roller plates 2080 and through the carriage plates 2068 to couple the roller assemblies 2076 to the carriage plates 2068 and also to couple the set of six carriage plates 2068 together. Other constructions include various other numbers of rollers 2084, roller plates 2080, and fasteners 2088 than that illustrated.

Figure 46:
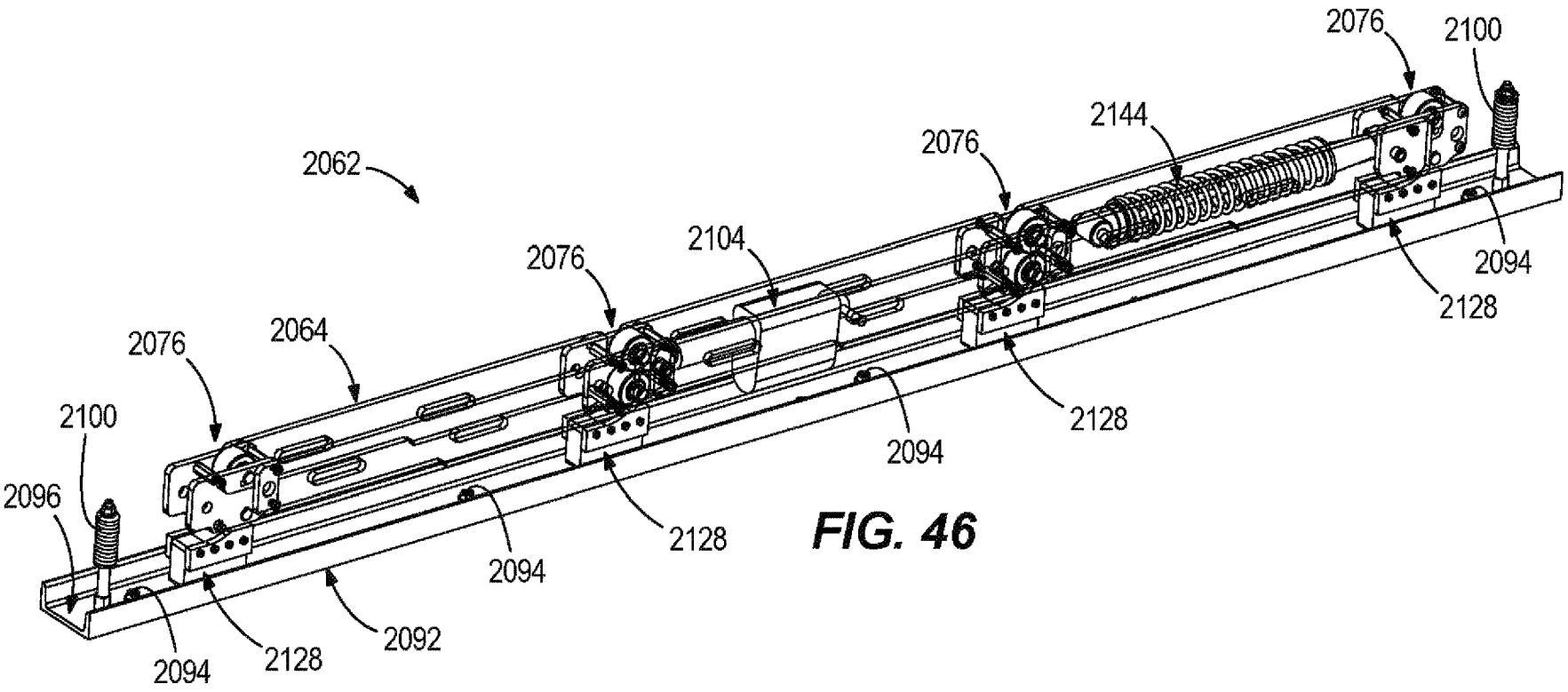
FIG. 46 is a perspective view of the internal carriage assembly, as well as a base member, an actuator assembly disposed within the internal carriage assembly, roller supports disposed on the base member that support the internal carriage assembly, vertically-oriented biasing members, and a shock absorber disposed at least mostly within the internal carriage assembly.
Figure 47:
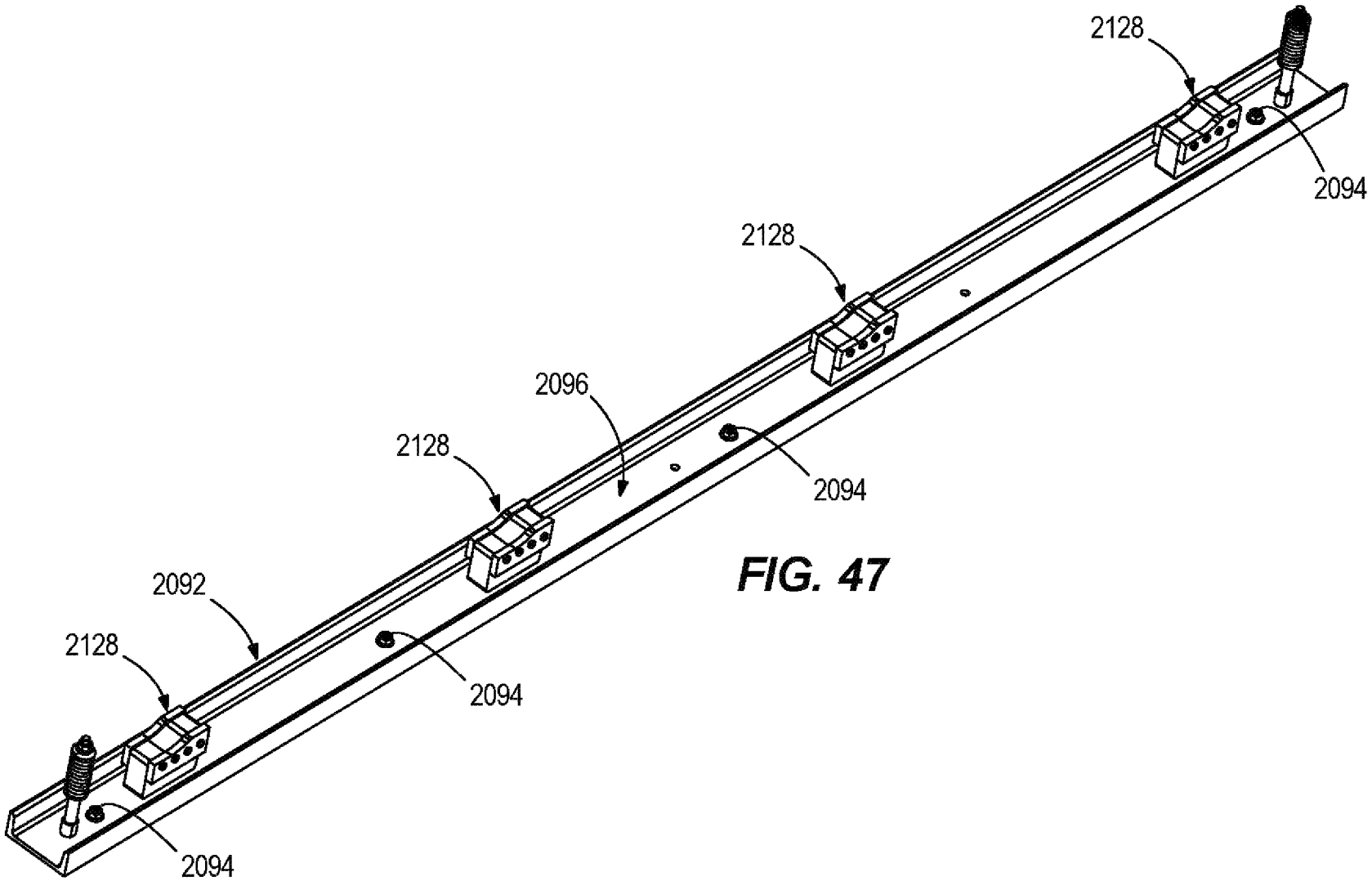
FIGS. 47 and 48 are perspective views of the base member, roller supports, and vertically-oriented biasing members.
Figure 48:
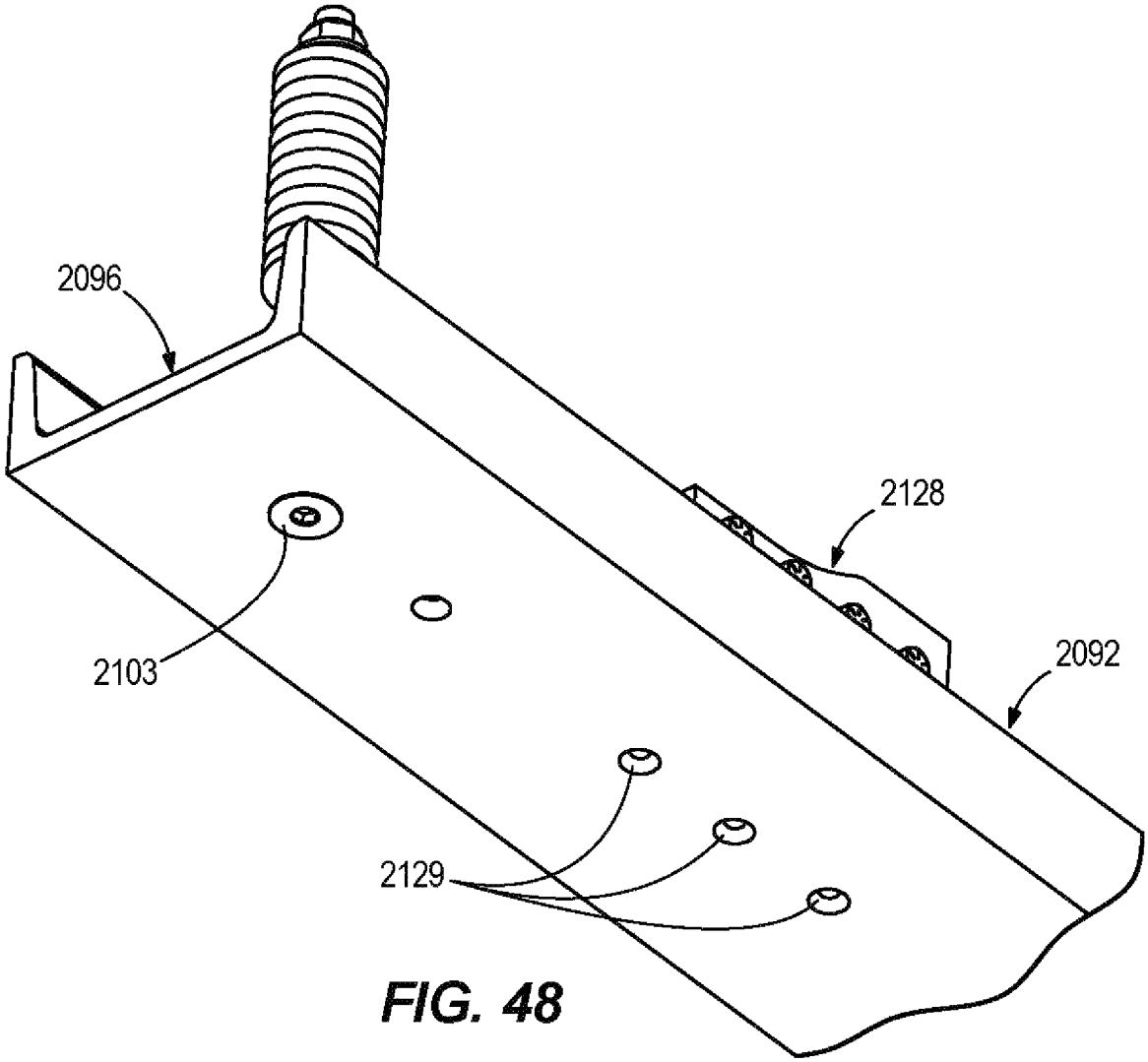

With reference to FIGS. 46-48, the automated rumble strip assembly 2010 further includes base members 2092 disposed beneath each of the elongate members 2062. The base members 2092 are fixed, for example to the frame 2014 within an interior of the main housing 2018 with fasteners 2094 (e.g., bolts, nuts, etc.). As illustrated in FIGS. 46-48, in the illustrated construction each base member 2092 has a U-shaped profile that forms a channel 2096. Other constructions include different shapes for the base member 2092 than that illustrated. In some constructions the base member 2092 is formed integrally as a single piece with the main housing 2018 of the frame 2014.

Figure 49:
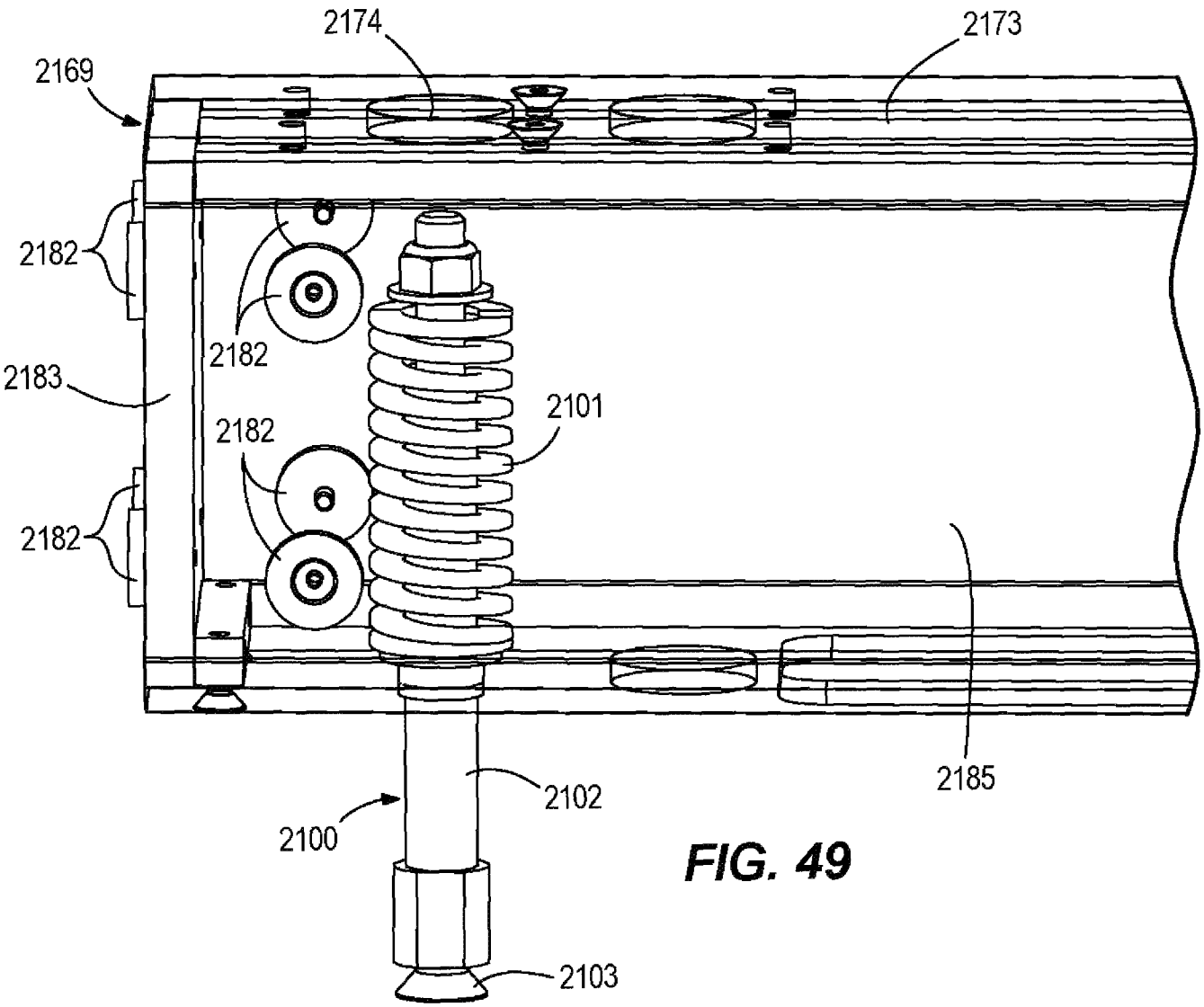
FIG. 49 is a partial, enlarged perspective view of one of the vertically-oriented biasing members and an elongate member housing.

With reference to FIGS. 46-49, in the illustrated construction two vertically-oriented biasing members 2100 (e.g., compression springs, plungers, etc.) are fixed to the base member 2092 at opposite ends of the base member 2092, and are disposed at least partially within the channel 2096. As described further herein, the biasing members 2100 are arranged to bias portions of the elongate member 2062 vertically upwards. Other constructions do not include the biasing members 2100, or include more or fewer biasing members 2100 than that illustrated. With reference to FIG. 49, in the illustrated construction, the vertically-oriented biasing members 2100 each include a biasing element (e.g., spring) 2101 positioned around a mandrel 2102. A lower cap screw 2103 is used to couple the vertically-oriented biasing member 2100 to the base member 2092 (FIG. 48).

Figure 50:
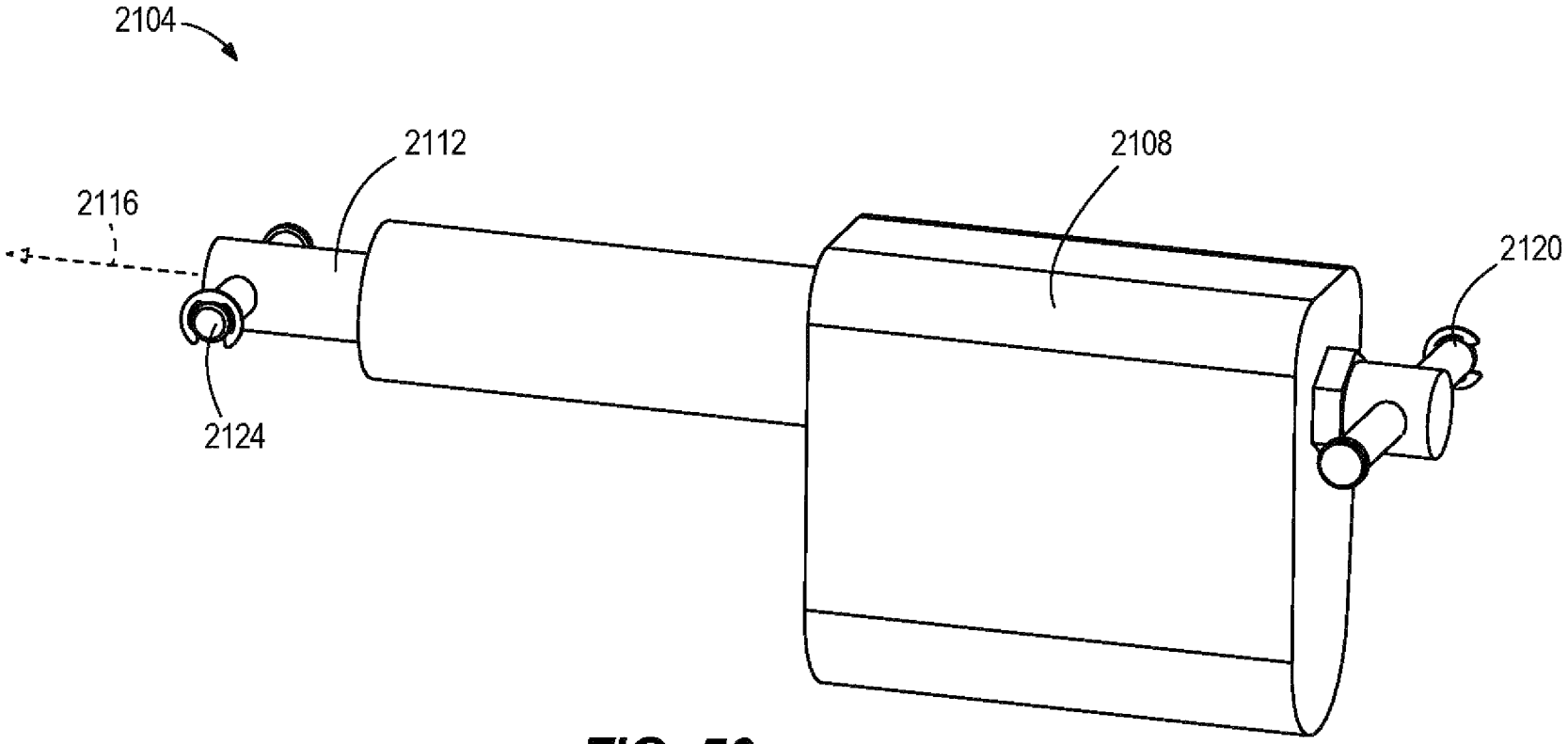
FIG. 50 is a perspective view of the actuator assembly.

With reference to FIGS. 46 and 50, each elongate member 2062 includes an actuator assembly 2104 coupled to the internal carriage assembly 2064. The actuator assembly 2104 includes, for example, a motor (e.g., electric), hydraulic actuator, or other prime mover that is capable of pushing the internal carriage assembly 2064. As illustrated in FIG. 46, the actuator assembly 2104 is disposed at least partially within the internal carriage assembly 2064, and is arranged to move with the internal carriage assembly 2064. With reference to FIG. 50, in the illustrated construction the actuator assembly 2104 includes a main housing 2108 (e.g., to house a motor), and an actuator shaft 2112 extending from the main housing 2108. When the actuator assembly 2104 is activated in a first state (e.g., extension), the actuator shaft 2112 is moved linearly along a first direction 2116. When the actuator assembly 2104 is activated in a second state (e.g., retraction), the actuator shaft 2112 is moved linearly in a second direction that is opposite to the first direction 2116. The actuator assembly 2104 further includes a first coupling member (e.g., pin) 2120 coupled to or disposed adjacent the main housing 2018, and a second coupling member (e.g., pin) 2124 coupled to the moving actuator shaft 2112.

With reference to FIGS. 46-48 and 51, each elongate member 2062 further includes roller supports 2128 that engage the rollers 2084. In the illustrated construction the roller supports 2128 are each coupled (e.g., fixed via fasteners extending through apertures 2129 illustrated in FIG. 48) to the base member 2092, and are disposed at least partially within the channel 2096. The roller supports 2128 support the internal carriage assembly 2064 and allow the internal carriage assembly 2064 to move from a first, raised position to a second, lowered position.

Figure 51:
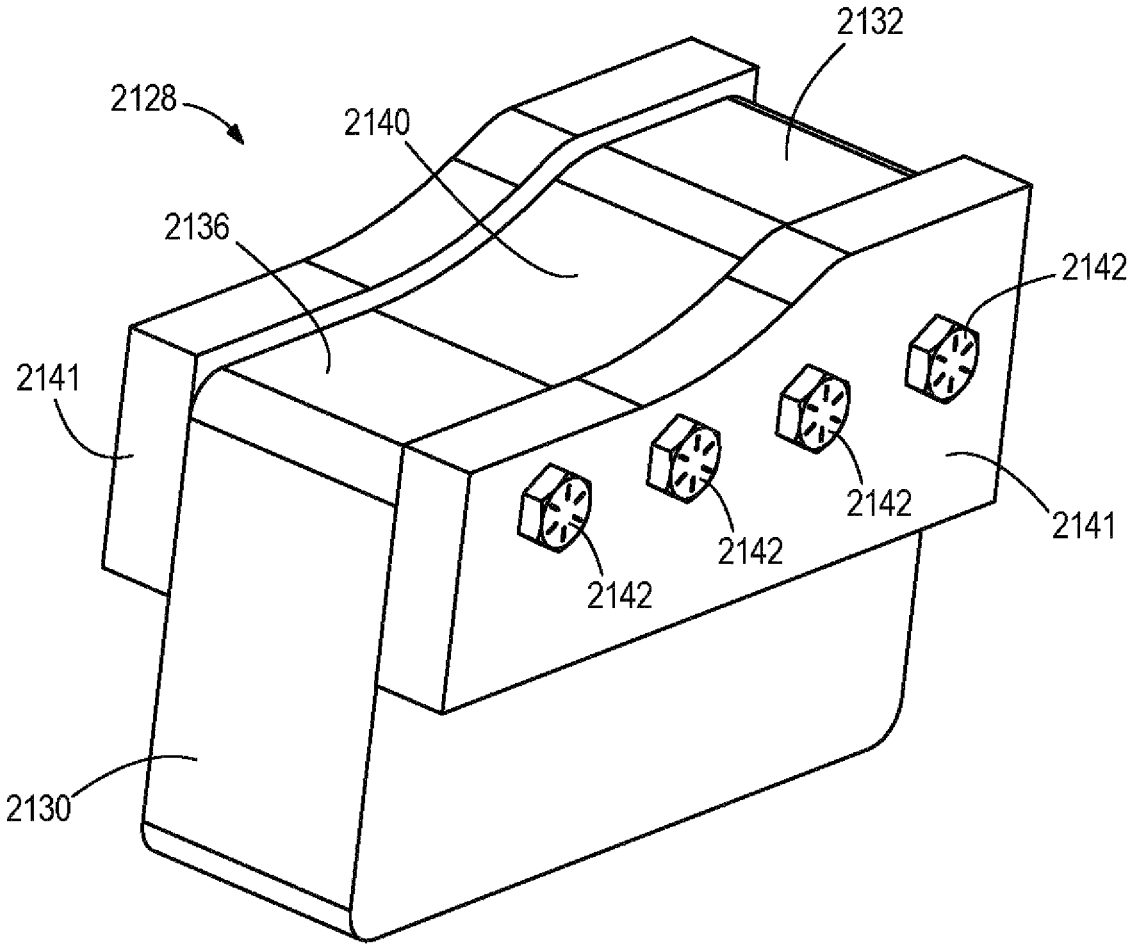
FIG. 51 is a perspective view of one of the roller supports.

For example, and with reference to FIG. 51, each roller support 2128 includes a body 2130 having first, generally flat and horizontal surface 2132 (e.g., that is parallel or substantially parallel to the roadway 2012 and top surface 2020 of the main housing 2018). Each roller support 2128 further includes a second, generally flat surface 2136 (e.g., that is parallel or substantially parallel to the first surface 2032). The first surface 2132 and the second surface 2136 are offset from one another in different planes. A third, inclined surface 2140 extends between the first surface 2132 and the second surface 2136. In some constructions the third surface 2140 is a concave, curved surface. In some constructions more than one surface is provided between the first surface 2132 and the second surface 2136. For example, in some constructions each rollers support 2128 includes yet another generally flat, horizontal surface between the first surface 2132 and the second surface 2136, and includes two separate inclined surfaces that extend from the additional flat surface to the first surface 2132 and the second surface 2136. Additionally, in some constructions the first surface 2132 and/or the second surface 2136 are not flat (e.g., have some curvature). The roller support 2128 further includes side guiding plates 2141 coupled to the body 2130 with fasteners 2142. Other constructions include various other surfaces and configurations of surfaces than that illustrated for the roller support 2128. As described further herein, when the actuator assembly 2104 is activated, the internal carriage assembly 2064 is forced to move, causing the rollers 2084 to slide along the roller supports 2128, and thus causing the internal carriage assembly 2064 to not only translate but also to rise and fall depending on which direction the actuator shaft 2112 is moving.

Figure 52:
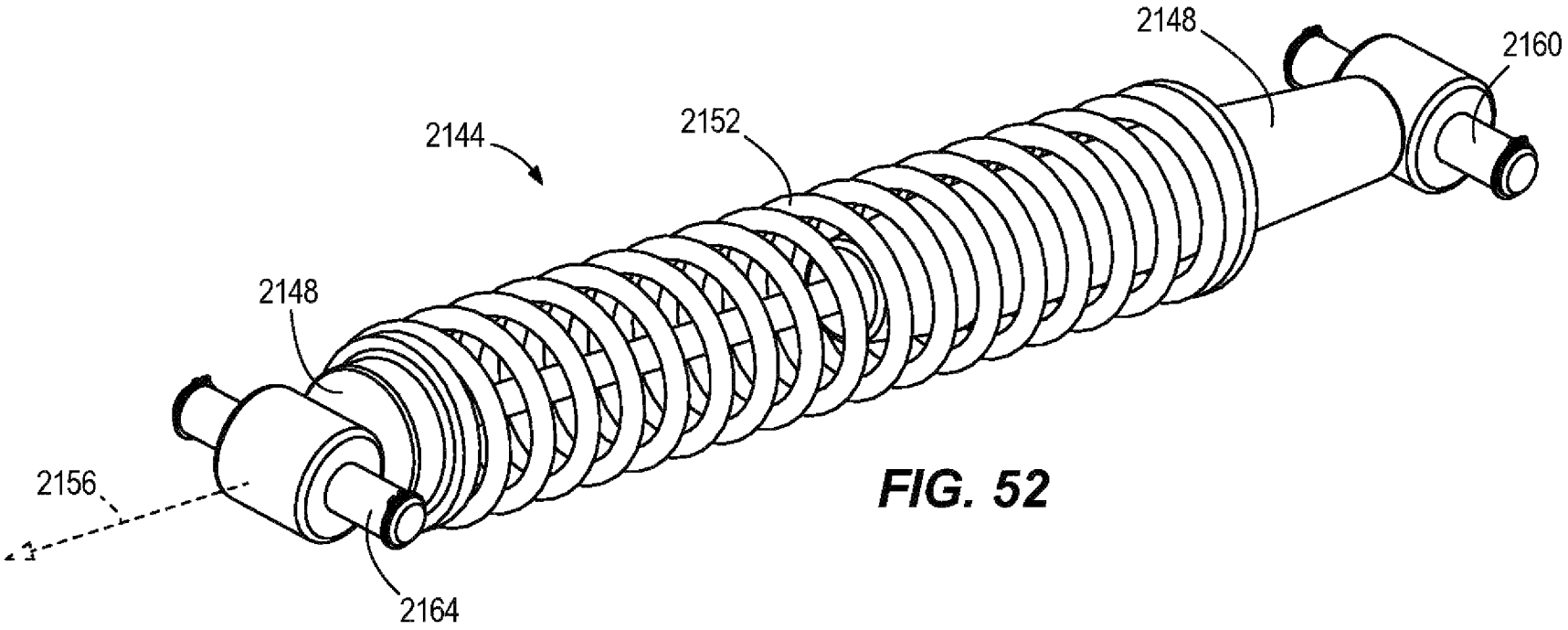
FIG. 52 is a perspective view of the shock absorber assembly.

With reference to FIGS. 46 and 52, each elongate member 2062 further includes a shock absorber assembly 2144 coupled to the internal carriage assembly 2064. As illustrated in FIG. 46, the shock absorber assembly 2144 is disposed at least partially within the internal carriage assembly 2064, and expands and contract within the internal carriage assembly 2064. With reference to FIG. 52, in the illustrated construction the shock absorber assembly 2144 includes, for example, core elements 2148 and a biasing element 2152 (e.g., compression spring) coupled to the core elements 2148. The biasing element 2152 is biased along a direction 2156 (e.g., the same direction as direction 2116 described above), such that the core elements 2148 are movable relative to one another. The shock absorber assembly 2144 further includes a first coupling member (e.g., pin) 2160 coupled to one of the core elements 2148, and a second coupling member (e.g., pin) 2164 coupled to the other core element 2148. In other constructions the shock absorber assembly 2144 includes more than one biasing element, or is positioned in other locations than that illustrated.

Figure 53:
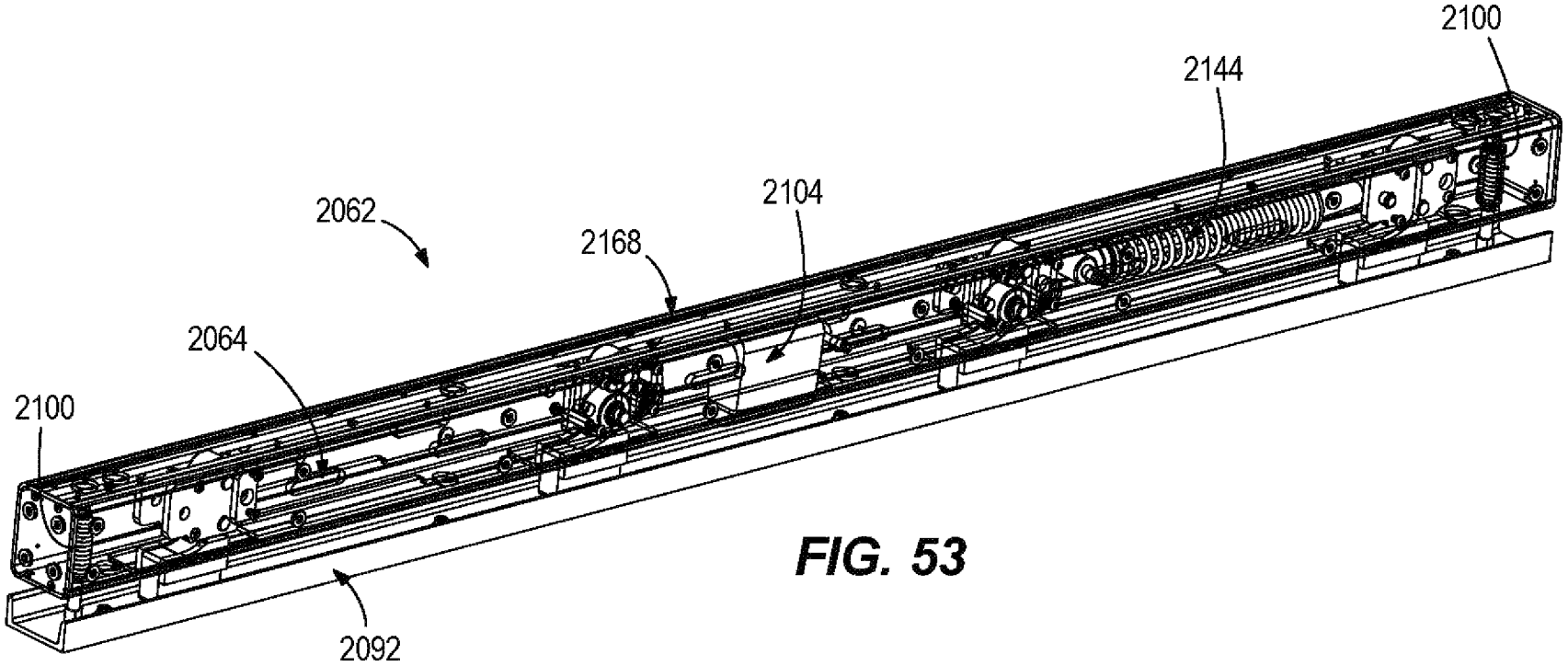
FIG. 53 is a perspective view of the elongate member of the rumble strip assembly of FIG. 41, illustrating the elongate member housing surrounding the internal carriage assembly.
Figure 54:
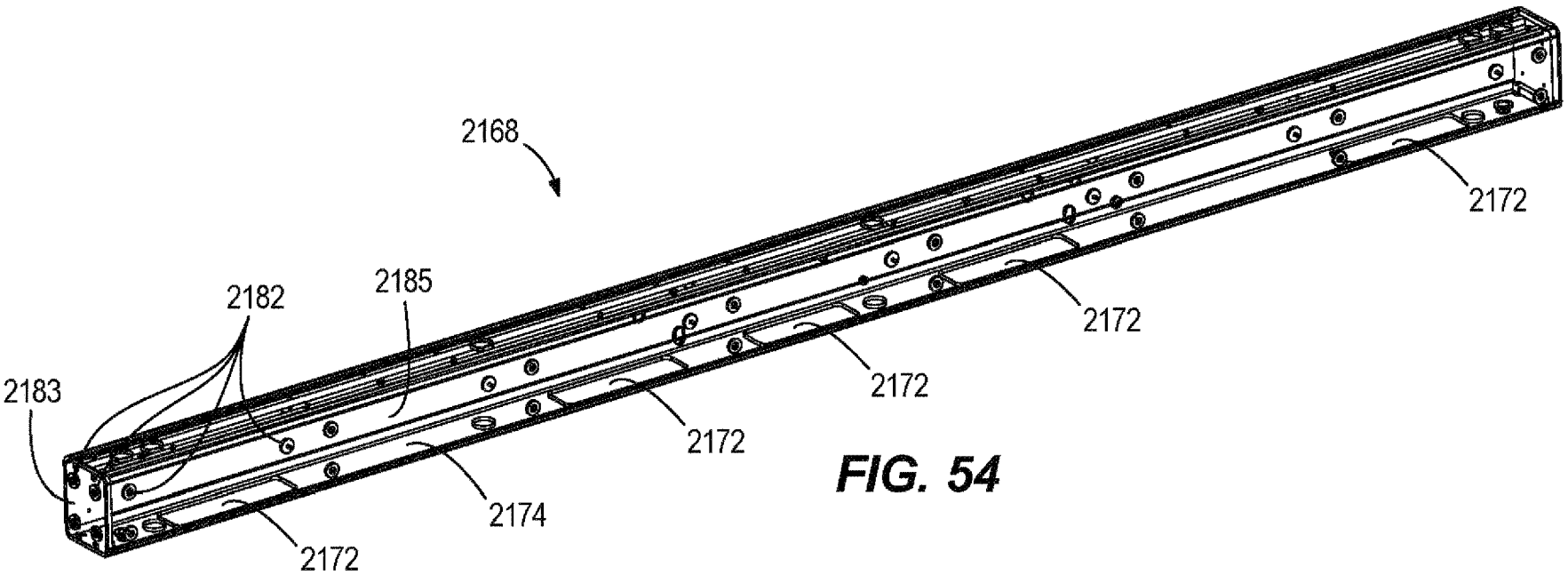
FIG. 54 is a perspective view of the elongate member housing.

With reference to FIGS. 49, 53 and 54, each elongate member 2062 further includes an elongate member housing 2168 that is positioned above the base member 2092, and in some constructions is biased upwardly by the vertically-oriented biasing members 2100. The internal carriage assembly 2064, as well as the actuator assembly 2104 and the shock absorber assembly 2144, are each disposed within the elongate member housing 2168. As illustrated in FIG. 54, the elongate member housing 2168 is generally an elongate hollow structure having a rectangular cross-section, and includes apertures 2172 along a bottom wall 2174 of the elongate member housing 2168. The apertures 2172 are sized and shaped (e.g., as rectangular apertures) to accommodate the roller supports 2128 and the main housing 2108 of the actuator assembly 2104. Other constructions include different shapes and sizes for the elongate member housing 2168, as well as different numbers and locations of apertures 2172 than that illustrated. With reference to FIG. 49, in some constructions the elongate member housing 2168 includes an upper wall 2173 that presses against the biasing element 2101 when the elongate member 2168 is lowered. For example, when the elongate member housing 2168 is lowered, an opening 2174 in the upper wall 2173 passes over an upper end of the mandrel 2102, and the biasing element 2101 engages the upper wall 2173.

Figure 55:
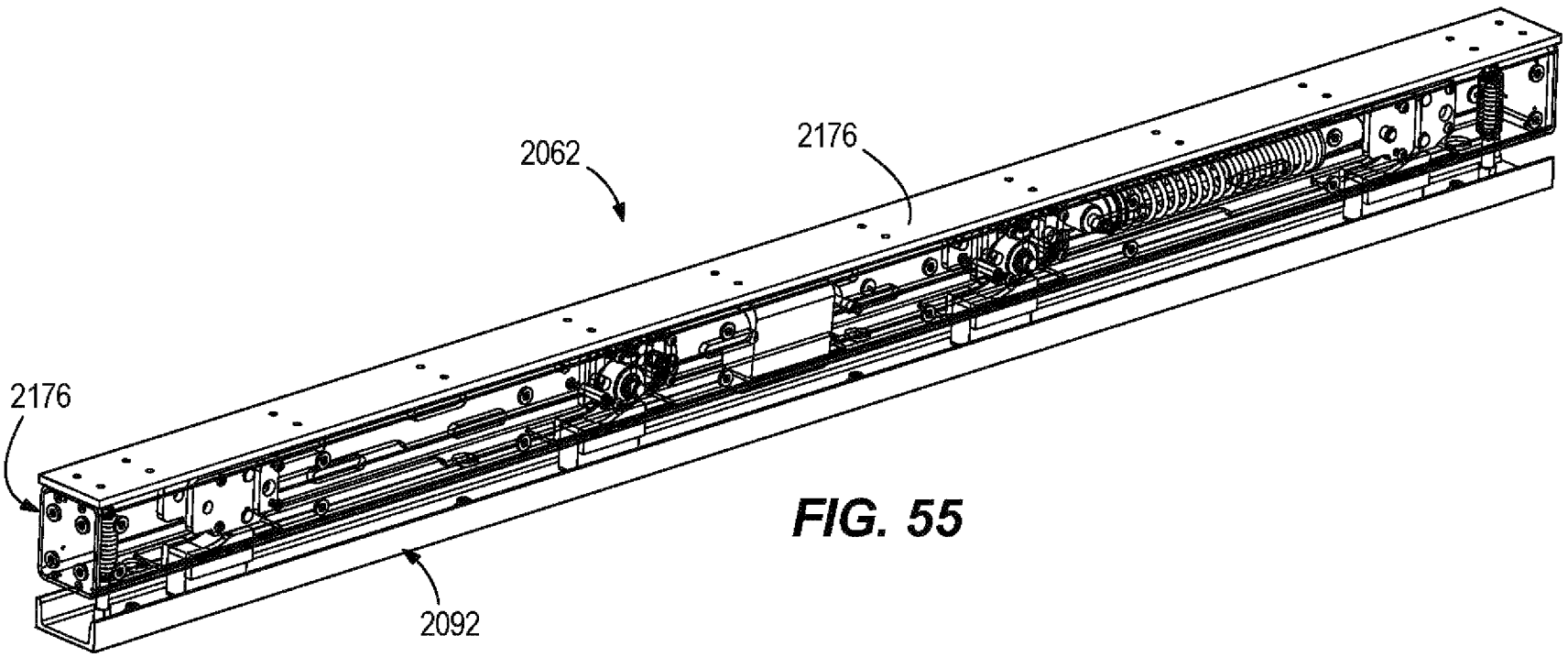
FIG. 55 is a perspective view of the elongate member, illustrating a top plate coupled to the elongate member housing.

With reference to FIGS. 43, 44, and 55, each elongate member 2062 further includes a top plate 2176 coupled to (fixed to or integrally formed as a single piece with) the elongate member housing 2168. As illustrated in FIGS. 43 and 44, when the elongate member 2062 is in a raised position, a top surface of the top plate 2176 of flush with a top surface of the guiding angle plates 2050.

With reference to FIGS. 42 and 43, in the illustrated construction each elongate member housing 2168 is also surrounded by a stationary outer housing 2180 within the main housing 2018 of the frame 2014. The stationary outer housing 2180 is coupled for example with rebar elements 2182 to the main housing 2018. Thus, the elongate member housing 2168 is generally restrained in all directions, with the exception of being free to move up and down between a raised position (i.e., where the top plate 2176 is flush with the top surface of the guiding angle plates 2050) and a recessed position (i.e., where the top plate 2176 is recessed into the frame 2014). As illustrated in FIG. 43, the outer housing 2180 includes end plates 2181, and as illustrated in FIGS. 49 and 54, in the illustrated construction pads 2182 (e.g., Teflon®) are coupled to ends 2183 and sides 2185 of the elongate member housing 2062. The pads 2182 help to hold/restrain the elongate member housing 2168, and to permit the vertical sliding movement of the elongate member housing 2168 alongside the outer housing 2180 (e.g., alongside the end plates 2181.

FIGS. 56-65 further illustrate how the internal carriage assembly 2064, the actuator assembly 2104, the shock absorber assembly 2144, and the elongate member housing 2168 are coupled together, to permit the internal carriage assembly 2064 to move relative to the elongate member housing 2168 within the elongate member housing 2168 and to cause the elongate member housing 2168 to move between the raised and recessed positions.

Figure 60:
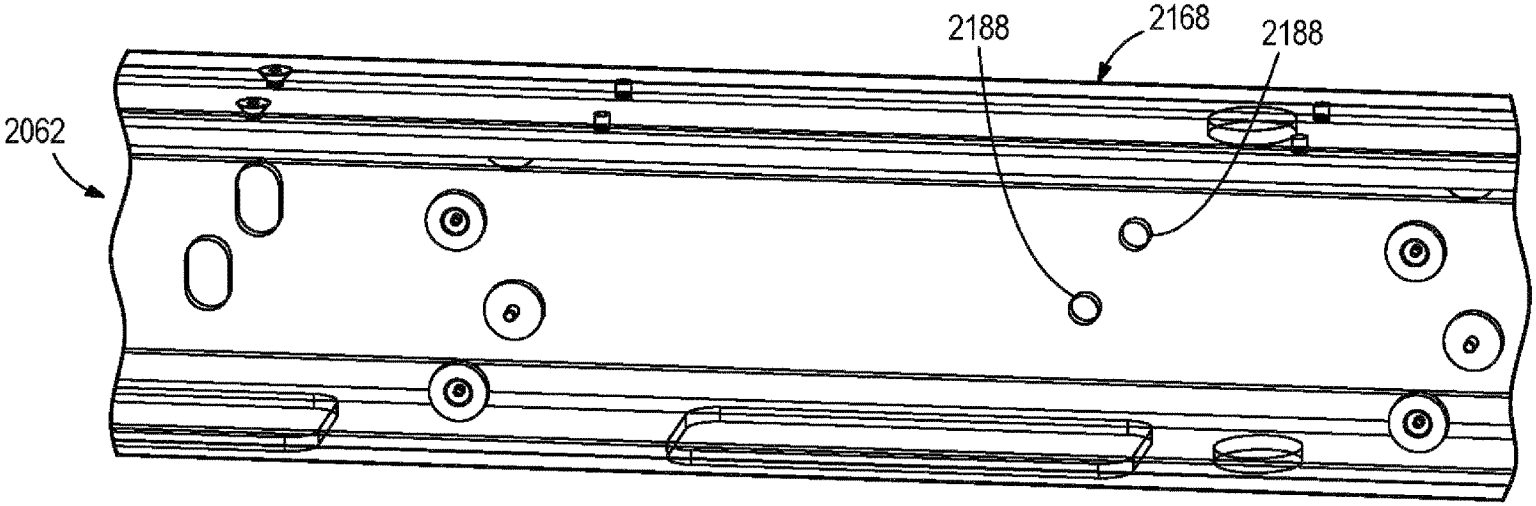
Figure 61:
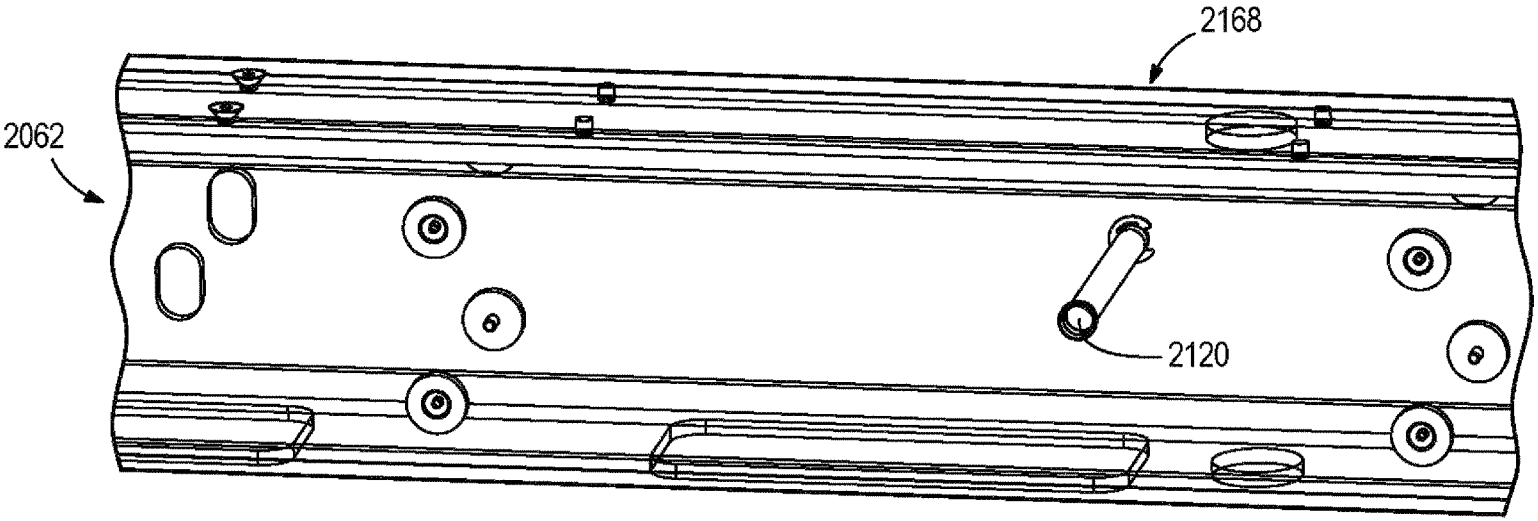

For example, and as described above, the actuator assembly 2104 includes a first coupling member 2120 (e.g., a pin) and a second coupling member 2124 (e.g., a pin). As illustrated in FIGS. 56-61, the first coupling member 2120 of the actuator assembly 2104 extends laterally through and at partially out of elongate slots 2184 of one pair of the carriage plates 2068. The second coupling member 2124 of the actuator assembly 2104 is fixed to two of the roller plates 2080. As illustrated in FIGS. 60 and 61, ends of the first coupling member 2120 of the actuator assembly 2104 extend into (e.g., and are held in place with retainers, frictionally, or otherwise held in place) apertures 2188 along walls of the elongate member housing 2168.

Figure 62:
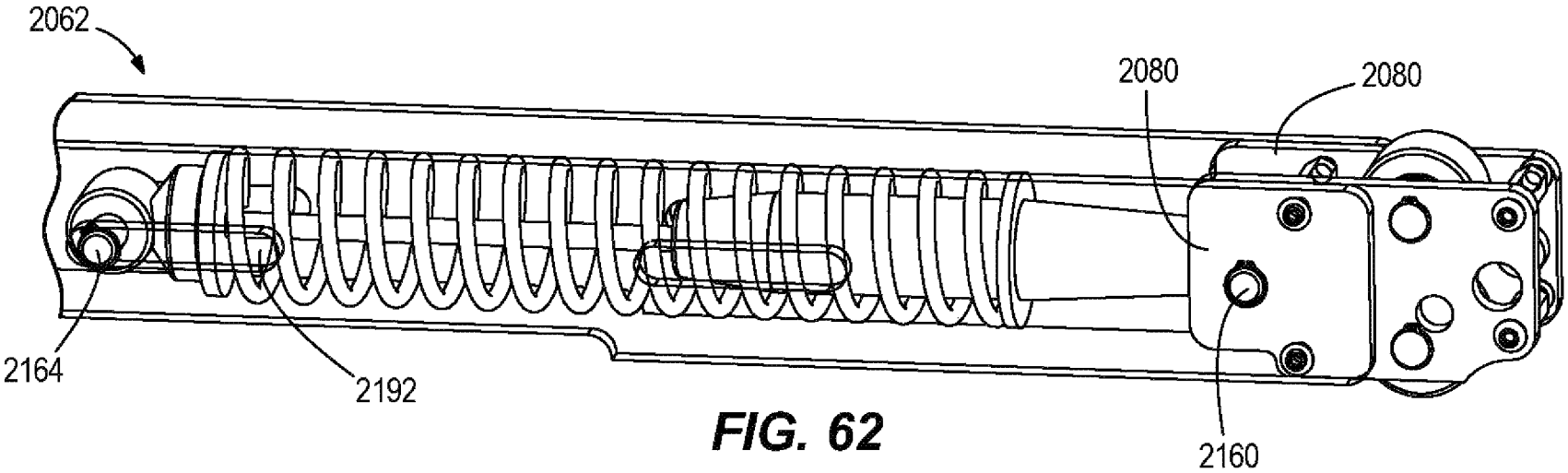
FIGS. 62-65 are perspective views of a portion of the elongate member, illustrating how the shock absorber assembly is coupled to the internal carriage assembly and the elongate member housing.
Figure 63:
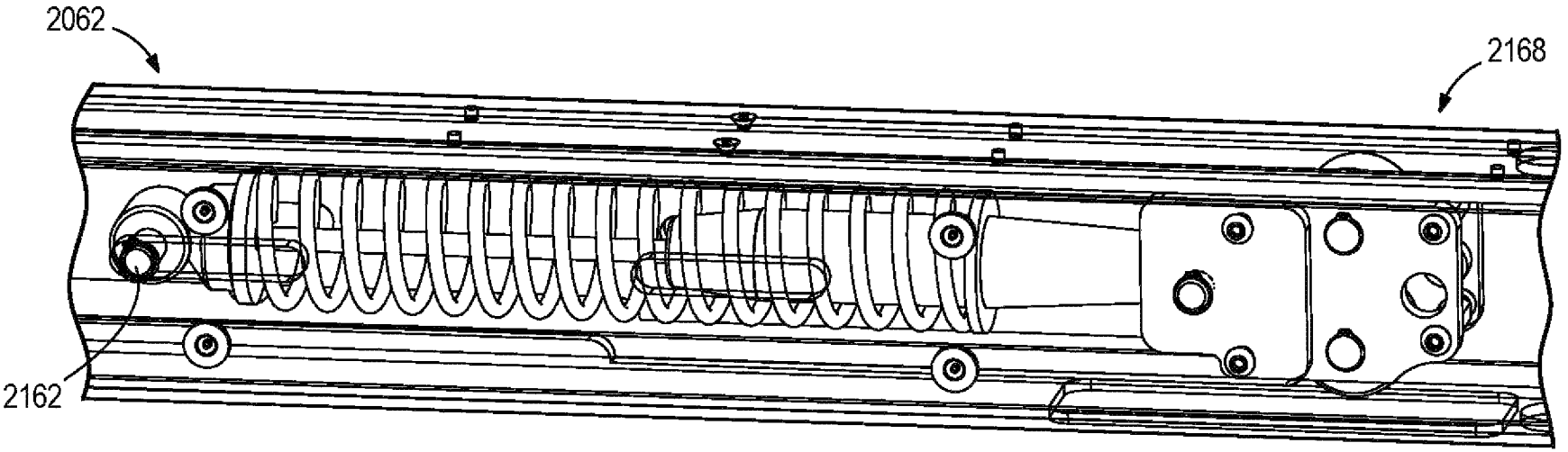
Figure 64:
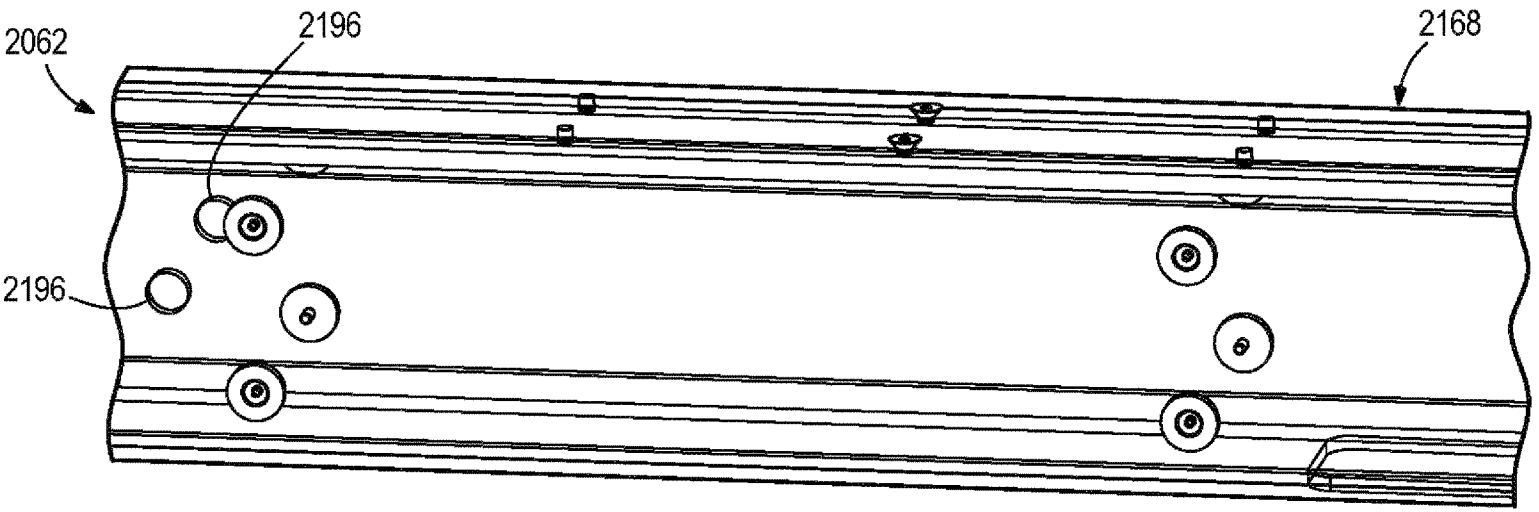
Figure 65:
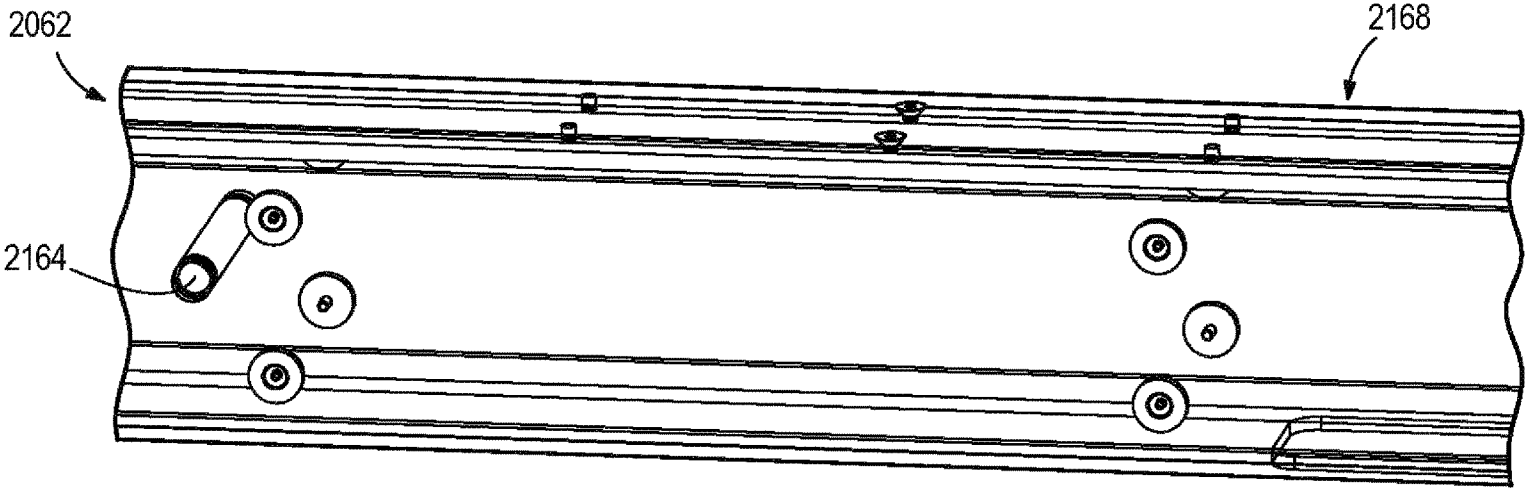

Additionally, and as described above, the shock absorber assembly 2144 includes a first coupling member 2160 (e.g., a pin) and a second coupling member 2164 (e.g., a pin). As illustrated in FIGS. 56-63, the first coupling member 2160 of the shock absorber assembly 2144 is fixed to two of the roller plates 2080. The second coupling member 2164 of the shock absorber assembly 2144 extends laterally through and at least partially out of elongate slots 2192 of one pair of the carriage plates 2068. As illustrated in FIGS. 62 and 63, ends of the second coupling member 2164 of the shock absorber assembly 2144 extend into (e.g., and are held in place with retainers, frictionally, or otherwise held in place) apertures 2196 along walls of the elongate member housing 2168.

During use, when the actuator assembly 2104 is activated in a first state, the actuator shaft 2112 extends away from the main housing 2108. Because the first coupling member 2120 of the actuator assembly 2104 is fixed to the elongate member housing 2168, and because the elongate member housing 2168 is restrained from axial movement, the activation of the actuator assembly 2104 causes the entire internal carriage assembly 2064 to slide within the elongate member housing 2168 (i.e., to the left in FIG. 56). This sliding movement is accommodated by the elongate slots 2184 on the carriage plates 2068. As the internal carriage assembly 2064 slides, the rollers 2084 begin to roll from the first surfaces 2132 down to the second surfaces 2136 of the rollers supports 2128, thus causing the internal carriage assembly 2064 (and the attached elongate member housing 2168) to lower vertically from the raised position to the recessed position.

When the internal carriage assembly 2064 is sliding within the elongate member housing 2168 to the recessed position, the second coupling member 2164 of the shock absorber assembly 2114 remains fixed to the elongate member housing 2168. However, the elongate slots 2192 permit the internal carriage assembly 2064 to continue to slide. Thus, the first coupling member 2160 of the shock absorber assembly 2144 is pulled toward the second coupling member 2164 of the shock absorber assembly 2144, and the biasing element 2152 is compressed. To return the internal carriage assembly 2064 to the raised position, the actuator assembly 2104 is retracted. When the internal carriage assembly 2064 is returned to the raised position, the internal carriage assembly 2064 slides back in the opposite direction (e.g., to the right in FIG. 56), and causes the rollers 2084 to roll from the second surfaces 2136 back up to the first surfaces 2132. This movement raises the elongate member 2062. In yet other constructions the shock absorber assembly 2144 and its biasing element 2152 may be arranged such that the biasing element 2152 is compressed when the internal carriage assembly is in the raised position, rather than the recessed position.

Figure 56:
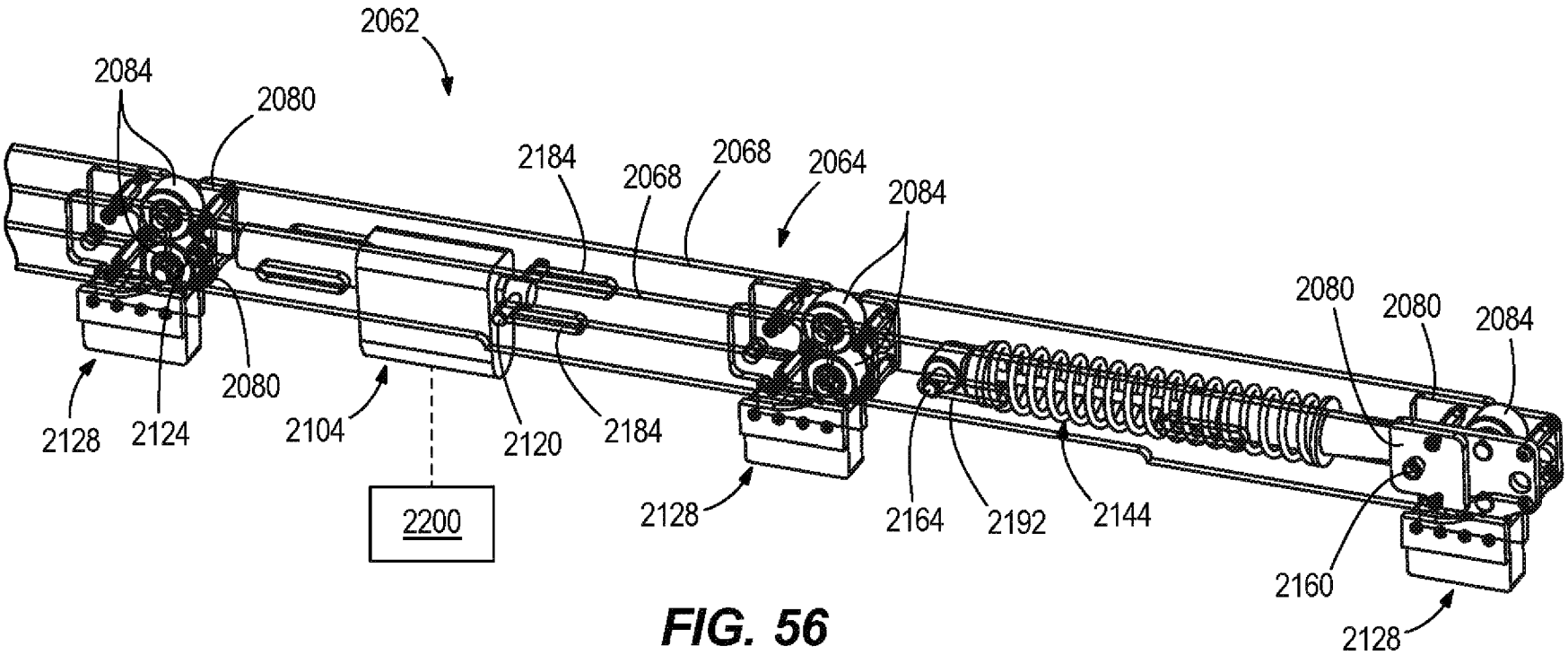
FIG. 56 is a perspective view of a portion of the elongate member, without the elongate member housing.
Figure 57:
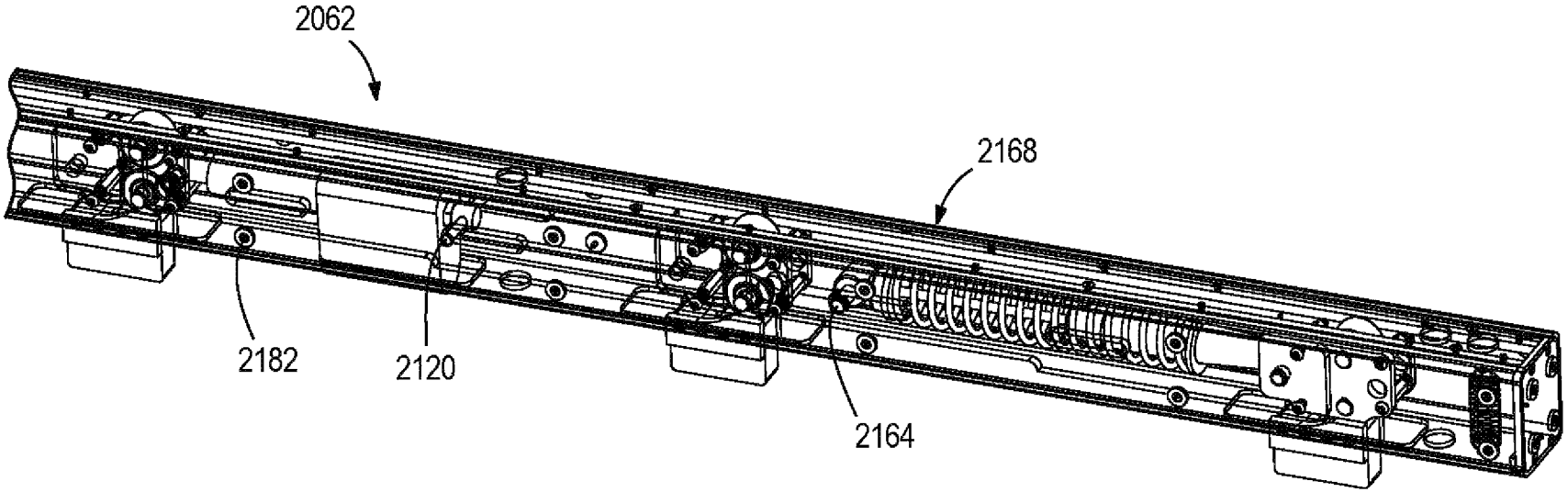
FIG. 57 is a perspective view of the portion of the carriage assembly of FIG. 45, with the elongate member housing, actuator assembly, roller supports, and shock absorber assembly added.
Figure 58:
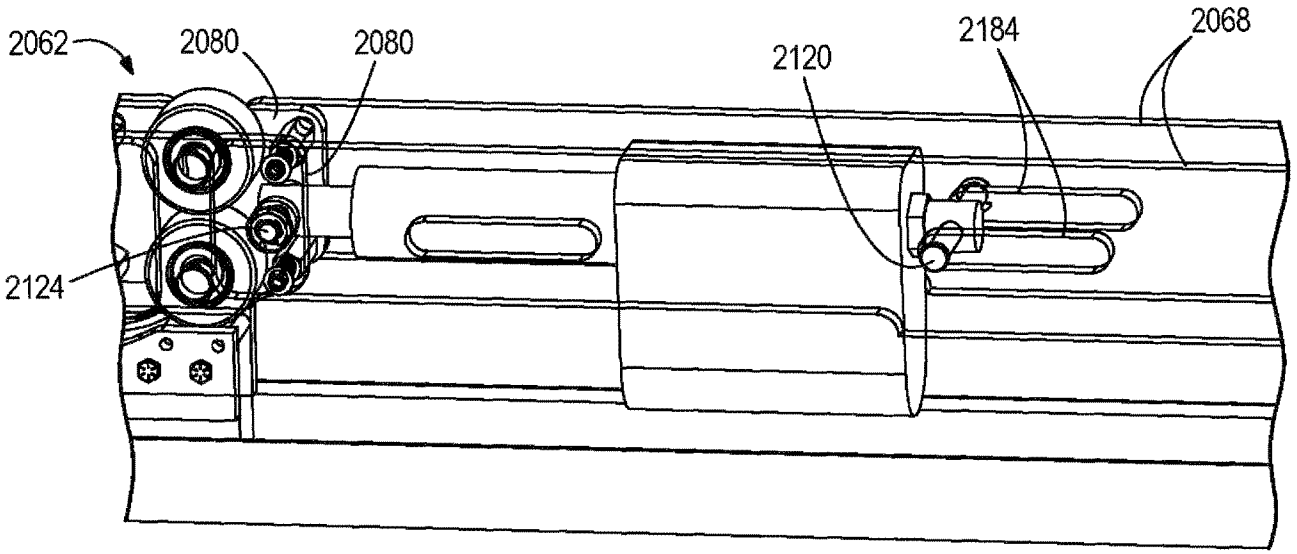
FIGS. 58-61 are perspective views of a portion of the elongate member, illustrating how the actuator assembly is coupled to the internal carriage assembly and the elongate member housing.
Figure 59:
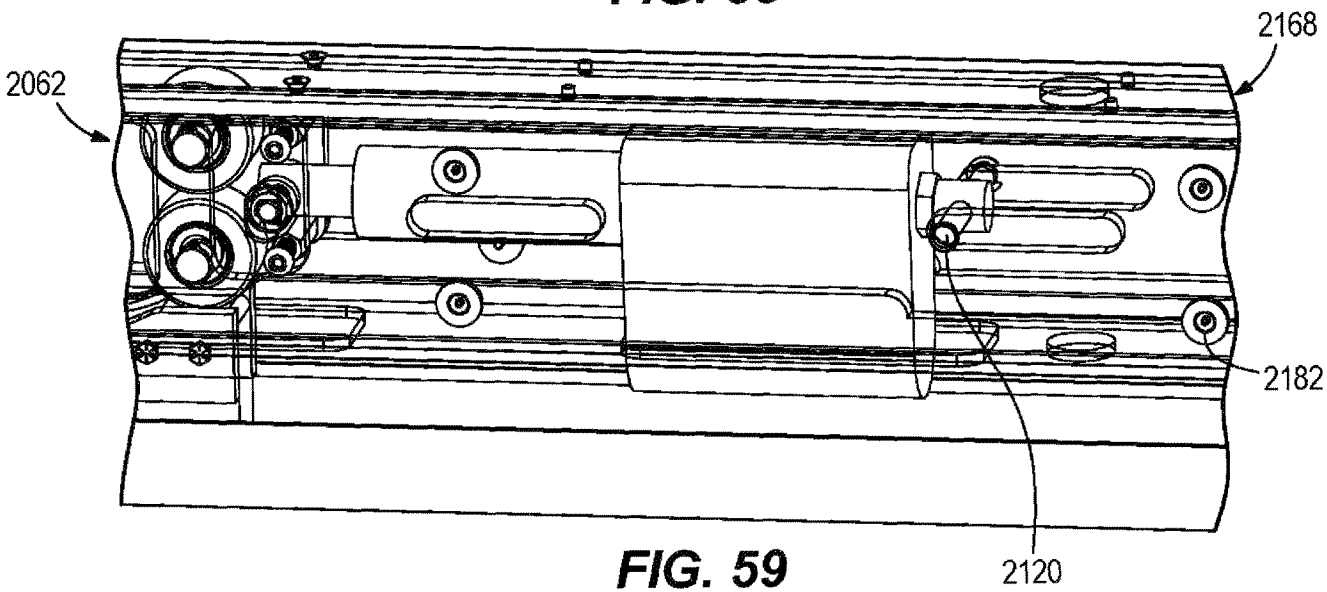

With reference to FIG. 56, in some constructions the automated rumble strip assembly 1010 further includes a controller 2200 coupled to one or more of the actuator assemblies 2104. In the illustrated construction the controller 2200 is coupled to each of the actuator assemblies 2104 of the five elongate members 2062, and controls each of the actuator assemblies 2104 so that the elongate members 2062 may be moved up and down together in a synchronized motion or so that each of the elongate members 2062 may be moved independently of the other (e.g., to raise or lower only a portion of the elongate members 2062 at one time). In some constructions the controller 2200 is disposed remotely from the actuator assembly 2104 and from the frame 2014. In yet other constructions the controller 2200 is disposed within the frame 2014. In some constructions, each of the elongate members 2062 includes its own associated controller 2200.

FIGS. 66-70 illustrate another automated rumble strip assembly 3010. Similar to the automated rumble strip assemblies 10, 1010, and 2010, the automated rumble strip assembly 3010 may be used to raise a level of driver attention on roadways, and to facilitate a reduction in a number and/or severity of crashes. In some constructions, the automated rumble strip assembly 3010 is sized and shaped to be integrally formed as part of a newly constructed roadway. In other constructions, the rumble strip assembly is sized and shaped so as to be a retrofit for an existing roadway.

The automated rumble strip assembly 3010 includes a wear plate in the form a guiding angle plate 3014 (e.g., similar to the guiding angle plates 50, 1050, 2050 described above). The guiding angle plate 3014 is coupled via wearing plate fasteners 3016 (e.g., bolts) to a frame (e.g., base) 3022. The frame 3022 may be part of or included within a larger frame (e.g., similar to the frames 14, 1014, 2014 described above) that houses a plurality of elongate members that are raised and lowered. In some constructions, the frame 3022 is made at least partially of concrete.

Figure 66:
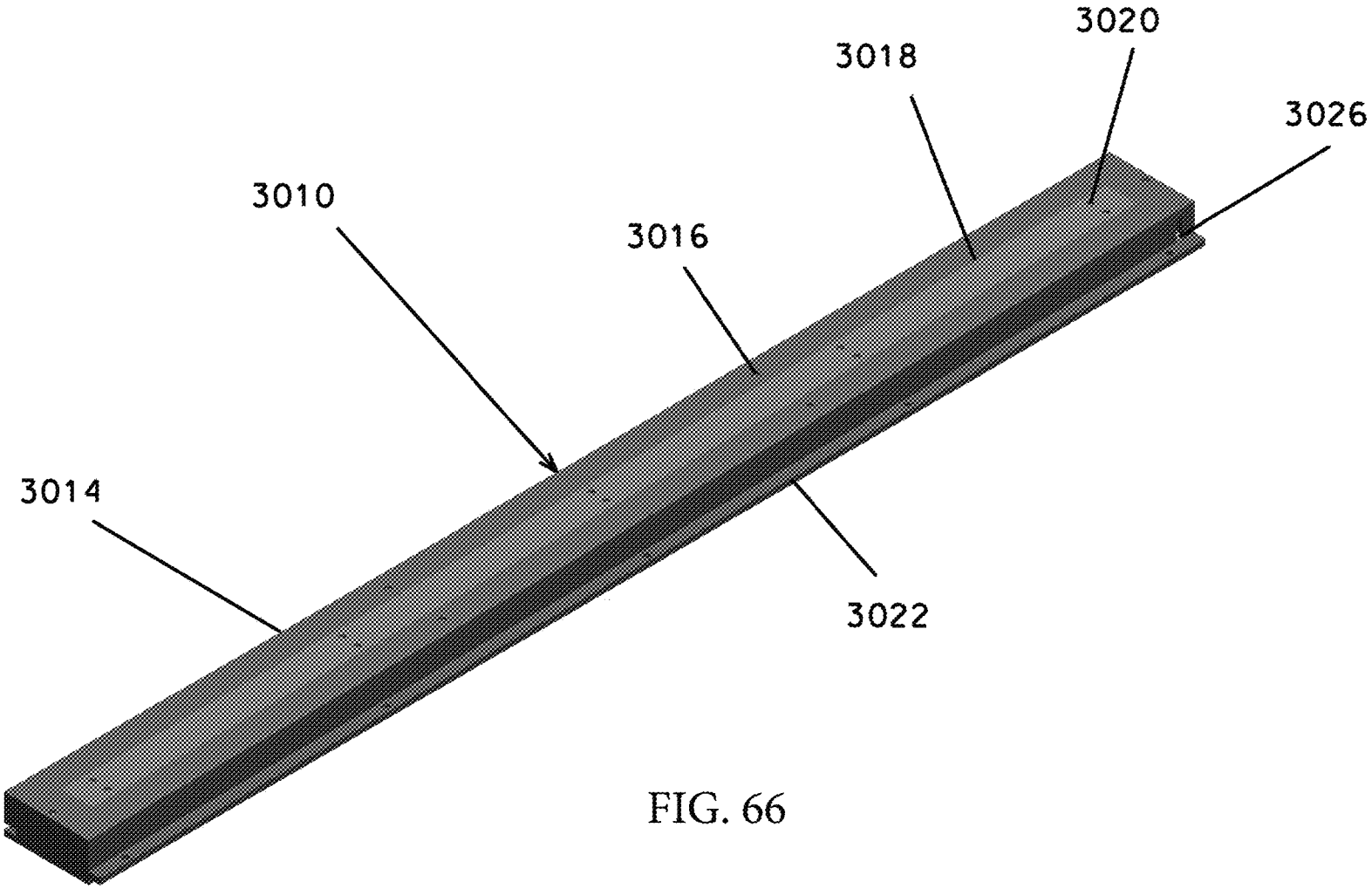
FIGS. 66-70 are perspective view of a rumble strip assembly according to another embodiment.
Figure 67:
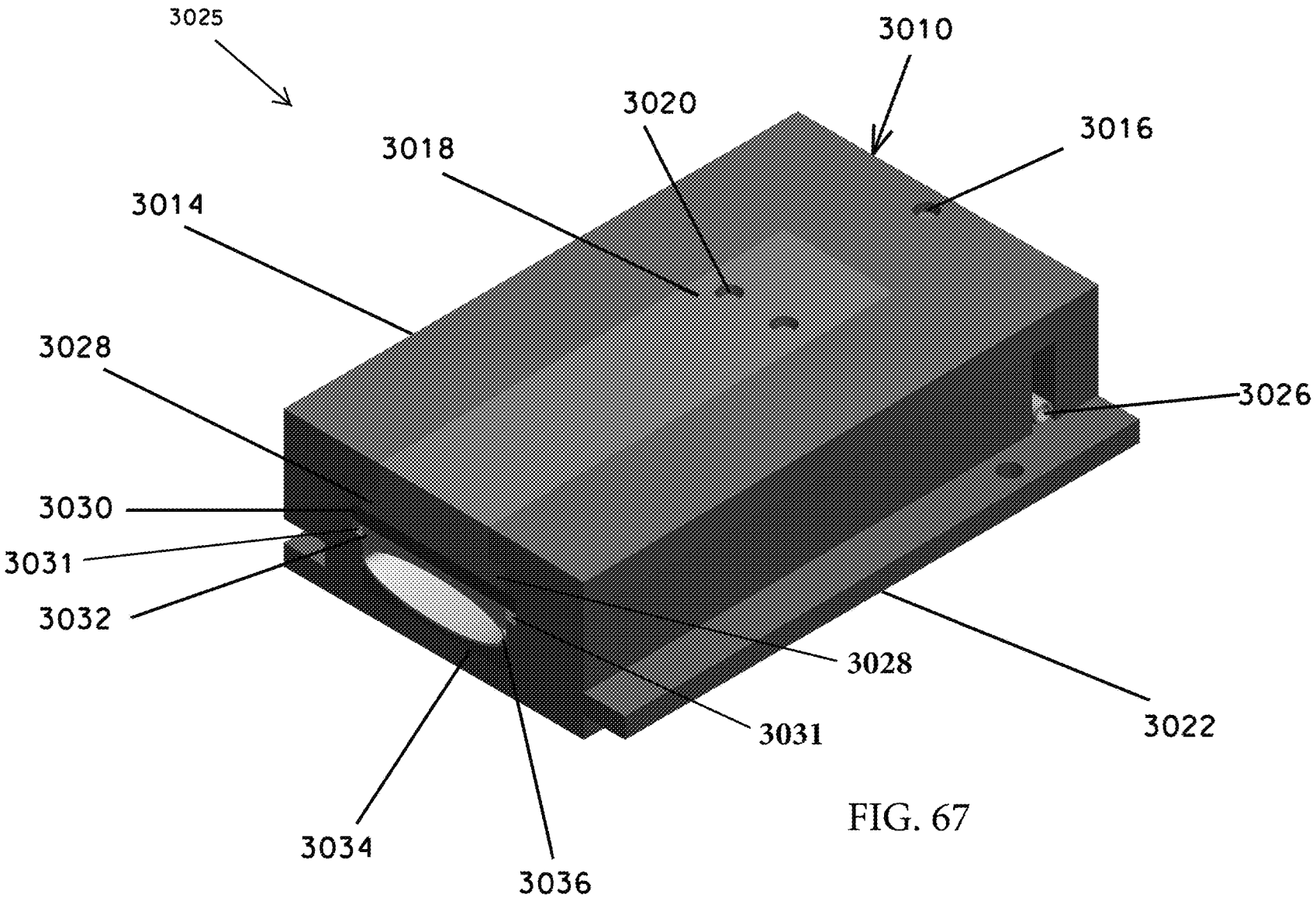
Figure 68:
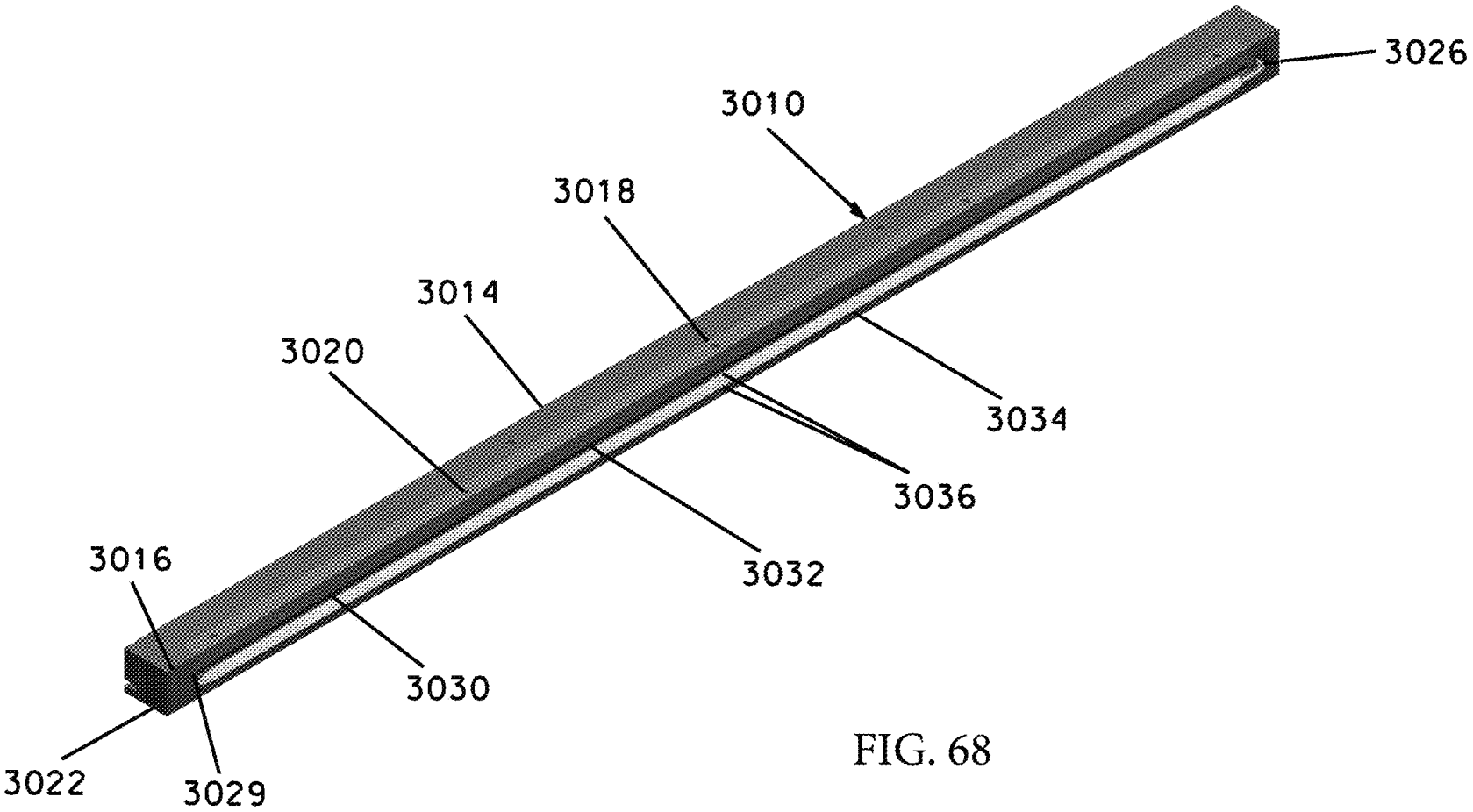

As illustrated in FIGS. 66 and 67, the guiding angle plate 3014 surrounds a rumble plate 3018 (e.g., similar to the top plate 2176 described above). When the rumble plate 3018 is in a raised position (as in FIGS. 66 and 67), a top surface of the rumble plate 3018 sits flush with a top surface of the guiding angle plate 3014.

Figure 70:
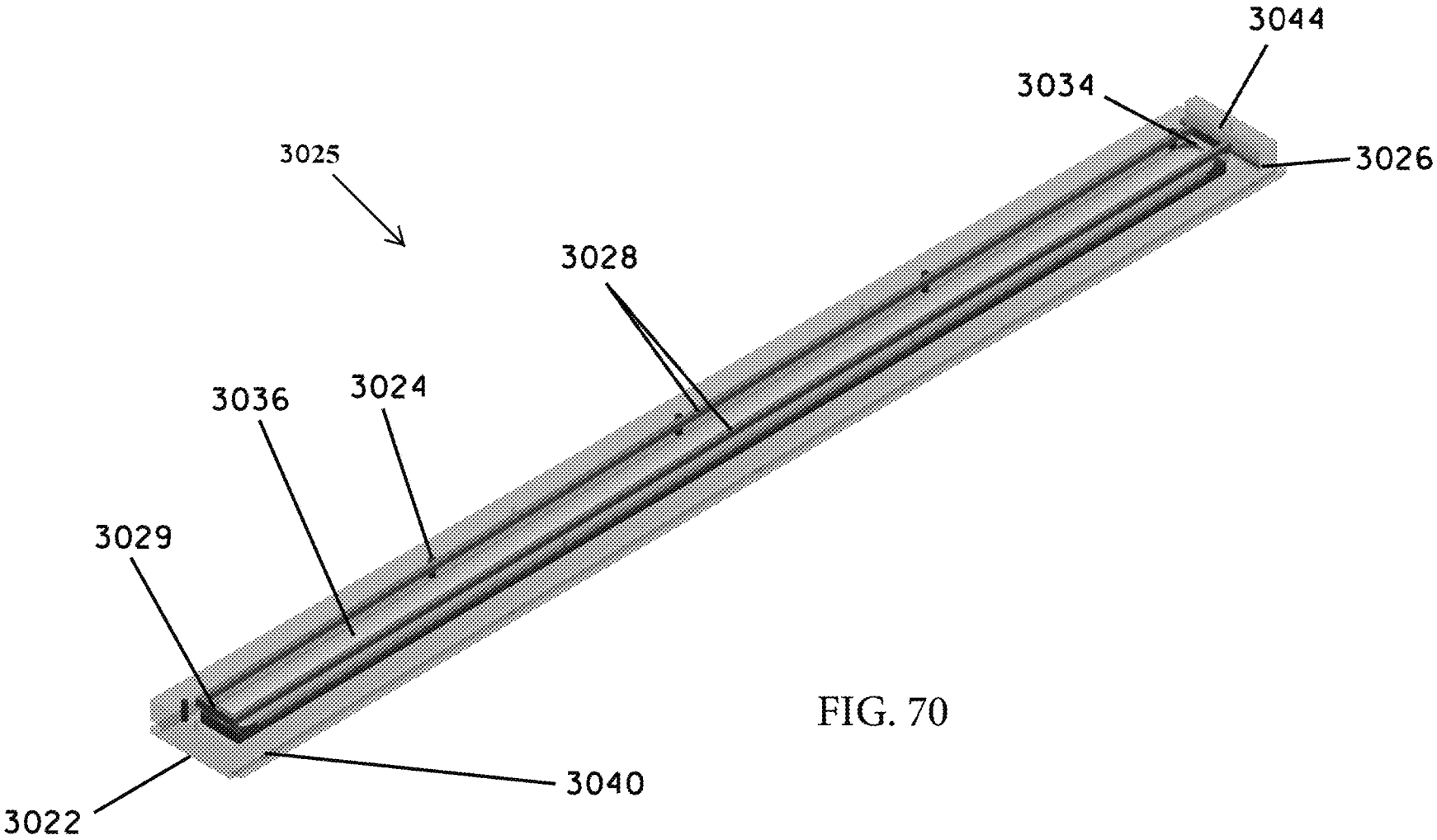

With reference to FIG. 67, the rumble plate 3018 sits above and is coupled via rumble plate fasteners 3020 (e.g., bolts) to a locking plate 3030. As illustrated in FIG. 67, lateral ends of the locking plate 3030 sit within opposite grooves 3031 within the frame 3022. The locking plate 3030 is thus vertically movable between a raised position as seen in FIG. 67 where the locking plate 3030 contacts upper walls forming the grooves 31, and a recessed position where the locking plate 3030 contacts lower walls forming the grooves 31. As illustrated in FIGS. 67 and 70, seals (e.g., rubber) 3028, 3029 are positioned above the locking plate 3030.

With reference to FIGS. 67 and 70, the rumble strip assembly 3010 further includes an actuator assembly 3025 that moves the rumble plate 3018 and locking plate 3030. In the illustrated construction, the actuator assembly 3025 is a hydraulic actuator assembly that includes a hydraulic lifting tube 3036 (e.g., flexible tube or other element configured to expand upon introduction of hydraulic fluid), a conduit 3026 (e.g., pipe) that delivers hydraulic fluid to the hydraulic lifting tube 3036, a hydraulic cover 3032 (e.g., rigid element) coupled to a top of the hydraulic lifting tube 3036 and positioned below the locking plate 3030, and a hydraulic base 3034 (e.g., that receives and/or supports the hydraulic lifting tube 3036).

During use, hydraulic fluid (or air or other material) is pumped through the conduit 3026 and into the hydraulic lifting tube 3036, causing the hydraulic cover 3032, the locking plate 3030, and the rumble plate 3018 to rise together until the top surface of the rumble plate 3018 is flush with the guiding angle plate 3014. In this raised position, the locking plate 3030 is forced against the upper walls defining the grooves 3031. To move the rumble plate 3018 to the lowered position, fluid is removed from the hydraulic lifting tube 3036. The hydraulic cover 3032, the locking plate 3030, and the rumble plates 3018 are thereby lowered, until the locking plate 3030 is at rest on the bottom walls defining the groove 3031. In some constructions, the rumble strip assembly 3010 includes multiple locking plates 3030 that are raised and lowered, and are coupled to the rumble plate 3018.

Figure 69:
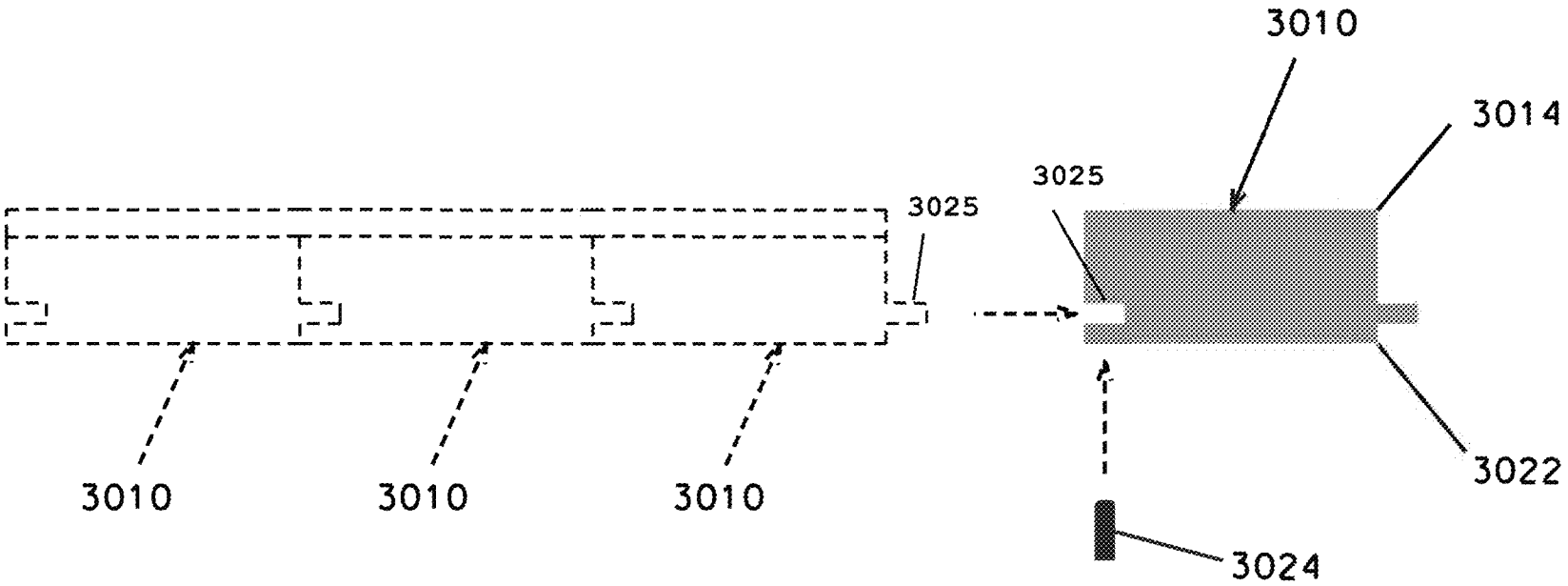

With reference to FIG. 69, in some constructions a modular assembly may be formed from multiple rumble strip assemblies 3010. For example, in the illustrated construction, each rumble strip assembly 3010 includes friction pins 3024. The friction pins 3024 may be inserted through the frames 3022 to link and couple the frames 3022 together. The frames 3022 may include keyed regions 3025 (e.g., cut-outs, notches, protrusions, shelves, tongues and grooves, etc.) that facilitate alignment and positioning of the rumble strip assemblies 3010. In some constructions, the rumble strip assemblies 3010 are glued together and/or use both glue and the friction pins 3024 to hold the rumble strip assemblies 3010 together.

In some constructions, the same conduit 3026 is attached to each hydraulic lifting tube 3036 in the modular assembly through pipe channels within the frames 3022. To create a closed pipe circuit, one end of the hydraulic lifting tube 3036 may be capped or otherwise closed off, and an opposite end may be coupled to a fluid pump.

Although the invention has been described in detail with reference to certain preferred embodiments, variations and modifications exist within the scope and spirit of one or more independent aspects of the invention as described.

What is claimed is:

1. An automated rumble strip assembly comprising:

a frame having a top surface configured to support a vehicle tire moving along the frame; and a plurality of elongate members disposed within the frame, wherein each said elongate member includes an elongate member housing, wherein each of the elongate members includes an internal carriage assembly disposed within the elongate member housing and moveable within the elongate member housing, wherein each said elongate member further includes an actuator assembly coupled to the internal carriage assembly and configured to move the internal carriage assembly relative to the elongate member housing;

wherein each said internal carriage assembly includes a plurality of carriage plates, wherein at least one of the carriage plates includes an elongate slot, wherein each said elongate member housing includes a wall having an aperture, wherein each actuator assembly includes a coupling member that extends into and slides within the elongate slot, and wherein the coupling member additionally extends into the aperture.

2. The automated rumble strip assembly of claim 1, wherein each said elongate member includes at least one roller assembly coupled to the carriage plates.

3. The automated rumble strip assembly of claim 2, wherein the at least one roller assembly includes a plurality of roller plates, and at least one roller disposed between and rotatably coupled to the roller plates.

4. The automated rumble strip assembly of claim 1, further comprising at least one roller assembly coupled to the internal carriage assembly, wherein the at least one roller assembly includes at least one roller, and wherein the automated rumble strip assembly further includes at least one roller support that supports the at least one roller.

5. The automated rumble strip assembly of claim 4, further comprising a base member fixed to the frame, wherein the at least one roller support is fixed to the base member.

6. The automated rumble strip assembly of claim 4, wherein the at least one roller support includes a first surface, a second surface offset from the first surface, and a third inclined surface that extends between the first surface and the second surface.

7. The automated rumble strip assembly of claim 1, wherein each said elongate member further includes a shock absorber assembly disposed at least partially within the internal carriage assembly, wherein the shock absorber assembly includes core elements and a biasing element coupled to the core elements.

8. The automated rumble strip assembly of claim 1, wherein each actuator assembly includes a main housing, and an actuator shaft configured to move relative to the main housing, wherein the actuator assembly includes a first pin fixed to the elongate member housing, and a second pin fixed to the actuator shaft and to the internal carriage assembly, such that when the actuator is activated the actuator shaft extends and moves the internal carriage assembly relative to the elongate member housing.

9. An automated rumble strip assembly comprising:

a frame having a top surface configured to support a vehicle tire moving along the frame; and a plurality of elongate members disposed within the frame and movable relative to the top surface, wherein each elongate member includes an elongate member housing, and an actuator assembly disposed at least partially within the elongate member housing and configured to move the elongate member housing between a raised position and a recessed position relative to the top surface of the frame, wherein the actuator assembly is configured to move with the elongate member housing between the raised position and the recessed position;

wherein each elongate member includes an internal carriage assembly disposed within the elongate member housing, wherein each internal carriage assembly includes a plurality of carriage plates, and wherein each elongate member includes at least one roller assembly coupled to the carriage plates;

wherein the at least one roller assembly includes a plurality of roller plates, at least one roller disposed between and rotatably coupled to the roller plates, and a plurality of fasteners that couple the roller plates to the carriage plates.

10. The automated rumble strip assembly of claim 9, further comprising the at least one roller assembly being disposed within the elongate member housing and wherein the automated rumble strip assembly further includes at least one roller support that supports the at least one roller.

11. The automated rumble strip assembly of claim 10, further comprising a base member fixed to the frame, wherein the at least one roller support is fixed to the base member.

12. The automated rumble strip assembly of claim 10, wherein the at least one roller support includes a first surface, a second surface offset from the first surface, and a third inclined surface that extends between the first surface and the second surface.

13. The automated rumble strip assembly of claim 9, wherein at least one of the carriage plates includes an elongate slot, wherein the elongate member housing includes a wall having an aperture, wherein the actuator assembly includes a coupling member that extends into and slides within the elongate slot.

14. The automated rumble strip assembly of claim 9, wherein each elongate member further includes a shock absorber assembly disposed at least partially within the elongate member housing, wherein the shock absorber assembly includes core elements and a biasing element coupled to the core elements.

15. The automated rumble strip assembly of claim 14, wherein at least one of the carriage plates includes an elongate slot, wherein the elongate member housing includes a wall having an aperture, wherein the shock absorber assembly includes a first coupling member that extends into and slides within the elongate slot, and a second coupling member that extends into the aperture.

16. The automated rumble strip assembly of claim 9, wherein the actuator assembly includes a main housing, and an actuator shaft configured to move relative to the main housing, wherein the actuator assembly includes a first pin fixed to the elongate member housing and a second pin fixed to the actuator shaft and to the internal carriage assembly, such that when the actuator is activated the actuator shaft extends and moves the internal carriage assembly relative to the elongate member housing.

17. An automated rumble strip assembly comprising:

a frame having a top surface configured to support a vehicle tire moving along the frame; and a plurality of elongate members disposed within the frame, wherein each elongate member includes an elongate member housing, an internal carriage assembly disposed within the elongate member housing and moveable within the elongate member housing, and an actuator assembly coupled to the internal carriage configured to move the internal carriage relative to the elongate member housing;

wherein the actuator assembly includes a main housing, and an actuator shaft configured to move relative to the main housing, wherein the actuator assembly includes a first pin fixed to the elongate member housing and a second pin fixed to the actuator shaft and to the internal carriage assembly, such that when the actuator is activated the actuator shaft extends and moves the internal carriage assembly relative to the elongate member housing.

18. An automated rumble strip assembly comprising:

a frame having a top surface configured to support a vehicle tire moving along the frame; and a plurality of elongate members disposed within the frame and movable relative to the top surface, wherein each elongate member includes an elongate member housing, and an actuator assembly disposed at least partially within the elongate member housing and configured to move the elongate member housing between a raised position and a recessed position relative to the top surface of the frame, wherein the actuator assembly is configured to move with the elongate member housing between the raised position and the recessed position; and at least one roller assembly disposed within the elongate member housing, wherein the at least one roller assembly includes at least one roller, and wherein the automated rumble strip assembly further includes at least one roller support that supports the at least one roller.

19. An automated rumble strip assembly comprising:

a frame having a top surface configured to support a vehicle tire moving along the frame; and a plurality of elongate members disposed within the frame and movable relative to the top surface, wherein each elongate member includes an elongate member housing, and an actuator assembly disposed at least partially within the elongate member housing and configured to move the elongate member housing between a raised position and a recessed position relative to the top surface of the frame, wherein the actuator assembly is configured to move with the elongate member housing between the raised position and the recessed position;

wherein each elongate member includes an internal carriage assembly, wherein each internal carriage assembly includes a plurality of carriage plates, wherein at least one of the carriage plates includes an elongate slot, wherein the elongate member housing includes a wall having an aperture, wherein the actuator assembly includes a coupling member that extends into and slides within the elongate slot, and wherein the coupling member additionally extends into the aperture.

20. An automated rumble strip assembly comprising:

a frame having a top surface configured to support a vehicle tire moving along the frame; and a plurality of elongate members disposed within the frame and movable relative to the top surface, wherein each elongate member includes an elongate member housing, and an actuator assembly disposed at least partially within the elongate member housing and configured to move the elongate member housing between a raised position and a recessed position relative to the top surface of the frame, wherein the actuator assembly is configured to move with the elongate member housing between the raised position and the recessed position;

wherein each elongate member further includes a shock absorber assembly disposed at least partially within the elongate member housing, wherein the shock absorber assembly includes core elements and a biasing element coupled to the core elements; and wherein each elongate member includes an internal carriage assembly, wherein each internal carriage assembly includes a plurality of carriage plates, wherein at least one of the carriage plates includes an elongate slot, wherein the elongate member housing includes a wall having an aperture, wherein the shock absorber assembly includes a first coupling member that extends into and slides within the elongate slot, and a second coupling member that extends into the aperture.

21. An automated rumble strip assembly comprising:

a frame having a top surface configured to support a vehicle tire moving along the frame; and a plurality of elongate members disposed within the frame and movable relative to the top surface, wherein each elongate member includes an elongate member housing, and an actuator assembly disposed at least partially within the elongate member housing and configured to move the elongate member housing between a raised position and a recessed position relative to the top surface of the frame, wherein the actuator assembly is configured to move with the elongate member housing between the raised position and the recessed position;

wherein each elongate member includes an internal carriage assembly, wherein the actuator assembly includes a main housing, and an actuator shaft configured to move relative to the main housing, wherein the actuator assembly includes a first pin fixed to the elongate member housing and a second pin fixed to the actuator shaft and to the internal carriage assembly, such that when the actuator is activated the actuator shaft extends and moves the internal carriage assembly relative to the elongate member housing.

* * * * *